US006222512B1

(12) United States Patent
Tajima et al.

(10) Patent No.: US 6,222,512 B1
(45) Date of Patent: Apr. 24, 2001

(54) INTRAFRAME TIME-DIVISION MULTIPLEXING TYPE DISPLAY DEVICE AND A METHOD OF DISPLAYING GRAY-SCALES IN AN INTRAFRAME TIME-DIVISION MULTIPLEXING TYPE DISPLAY DEVICE

(75) Inventors: Masaya Tajima; Toshio Ueda; Katsuhiro Ishida; Naoki Matsui; Kyoji Kariya; Akira Yamamoto; Hirohito Kuriyama, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 08/702,064

(22) Filed: Aug. 23, 1996

Related U.S. Application Data

(63) Continuation-in-part of application No. 08/368,002, filed on Jan. 3, 1995, now abandoned.

(30) Foreign Application Priority Data

Feb. 8, 1994 (JP) ..... 6-014421
Oct. 27, 1994 (JP) ..... 6-284244
Aug. 24, 1995 (JP) ..... 7-216120

(51) Int. Cl.[7] ..... G09G 3/22
(52) U.S. Cl. ..... 345/63
(58) Field of Search ..... 345/60, 63, 68, 345/147

(56) References Cited

U.S. PATENT DOCUMENTS 5,724,054 * 3/1998 Shinoda ..... 345/60
5,757,343 * 5/1998 Nagakubo ..... 345/63
5,835,072 * 11/1998 Kanazawa ..... 345/60
5,874,932 * 2/1999 Nagaoka et al. ..... 345/60
5,973,655 * 10/1999 Fujisaki et al. ..... 345/63
6,025,818 * 2/2000 Okano ..... 345/63

FOREIGN PATENT DOCUMENTS 1-200396 8/1989 (JP) .
3-145691 6/1991 (JP) .
4-127194 4/1992 (JP) .
6-010991 2/1994 (JP) .
7-248743 9/1995 (JP) .
7-271325 10/1995 (JP) .

OTHER PUBLICATIONS

Makino et al., "Improvement of Video Image Quality of AC–Plasma Display Panels by Suppressing the Unfavorable Coloration Effect with Sufficient Gray Shades Capability," *Proceedings of the Fifteenth International Display Research Conference,* Oct. 16–18, 1995, Hamamatsu, Japan, pp. 381–384.

* cited by examiner

*Primary Examiner*—Amare Mengistu
(74) *Attorney, Agent, or Firm*—Staas & Halsey LLP

(57) ABSTRACT

An intraframe time-division multiplexing type display device prevents prominent image defects, such as flicker, and affords a high-quality image display. A single frame of an image is displayed while changing a gray-scale level thereof by means of a number of sub-frames, each sub-frame comprising at least an address period and a sustained discharge period; further, the sub-frames have respective, mutually different sustained discharge periods. A gray-scale level adjustment unit arbitrarily sets the selection sequence of each of the number of sub-frames within an individual frame that is to be in a sustained discharge state.

5 Claims, 50 Drawing Sheets

| GRAY SCALE LEVEL | TURNED ON SUB-FRAMES |
|---|---|
| 1 | SF 1 |
| 2 | SF 2 |
| 3 | SF 1 , SF 2 |
| 4 | SF 3 |
| 5 | SF 3 , SF 1 |
| ⋮ | |
| 30 | SF2 ~ SF5 |
| 31 | SF1 ~ SF5 |
| 32 | SF6 |
| ⋮ | |
| 63 | SF1 ~ SF6 |

THE APPEARANCE OF THE LIGHT-EMITTING CELLS RESULTING WHEN THE SF6 TO 1 VERTICAL BLUE LINE IS DISPLAYED AND SCROLLING IS DONE 1 DOT AT TIME TO THE LEFT AT 1 $V_{SYNC}$.

THE APPEARANCE OF THE LIGHT-EMITTING CELLS RESULTING WHEN THE SF6 TO 1 VERTICAL BLUE LINE IS DISPLAYED AND SCROLLING IS DONE 2 DOTS AT TIME TO THE LEFT AT 1 $V_{SYNC.}$

Fig.16

SUB-FRAME TURN-ON SEQUENCE

NOTE: CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 8 (3) | 4 | 1 | 16 (2) | 8 (2) |
| 0 | | | | | | | | |
| 1 | | | | | | O | | |
| 2 | | | O | | | | | |
| 3 | | | O | | | O | | |
| 4 | | | | | O | | | |
| 5 | | | | | O | O | | |
| 6 | | | O | | O | | | |
| 7 | | | O | | O | O | | |
| 8 | | | | O | | | | |
| 9 | | | | O | | O | | |
| 10 | | | O | O | | | | |
| 11 | | | O | O | | O | | |
| 12 | | | | O | O | | | |
| 13 | | | | O | O | O | | |
| 14 | | | O | O | O | | | |
| 15 | | | O | O | O | O | | |
| 16 | O | | | O | | | | |
| 17 | O | | | O | | O | | |
| 18 | O | | O | O | | | | |
| 19 | O | | O | O | | O | | |
| 20 | O | | | O | O | | | |
| 21 | O | | | O | O | O | | |
| 22 | O | | O | O | O | | | |
| 23 | O | | O | O | O | O | | |
| 24 | O | | | O | | | | O |
| 25 | O | | | O | | O | | O |
| 26 | O | | O | O | | | | O |
| 27 | O | | O | O | | O | | O |
| 28 | O | | | O | O | | | O |
| 29 | O | | | O | O | O | | O |
| 30 | O | | O | O | O | | | O |
| 31 | O | | O | O | O | O | | O |

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 8 (3) | 4 | 1 | 16 (2) | 8 (2) |
| 32 | | O | | O | | | | O |
| 33 | | O | | O | | O | | O |
| 34 | | O | O | O | | | | O |
| 35 | | O | O | O | | O | | O |
| 36 | | O | | O | O | | | O |
| 37 | | O | | O | O | O | | O |
| 38 | | O | O | O | O | | | O |
| 39 | | O | O | O | O | O | | O |
| 40 | | O | | O | | | O | |
| 41 | | O | | O | | O | O | |
| 42 | | O | O | O | | | O | |
| 43 | | O | O | O | | O | O | |
| 44 | | O | | O | O | | O | |
| 45 | | O | | O | O | O | O | |
| 46 | | O | O | O | O | | O | |
| 47 | | O | O | O | O | O | O | |
| 48 | O | O | | O | | | O | |
| 49 | O | O | | O | | O | O | |
| 50 | O | O | O | O | | | O | |
| 51 | O | O | O | O | | O | O | |
| 52 | O | O | | O | O | | O | |
| 53 | O | O | | O | O | O | O | |
| 54 | O | O | O | O | O | | O | |
| 55 | O | O | O | O | O | O | O | |
| 56 | O | O | | O | | | O | O |
| 57 | O | O | | O | | O | O | O |
| 58 | O | O | O | O | | | O | O |
| 59 | O | O | O | O | | O | O | O |
| 60 | O | O | | O | O | | O | O |
| 61 | O | O | | O | O | O | O | O |
| 62 | O | O | O | O | O | | O | O |
| 63 | O | O | O | O | O | O | O | O |

(1ST MODE)

Fig.17

SUB-FRAME TURN-ON SEQUENCE

NOTE: CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 8 (3) | 4 | 1 | 16 (2) | 8 (2) |
| 0 | | | | | | | | |
| 1 | | | | | | O | | |
| 2 | | | O | | | | | |
| 3 | | | O | | | O | | |
| 4 | | | | | O | | | |
| 5 | | | | | O | O | | |
| 6 | | | O | | O | | | |
| 7 | | | O | | O | O | | |
| 8 | | | | O | | | | |
| 9 | | | | O | | O | | |
| 10 | | | O | O | | | | |
| 11 | | | O | O | | O | | |
| 12 | | | | O | O | | | |
| 13 | | | | O | O | O | | |
| 14 | | | O | O | O | | | |
| 15 | | | O | O | O | O | | |
| 16 | | | | O | | | | O |
| 17 | | | | O | | O | | O |
| 18 | | | O | O | | | | O |
| 19 | | | O | O | | O | | O |
| 20 | | | | O | O | | | O |
| 21 | | | | O | O | O | | O |
| 22 | | | O | O | O | | | O |
| 23 | | | O | O | O | O | | O |
| 24 | O | | | O | | | | O |
| 25 | O | | | O | | O | | O |
| 26 | O | | O | O | | | | O |
| 27 | O | | O | O | | O | | O |
| 28 | O | | | O | O | | | O |
| 29 | O | | | O | O | O | | O |
| 30 | O | | O | O | O | | | O |
| 31 | O | | O | O | O | O | | O |

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 8 (3) | 4 | 1 | 16 (2) | 8 (2) |
| 32 | O | | | O | | | O | |
| 33 | O | | | O | | O | O | |
| 34 | O | | O | O | | | O | |
| 35 | O | | O | O | | O | O | |
| 36 | O | | | O | O | | O | |
| 37 | O | | | O | O | O | O | |
| 38 | O | | O | O | O | | O | |
| 39 | O | | O | O | O | O | O | |
| 40 | | O | | O | | | O | |
| 41 | | O | | O | | O | O | |
| 42 | | O | O | O | | | O | |
| 43 | | O | O | O | | O | O | |
| 44 | | O | | O | O | | O | |
| 45 | | O | | O | O | O | O | |
| 46 | | O | O | O | O | | O | |
| 47 | | O | O | O | O | O | O | |
| 48 | | O | | O | | | O | O |
| 49 | | O | | O | | O | O | O |
| 50 | | O | O | O | | | O | O |
| 51 | | O | O | O | | O | O | O |
| 52 | | O | | O | O | | O | O |
| 53 | | O | | O | O | O | O | O |
| 54 | | O | O | O | O | | O | O |
| 55 | | O | O | O | O | O | O | O |
| 56 | O | O | | O | | | O | O |
| 57 | O | O | | O | | O | O | O |
| 58 | O | O | O | O | | | O | O |
| 59 | O | O | O | O | | O | O | O |
| 60 | O | O | | O | O | | O | O |
| 61 | O | O | | O | O | O | O | O |
| 62 | O | O | O | O | O | | O | O |
| 63 | O | O | O | O | O | O | O | O |

(2ND MODE)

Fig.18

SUB-FRAME TURN-ON SEQUENCE

NOTE: CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 16 (3) | 4 | 1 | 16 (2) | 8 (2) |
| 0 | | | | | | | | |
| 1 | | | | | | ○ | | |
| 2 | | | ○ | | | | | |
| 3 | | | ○ | | | ○ | | |
| 4 | | | | | ○ | | | |
| 5 | | | | | ○ | ○ | | |
| 6 | | | ○ | | ○ | | | |
| 7 | | | ○ | | ○ | ○ | | |
| 8 | ○ | | | | | | | |
| 9 | ○ | | | | | ○ | | |
| 10 | ○ | | ○ | | | | | |
| 11 | ○ | | ○ | | | ○ | | |
| 12 | ○ | | | | ○ | | | |
| 13 | ○ | | | | ○ | ○ | | |
| 14 | ○ | | ○ | | ○ | | | |
| 15 | ○ | | ○ | | ○ | ○ | | |
| 16 | | | | ○ | | | | |
| 17 | | | | ○ | | ○ | | |
| 18 | | | ○ | ○ | | | | |
| 19 | | | ○ | ○ | | ○ | | |
| 20 | | | | ○ | ○ | | | |
| 21 | | | | ○ | ○ | ○ | | |
| 22 | | | ○ | ○ | ○ | | | |
| 23 | | | ○ | ○ | ○ | ○ | | |
| 24 | ○ | | | ○ | | | | |
| 25 | ○ | | | ○ | | ○ | | |
| 26 | ○ | | ○ | ○ | | | | |
| 27 | ○ | | ○ | ○ | | ○ | | |
| 28 | ○ | | | ○ | ○ | | | |
| 29 | ○ | | | ○ | ○ | ○ | | |
| 30 | ○ | | ○ | ○ | ○ | | | |
| 31 | ○ | | ○ | ○ | ○ | ○ | | |
| 32 | ○ | | | ○ | | | | ○ |
| 33 | ○ | | | ○ | | ○ | | ○ |
| 34 | ○ | | ○ | ○ | | | | ○ |
| 35 | ○ | | ○ | ○ | | ○ | | ○ |

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 16 (3) | 4 | 1 | 16 (2) | 8 (2) |
| 36 | ○ | | | ○ | ○ | | | ○ |
| 37 | ○ | | | ○ | ○ | ○ | | ○ |
| 38 | ○ | | ○ | ○ | ○ | | | ○ |
| 39 | ○ | | ○ | ○ | ○ | ○ | | ○ |
| 40 | | ○ | | ○ | | | | ○ |
| 41 | | ○ | | ○ | | ○ | | ○ |
| 42 | | ○ | ○ | ○ | | | | ○ |
| 43 | | ○ | ○ | ○ | | ○ | | ○ |
| 44 | | ○ | | ○ | ○ | | | ○ |
| 45 | | ○ | | ○ | ○ | ○ | | ○ |
| 46 | | ○ | ○ | ○ | ○ | | | ○ |
| 47 | | ○ | ○ | ○ | ○ | ○ | | ○ |
| 48 | | ○ | | ○ | | | ○ | |
| 49 | | ○ | | ○ | | ○ | ○ | |
| 50 | | ○ | ○ | ○ | | | ○ | |
| 51 | | ○ | ○ | ○ | | ○ | ○ | |
| 52 | | ○ | | ○ | ○ | | ○ | |
| 53 | | ○ | | ○ | ○ | ○ | ○ | |
| 54 | | ○ | ○ | ○ | ○ | | ○ | |
| 55 | | ○ | ○ | ○ | ○ | ○ | ○ | |
| 56 | ○ | ○ | | ○ | | | ○ | |
| 57 | ○ | ○ | | ○ | | ○ | ○ | |
| 58 | ○ | ○ | ○ | ○ | | | ○ | |
| 59 | ○ | ○ | ○ | ○ | | ○ | ○ | |
| 60 | ○ | ○ | | ○ | ○ | | ○ | |
| 61 | ○ | ○ | | ○ | ○ | ○ | ○ | |
| 62 | ○ | ○ | ○ | ○ | ○ | | ○ | |
| 63 | ○ | ○ | ○ | ○ | ○ | ○ | ○ | |
| 64 | ○ | ○ | | ○ | | | ○ | ○ |
| 65 | ○ | ○ | | ○ | | ○ | ○ | ○ |
| 66 | ○ | ○ | ○ | ○ | | | ○ | ○ |
| 67 | ○ | ○ | ○ | ○ | | ○ | ○ | ○ |
| 68 | ○ | ○ | | ○ | ○ | | ○ | ○ |
| 69 | ○ | ○ | | ○ | ○ | ○ | ○ | ○ |
| 70 | ○ | ○ | ○ | ○ | ○ | | ○ | ○ |
| 71 | ○ | ○ | ○ | ○ | ○ | ○ | ○ | ○ |

(1ST MODE)

Fig.19

SUB-FRAME TURN-ON SEQUENCE

NOTE: CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 16 (3) | 4 | 1 | 16 (2) | 8 (2) |
| 0 | | | | | | | | |
| 1 | | | | | | ○ | | |
| 2 | | | ○ | | | | | |
| 3 | | | ○ | | | ○ | | |
| 4 | | | | | ○ | | | |
| 5 | | | | | ○ | ○ | | |
| 6 | | | ○ | | ○ | | | |
| 7 | | | ○ | | ○ | ○ | | |
| 8 | ○ | | | | | | | ○ |
| 9 | ○ | | | | | ○ | | ○ |
| 10 | ○ | | ○ | | | | | ○ |
| 11 | ○ | | ○ | | | ○ | | ○ |
| 12 | ○ | | | | ○ | | | ○ |
| 13 | ○ | | | | ○ | ○ | | ○ |
| 14 | ○ | | ○ | | ○ | | | ○ |
| 15 | ○ | | ○ | | ○ | ○ | | ○ |
| 16 | | | | ○ | | | | |
| 17 | | | | ○ | | ○ | | |
| 18 | | | ○ | ○ | | | | |
| 19 | | | ○ | ○ | | ○ | | |
| 20 | | | | ○ | ○ | | | |
| 21 | | | | ○ | ○ | ○ | | |
| 22 | | | ○ | ○ | ○ | | | |
| 23 | | | ○ | ○ | ○ | ○ | | |
| 24 | | | | ○ | | | | ○ |
| 25 | | | | ○ | | ○ | | ○ |
| 26 | | | ○ | ○ | | | | ○ |
| 27 | | | ○ | ○ | | ○ | | ○ |
| 28 | | | | ○ | ○ | | | ○ |
| 29 | | | | ○ | ○ | ○ | | ○ |
| 30 | | | ○ | ○ | ○ | | | ○ |
| 31 | | | ○ | ○ | ○ | ○ | | ○ |
| 32 | ○ | | | ○ | | | | ○ |
| 33 | ○ | | | ○ | | ○ | | ○ |
| 34 | ○ | | ○ | ○ | | | | ○ |
| 35 | ○ | | ○ | ○ | | ○ | | ○ |

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 16 (3) | 4 | 1 | 16 (2) | 8 (2) |
| 36 | ○ | | | ○ | ○ | | | ○ |
| 37 | ○ | | | ○ | ○ | ○ | | ○ |
| 38 | ○ | | ○ | ○ | ○ | | | ○ |
| 39 | ○ | | ○ | ○ | ○ | ○ | | ○ |
| 40 | ○ | | | ○ | | | ○ | |
| 41 | ○ | | | ○ | | ○ | ○ | |
| 42 | ○ | | ○ | ○ | | | ○ | |
| 43 | ○ | | ○ | ○ | | ○ | ○ | |
| 44 | ○ | | | ○ | ○ | | ○ | |
| 45 | ○ | | | ○ | ○ | ○ | ○ | |
| 46 | ○ | | ○ | ○ | ○ | | ○ | |
| 47 | ○ | | ○ | ○ | ○ | ○ | ○ | |
| 48 | | ○ | | ○ | | | ○ | |
| 49 | | ○ | | ○ | | ○ | ○ | |
| 50 | | ○ | ○ | ○ | | | ○ | |
| 51 | | ○ | ○ | ○ | | ○ | ○ | |
| 52 | | ○ | | ○ | ○ | | ○ | |
| 53 | | ○ | | ○ | ○ | ○ | ○ | |
| 54 | | ○ | ○ | ○ | ○ | | ○ | |
| 55 | | ○ | ○ | ○ | ○ | ○ | ○ | |
| 56 | ○ | ○ | | ○ | | | ○ | ○ |
| 57 | ○ | ○ | | ○ | | ○ | ○ | ○ |
| 58 | ○ | ○ | ○ | ○ | | | ○ | ○ |
| 59 | ○ | ○ | ○ | ○ | | ○ | ○ | ○ |
| 60 | ○ | ○ | | ○ | ○ | | ○ | ○ |
| 61 | ○ | ○ | | ○ | ○ | ○ | ○ | ○ |
| 62 | ○ | ○ | ○ | ○ | ○ | | ○ | ○ |
| 63 | ○ | ○ | ○ | ○ | ○ | ○ | ○ | ○ |
| 64 | ○ | ○ | | ○ | | | ○ | ○ |
| 65 | ○ | ○ | | ○ | | ○ | ○ | ○ |
| 66 | ○ | ○ | ○ | ○ | | | ○ | ○ |
| 67 | ○ | ○ | ○ | ○ | | ○ | ○ | ○ |
| 68 | ○ | ○ | | ○ | ○ | | ○ | ○ |
| 69 | ○ | ○ | | ○ | ○ | ○ | ○ | ○ |
| 70 | ○ | ○ | ○ | ○ | ○ | | ○ | ○ |
| 71 | ○ | ○ | ○ | ○ | ○ | ○ | ○ | ○ |

(2ND MODE)

Fig.20

SUB-FRAME TURN-ON SEQUENCE IN FIRST MODE (A)

NOTE:CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | |
|---|---|---|---|---|---|---|---|
| | 4 (1) | 8 (1) | 2 | 4 (3) | 1 | 8 (2) | 4 (2) |
| 0 | | | | | | | |
| 1 | | | | | ○ | | |
| 2 | | | ○ | | | | |
| 3 | | | ○ | | ○ | | |
| 4 | | | | ○ | | | |
| 5 | | | | ○ | ○ | | |
| 6 | | | ○ | ○ | | | |
| 7 | | | ○ | ○ | ○ | | |
| 8 | ○ | | | ○ | | | |
| 9 | ○ | | | ○ | ○ | | |
| 10 | ○ | | ○ | ○ | | | |
| 11 | ○ | | ○ | ○ | | | |
| 12 | ○ | | | ○ | | | ○ |
| 13 | ○ | | | ○ | ○ | | ○ |
| 14 | ○ | | ○ | ○ | | | ○ |
| 15 | ○ | | ○ | ○ | ○ | | ○ |
| 16 | | ○ | | ○ | | | ○ |
| 17 | | ○ | | ○ | ○ | | ○ |
| 18 | | ○ | ○ | ○ | | | ○ |
| 19 | | ○ | ○ | ○ | ○ | | ○ |
| 20 | | ○ | | ○ | | ○ | |
| 21 | | ○ | | ○ | ○ | ○ | |
| 22 | | ○ | ○ | ○ | | ○ | |
| 23 | | ○ | ○ | ○ | ○ | ○ | |
| 24 | ○ | ○ | | ○ | | ○ | |
| 25 | ○ | ○ | | ○ | ○ | ○ | |
| 26 | ○ | ○ | ○ | ○ | | ○ | |
| 27 | ○ | ○ | ○ | ○ | ○ | ○ | |
| 28 | ○ | ○ | | ○ | | ○ | ○ |
| 29 | ○ | ○ | | ○ | ○ | ○ | ○ |
| 30 | ○ | ○ | ○ | ○ | | ○ | ○ |
| 31 | ○ | ○ | ○ | ○ | ○ | ○ | ○ |

Fig.21

SUB-FRAME TURN-ON SEQUENCE IN THE SECOND MODE (B)

NOTE:CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | |
|---|---|---|---|---|---|---|---|
| | 4 (1) | 8 (1) | 2 | 4 (3) | 1 | 8 (2) | 4 (2) |
| 0 | | | | | | | |
| 1 | | | | | ○ | | |
| 2 | | | ○ | | | | |
| 3 | | | ○ | | ○ | | |
| 4 | | | | ○ | | | |
| 5 | | | | ○ | ○ | | |
| 6 | | | ○ | ○ | | | |
| 7 | | | ○ | ○ | ○ | | |
| 8 | | | | ○ | | | ○ |
| 9 | | | | ○ | ○ | | ○ |
| 10 | | | ○ | ○ | | | ○ |
| 11 | | | ○ | ○ | | | ○ |
| 12 | ○ | | | ○ | | | ○ |
| 13 | ○ | | | ○ | ○ | | ○ |
| 14 | ○ | | ○ | ○ | | | ○ |
| 15 | ○ | | ○ | ○ | ○ | | ○ |
| 16 | ○ | | | ○ | | ○ | |
| 17 | ○ | | | ○ | ○ | ○ | |
| 18 | ○ | | ○ | ○ | | ○ | |
| 19 | ○ | | ○ | ○ | ○ | ○ | |
| 20 | | ○ | | ○ | | ○ | |
| 21 | | ○ | | ○ | ○ | ○ | |
| 22 | | ○ | ○ | ○ | | ○ | |
| 23 | | ○ | ○ | ○ | ○ | ○ | |
| 24 | | ○ | | ○ | | ○ | ○ |
| 25 | | ○ | | ○ | ○ | ○ | ○ |
| 26 | | ○ | ○ | ○ | | ○ | ○ |
| 27 | | ○ | ○ | ○ | ○ | ○ | ○ |
| 28 | ○ | ○ | | ○ | | ○ | ○ |
| 29 | ○ | ○ | | ○ | ○ | ○ | ○ |
| 30 | ○ | ○ | ○ | ○ | | ○ | ○ |
| 31 | ○ | ○ | ○ | ○ | ○ | ○ | ○ |

Fig.22

SUB-FRAME TURN-ON SEQUENCE

NOTE:CIRCLES INDICATE TURNED ON SUB-FRAMES AND BLANKS INDICATE NON-TURNED ON SUB-FRAMES.

| GRAY SCALE LEVEL | WEIGHTS OF SUB-FRAMES WITHIN FRAME | | | | | |
|---|---|---|---|---|---|---|
| | 4 (1) | 8 (1) | 2 | 1 | 8 (2) | 4 (2) |
| 0 | | | | | | |
| 1 | | | | O | | |
| 2 | | | O | | | |
| 3 | | | O | O | | |
| 4 | O | | | | | |
| 5 | O | | | O | | |
| 6 | O | | O | | | |
| 7 | O | | O | O | | |
| 8 | O | | | | | O |
| 9 | O | | | O | | O |
| 10 | O | | O | | | O |
| 11 | O | | O | O | | O |
| 12 | | O | | | | O |
| 13 | | O | | O | | O |
| 14 | | O | O | | | O |
| 15 | | O | O | O | | O |
| 16 | | O | | | O | |
| 17 | | O | | O | O | |
| 18 | | O | O | | O | |
| 19 | | O | O | O | O | |
| 20 | O | O | | | O | |
| 21 | O | O | | O | O | |
| 22 | O | O | O | | O | |
| 23 | O | O | O | O | O | |
| 24 | O | O | | | O | O |
| 25 | O | O | | O | O | O |
| 26 | O | O | O | | O | O |
| 27 | O | O | O | O | O | O |

(1ST MODE)

Fig.23

SUB-FRAME TURN-ON SEQUENCE

NOTE:CIRCLES INDICATE TURNED ON SUB-FRAMES AND BLANKS INDICATE NON-TURNED ON SUB-FRAMES.

| GRAY SCALE LEVEL | WEIGHTS OF SUB-FRAMES WITHIN FRAME | | | | | |
|---|---|---|---|---|---|---|
| | 4 (1) | 8 (1) | 2 | 1 | 8 (2) | 4 (2) |
| 0 | | | | | | |
| 1 | | | | ○ | | |
| 2 | | | ○ | | | |
| 3 | | | ○ | ○ | | |
| 4 | | | | | | ○ |
| 5 | | | | ○ | | ○ |
| 6 | | | ○ | | | ○ |
| 7 | | | ○ | ○ | | ○ |
| 8 | ○ | | | | | ○ |
| 9 | ○ | | | ○ | | ○ |
| 10 | ○ | | ○ | | | ○ |
| 11 | ○ | | ○ | ○ | | ○ |
| 12 | ○ | | | | ○ | |
| 13 | ○ | | | ○ | ○ | |
| 14 | ○ | | ○ | | ○ | |
| 15 | ○ | | ○ | ○ | ○ | |
| 16 | | ○ | | | ○ | |
| 17 | | ○ | | ○ | ○ | |
| 18 | | ○ | ○ | | ○ | |
| 19 | | ○ | ○ | ○ | ○ | |
| 20 | | ○ | | | ○ | ○ |
| 21 | | ○ | | ○ | ○ | ○ |
| 22 | | ○ | ○ | | ○ | ○ |
| 23 | | ○ | ○ | ○ | ○ | ○ |
| 24 | ○ | ○ | | | ○ | ○ |
| 25 | ○ | ○ | | ○ | ○ | ○ |
| 26 | ○ | ○ | ○ | | ○ | ○ |
| 27 | ○ | ○ | ○ | ○ | ○ | ○ |

(2ND MODE)

Fig.24(A)
A B A B
A B A B
A B A B
VERTICAL OVERLAP ONLY
Fig.24(B)
A A A A
B B B B
A A A A
HORIZONTAL OVERLAP ONLY
Fig.24(C)
A B A B
B A B A
A B A B
STAGGERED OVERLAP
Fig.24(D)
B A B A
A B A B
B A B A
OVERLAP THE REVERSE OF (C)
Fig.25
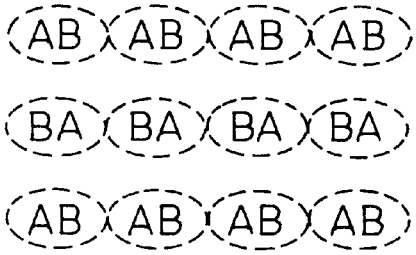
Fig.26
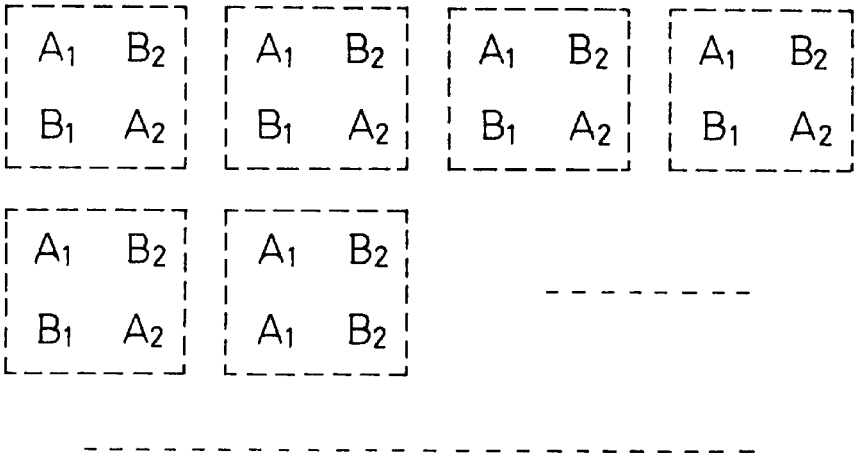

Fig.27

| | | |

Fig. 28

SUB-FRAME TURN-ON SEQUENCE

NOTE: CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 8 (3) | 4 | 1 | 16 (2) | 8 (2) |
| 0 | | | | | | | | |
| 1 | | | | | | ○ | | |
| 2 | | | ○ | | | | | |
| 3 | | | ○ | | | ○ | | |
| 4 | | | | | ○ | | | |
| 5 | | | | | ○ | ○ | | |
| 6 | | | ○ | | ○ | | | |
| 7 | | | ○ | | ○ | ○ | | |
| 8 | | | | ○ | | | | |
| 9 | | | | ○ | | ○ | | |
| 10 | | | ○ | ○ | | | | |
| 11 | | | ○ | ○ | | ○ | | |
| 12 | | | | ○ | ○ | | | |
| 13 | | | | ○ | ○ | ○ | | |
| 14 | | | ○ | ○ | ○ | | | |
| 15 | | | ○ | ○ | ○ | ○ | | |
| 16 | ○ | | | ○ | | | | |
| 17 | | | | ○ | | ○ | | ○ |
| 18 | ○ | | ○ | ○ | | | | |
| 19 | | | ○ | ○ | | ○ | | ○ |
| 20 | ○ | | | ○ | ○ | | | |
| 21 | | | | ○ | ○ | ○ | | ○ |
| 22 | ○ | | ○ | ○ | ○ | | | |
| 23 | | | ○ | ○ | ○ | ○ | | ○ |
| 24 | ○ | | | ○ | | | | ○ |
| 25 | ○ | | | ○ | | ○ | | ○ |
| 26 | ○ | | ○ | ○ | | | | ○ |
| 27 | ○ | | ○ | ○ | | ○ | | ○ |
| 28 | ○ | | | ○ | ○ | | | ○ |
| 29 | ○ | | | ○ | ○ | ○ | | ○ |
| 30 | ○ | | ○ | ○ | ○ | | | ○ |
| 31 | ○ | | ○ | ○ | ○ | ○ | | ○ |

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 8 (3) | 4 | 1 | 16 (2) | 8 (2) |
| 32 | | ○ | | ○ | | | | ○ |
| 33 | ○ | ○ | | ○ | | ○ | | |
| 34 | | ○ | ○ | ○ | | | | ○ |
| 35 | ○ | ○ | ○ | ○ | | ○ | | |
| 36 | | ○ | | ○ | ○ | | | ○ |
| 37 | ○ | ○ | | ○ | ○ | ○ | | |
| 38 | | ○ | ○ | ○ | ○ | | | ○ |
| 39 | ○ | ○ | ○ | ○ | ○ | ○ | | |
| 40 | | ○ | | ○ | | | ○ | |
| 41 | | ○ | | ○ | | ○ | ○ | |
| 42 | | ○ | ○ | ○ | | | ○ | |
| 43 | | ○ | ○ | ○ | | ○ | ○ | |
| 44 | | ○ | | ○ | ○ | | ○ | |
| 45 | | ○ | | ○ | ○ | ○ | ○ | |
| 46 | | ○ | ○ | ○ | ○ | | ○ | |
| 47 | | ○ | ○ | ○ | ○ | ○ | ○ | |
| 48 | ○ | ○ | | ○ | | | ○ | |
| 49 | | ○ | | ○ | | ○ | ○ | ○ |
| 50 | ○ | ○ | ○ | ○ | | | ○ | |
| 51 | | ○ | ○ | ○ | | ○ | ○ | ○ |
| 52 | ○ | ○ | | ○ | ○ | | ○ | |
| 53 | | ○ | | ○ | ○ | ○ | ○ | ○ |
| 54 | ○ | ○ | ○ | ○ | ○ | | ○ | |
| 55 | | ○ | ○ | ○ | ○ | ○ | ○ | ○ |
| 56 | ○ | ○ | | ○ | | | ○ | ○ |
| 57 | ○ | ○ | | ○ | | ○ | ○ | ○ |
| 58 | ○ | ○ | ○ | ○ | | | ○ | ○ |
| 59 | ○ | ○ | ○ | ○ | | ○ | ○ | ○ |
| 60 | ○ | ○ | | ○ | ○ | | ○ | ○ |
| 61 | ○ | ○ | | ○ | ○ | ○ | ○ | ○ |
| 62 | ○ | ○ | ○ | ○ | ○ | | ○ | ○ |
| 63 | ○ | ○ | ○ | ○ | ○ | ○ | ○ | ○ |

(1ST MODE)

Fig.29

SUB-FRAME TURN-ON SEQUENCE

NOTE: CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 8 (3) | 4 | 1 | 16 (2) | 8 (2) |
| 0 | | | | | | | | |
| 1 | | | | | | O | | |
| 2 | | | O | | | | | |
| 3 | | | O | | | O | | |
| 4 | | | | | O | | | |
| 5 | | | | | O | O | | |
| 6 | | | O | | O | | | |
| 7 | | | O | | O | O | | |
| 8 | | | | O | | | | |
| 9 | | | | O | | O | | |
| 10 | | | O | O | | | | |
| 11 | | | O | O | | O | | |
| 12 | | | | O | O | | | |
| 13 | | | | O | O | O | | |
| 14 | | | O | O | O | | | |
| 15 | | | O | O | O | O | | |
| 16 | | | | O | | | | O |
| 17 | O | | | O | | O | | |
| 18 | | | O | O | | | | O |
| 19 | O | | O | O | | O | | |
| 20 | | | | O | O | | | O |
| 21 | O | | | O | O | O | | |
| 22 | | | O | O | O | | | O |
| 23 | O | | O | O | O | O | | |
| 24 | O | | | O | | | | O |
| 25 | O | | | O | | O | | O |
| 26 | O | | O | O | | | | O |
| 27 | O | | O | O | | O | | O |
| 28 | O | | | O | O | | | O |
| 29 | O | | | O | O | O | | O |
| 30 | O | | O | O | O | | | O |
| 31 | O | | O | O | O | O | | O |

| GRAY SCALE LEVEL | WEIGHT ARRANGEMENT OF SUB-FRAMES WITHIN FRAME | | | | | | | |
|---|---|---|---|---|---|---|---|---|
| | 8 (1) | 16 (1) | 2 | 8 (3) | 4 | 1 | 16 (2) | 8 (2) |
| 32 | O | | | O | | | O | |
| 33 | | | | O | | O | O | O |
| 34 | O | | O | O | | | O | |
| 35 | | | O | O | | O | O | O |
| 36 | O | | | O | O | | O | |
| 37 | | | | O | O | O | O | O |
| 38 | O | | O | O | O | | O | |
| 39 | | | O | O | O | O | O | O |
| 40 | | O | | O | | | O | |
| 41 | | O | | O | | O | O | |
| 42 | | O | O | O | | | O | |
| 43 | | O | O | O | | O | O | |
| 44 | | O | | O | O | | O | |
| 45 | | O | | O | O | O | O | |
| 46 | | O | O | O | O | | O | |
| 47 | | O | O | O | O | O | O | |
| 48 | | O | | O | | | O | O |
| 49 | O | O | | O | | O | O | |
| 50 | | O | O | O | | | O | O |
| 51 | O | O | O | O | | O | O | |
| 52 | | O | | O | O | | O | O |
| 53 | O | O | | O | O | O | O | |
| 54 | | O | O | O | O | | O | O |
| 55 | O | O | O | O | O | O | O | |
| 56 | O | O | | O | | | O | O |
| 57 | O | O | | O | | O | O | O |
| 58 | O | O | O | O | | | O | O |
| 59 | O | O | O | O | | O | O | O |
| 60 | O | O | | O | O | | O | O |
| 61 | O | O | | O | O | O | O | O |
| 62 | O | O | O | O | O | | O | O |
| 63 | O | O | O | O | O | O | O | O |

(2ND MODE)

Fig.30

SUB-FRAME TURN-ON SEQUENCE IN FIRST MODE (A)

NOTE:CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | |
|---|---|---|---|---|---|---|---|
| | 2 | 8 (1) | 16 (1) | 4 | 16 (2) | 8 (2) | 1 |
| 0 | | | | | | | |
| 1 | | | | | | | ○ |
| 2 | ○ | | | | | | |
| 3 | ○ | | | | | | ○ |
| 4 | | | | ○ | | | |
| 5 | | | | ○ | | | ○ |
| 6 | ○ | | | ○ | | | |
| 7 | ○ | | | ○ | | | ○ |
| 8 | | ○ | | | | | |
| 9 | | ○ | | | | | ○ |
| 10 | ○ | ○ | | | | | |
| 11 | ○ | ○ | | | | | ○ |
| 12 | | ○ | | ○ | | | |
| 13 | | ○ | | ○ | | | ○ |
| 14 | ○ | ○ | | ○ | | | |
| 15 | ○ | ○ | | ○ | | | ○ |
| 16 | | ○ | | | | ○ | |
| 17 | | ○ | | | | ○ | ○ |
| 18 | ○ | ○ | | | | ○ | |
| 19 | ○ | ○ | | | | ○ | ○ |
| 20 | | ○ | | ○ | | ○ | |
| 21 | | ○ | | ○ | | ○ | ○ |
| 22 | ○ | ○ | | ○ | | ○ | |
| 23 | ○ | ○ | | ○ | | ○ | ○ |
| 24 | | | ○ | | | ○ | |
| 25 | | | ○ | | | ○ | ○ |
| 26 | ○ | | ○ | | | ○ | |
| 27 | ○ | | ○ | | | ○ | ○ |

| GRAY SCALE LEVEL | WEIGHT ARRANGEMENT OF SUB-FRAMES WITHIN FRAME | | | | | | |
|---|---|---|---|---|---|---|---|
| | 2 | 8 (1) | 16 (1) | 4 | 16 (2) | 8 (2) | 1 |
| 28 | | | ○ | ○ | | ○ | |
| 29 | | | ○ | ○ | | ○ | ○ |
| 30 | ○ | | ○ | ○ | | ○ | |
| 31 | ○ | | ○ | ○ | | ○ | ○ |
| 32 | | | ○ | | ○ | | |
| 33 | | | ○ | | ○ | | ○ |
| 34 | ○ | | ○ | | ○ | | |
| 35 | ○ | | ○ | | ○ | | ○ |
| 36 | | | ○ | ○ | ○ | | |
| 37 | | | ○ | ○ | ○ | | ○ |
| 38 | ○ | | ○ | ○ | ○ | | |
| 39 | ○ | | ○ | ○ | ○ | | ○ |
| 40 | | ○ | ○ | | ○ | | |
| 41 | | ○ | ○ | | ○ | | ○ |
| 42 | ○ | ○ | ○ | | ○ | | |
| 43 | ○ | ○ | ○ | | ○ | | ○ |
| 44 | | ○ | ○ | ○ | ○ | | |
| 45 | | ○ | ○ | ○ | ○ | | ○ |
| 46 | ○ | ○ | ○ | ○ | ○ | | |
| 47 | ○ | ○ | ○ | ○ | ○ | | ○ |
| 48 | | ○ | ○ | | ○ | ○ | |
| 49 | | ○ | ○ | | ○ | ○ | ○ |
| 50 | ○ | ○ | ○ | | ○ | ○ | |
| 51 | ○ | ○ | ○ | | ○ | ○ | ○ |
| 52 | | ○ | ○ | ○ | ○ | ○ | |
| 53 | | ○ | ○ | ○ | ○ | ○ | ○ |
| 54 | ○ | ○ | ○ | ○ | ○ | ○ | |
| 55 | ○ | ○ | ○ | ○ | ○ | ○ | ○ |

Fig.31

SUB-FRAME TURN-ON SEQUENCE IN THE SECOND MODE (B)

NOTE:CIRCLES INDICATE TURNED ON SUB-FRAMES AND BLANKS INDICATE NON-TURNED ON SUB-FRAMES.

| GRAY SCALE LEVEL | WEIGHT ARRANGEMENT OF SUB-FRAMES WITHIN FRAME | | | | | | |
|---|---|---|---|---|---|---|---|
| | 2 | 8 (1) | 16 (1) | 4 | 16 (2) | 8 (2) | 1 |
| 0 | | | | | | | |
| 1 | | | | | | | O |
| 2 | O | | | | | | |
| 3 | O | | | | | | O |
| 4 | | | | O | | | |
| 5 | | | | O | | | O |
| 6 | O | | | O | | | |
| 7 | O | | | O | | | O |
| 8 | | | | | | O | |
| 9 | | | | | | O | O |
| 10 | O | | | | | O | |
| 11 | O | | | | | O | O |
| 12 | | | | O | | O | |
| 13 | | | | O | | O | O |
| 14 | O | | | O | | O | |
| 15 | O | | | O | | O | O |
| 16 | | O | | | | O | |
| 17 | | O | | | | O | O |
| 18 | O | O | | | | O | |
| 19 | O | O | | | | O | O |
| 20 | | O | | O | | O | |
| 21 | | O | | O | | O | O |
| 22 | O | O | | O | | O | |
| 23 | O | O | | O | | O | O |
| 24 | | O | | | O | | |
| 25 | | O | | | O | | O |
| 26 | O | O | | | O | | |
| 27 | O | O | | | O | | O |

| GRAY SCALE LEVEL | WEIGHT ARRANGEMENT OF SUB-FRAMES WITHIN FRAME | | | | | | |
|---|---|---|---|---|---|---|---|
| | 2 | 8 (1) | 16 (1) | 4 | 16 (2) | 8 (2) | 1 |
| 28 | | O | | O | O | | |
| 29 | | O | | O | O | | O |
| 30 | O | O | | O | O | | |
| 31 | O | O | | O | O | | O |
| 32 | | | O | | O | | |
| 33 | | | O | | O | | O |
| 34 | O | | O | | O | | |
| 35 | O | | O | | O | | O |
| 36 | | | O | O | O | | |
| 37 | | | O | O | O | | O |
| 38 | O | | O | O | O | | |
| 39 | O | | O | O | O | | O |
| 40 | | | O | | O | O | |
| 41 | | | O | | O | O | O |
| 42 | O | | O | | O | O | |
| 43 | O | | O | | O | O | O |
| 44 | | | O | O | O | O | |
| 45 | | | O | O | O | O | O |
| 46 | O | | O | O | O | O | |
| 47 | O | | O | O | O | O | O |
| 48 | | O | O | | O | O | |
| 49 | | O | O | | O | O | O |
| 50 | O | O | O | | O | O | |
| 51 | O | O | O | | O | O | O |
| 52 | | O | O | O | O | O | |
| 53 | | O | O | O | O | O | O |
| 54 | O | O | O | O | O | O | |
| 55 | O | O | O | O | O | O | O |

Fig.36

GRAY SCALE LEVEL

| | WEIGHS OF SUB-FRAMES WITHIN FRAME (1st MODE) | | | | | | |
|---|---|---|---|---|---|---|---|
| | SF6 6 | SF4 4 | SF2 2 | SF1 1 | SF3 2 | SF5 4 | SF7 6 |
| 0 | | | | | | | |
| 1 | | | | ○ | | | |
| 2 | | | ○ | | | | |
| 3 | | | ○ | ○ | | | |
| 4 | | | ○ | | ○ | | |
| 5 | | | ○ | ○ | ○ | | |
| 6 | | ○ | | | ○ | | |
| 7 | | ○ | | ○ | ○ | | |
| 8 | | ○ | ○ | | ○ | | |
| 9 | | ○ | ○ | ○ | ○ | | |
| 10 | | ○ | ○ | | | ○ | |
| 11 | | ○ | ○ | ○ | | ○ | |
| 12 | | ○ | ○ | | ○ | ○ | |
| 13 | | ○ | ○ | ○ | ○ | ○ | |
| 14 | ○ | | ○ | | ○ | ○ | |
| 15 | ○ | | ○ | ○ | ○ | ○ | |
| 16 | ○ | ○ | | | ○ | ○ | |
| 17 | ○ | ○ | | ○ | ○ | ○ | |
| 18 | ○ | ○ | ○ | | ○ | ○ | |
| 19 | ○ | ○ | ○ | ○ | ○ | ○ | |
| 20 | ○ | ○ | ○ | | ○ | | ○ |
| 21 | ○ | ○ | ○ | ○ | ○ | | ○ |
| 22 | ○ | ○ | ○ | | | ○ | ○ |
| 23 | ○ | ○ | ○ | ○ | | ○ | ○ |
| 24 | ○ | ○ | ○ | | ○ | ○ | ○ |
| 25 | ○ | ○ | ○ | ○ | ○ | ○ | ○ |

GRAY SCALE LEVEL

NUMBER OF BITS: 7 TOTAL GRAY LEVELS: 26

| | WEIGHS OF SUB-FRAMES WITHIN FRAME (2nd MODE) | | | | | | |
|---|---|---|---|---|---|---|---|
| | SF6 6 | SF4 4 | SF2 2 | SF1 1 | SF3 2 | SF5 4 | SF7 6 |
| 0 | | | | | | | |
| 1 | | | | ○ | | | |
| 2 | | | | | ○ | | |
| 3 | | | | ○ | ○ | | |
| 4 | | | ○ | | ○ | | |
| 5 | | | ○ | ○ | ○ | | |
| 6 | | | ○ | | | ○ | |
| 7 | | | ○ | ○ | | ○ | |
| 8 | | | ○ | | ○ | ○ | |
| 9 | | | ○ | ○ | ○ | ○ | |
| 10 | | ○ | | | ○ | ○ | |
| 11 | | ○ | | ○ | ○ | ○ | |
| 12 | | ○ | ○ | | ○ | ○ | |
| 13 | | ○ | ○ | ○ | ○ | ○ | |
| 14 | | ○ | ○ | | ○ | | |
| 15 | | ○ | ○ | ○ | ○ | | |
| 16 | | ○ | ○ | | | ○ | ○ |
| 17 | | ○ | ○ | ○ | | ○ | ○ |
| 18 | | ○ | ○ | | ○ | ○ | ○ |
| 19 | | ○ | ○ | ○ | ○ | ○ | ○ |
| 20 | ○ | | ○ | | ○ | ○ | ○ |
| 21 | ○ | | ○ | ○ | ○ | ○ | ○ |
| 22 | ○ | ○ | | | ○ | ○ | ○ |
| 23 | ○ | ○ | | ○ | ○ | ○ | ○ |
| 24 | ○ | ○ | ○ | | ○ | ○ | ○ |
| 25 | ○ | ○ | ○ | ○ | ○ | ○ | ○ |

Fig.37

1st MODE

NUMBER OF BITS: 8 TOTAL GRAY LEVELS: 52

| GRAY SCALE LEVEL | WEIGHS OF SUB-FRAMES WITHIN FRAME | | | | | | | |
|---|---|---|---|---|---|---|---|---|
| | SF7 12 | SF5 8 | SF3 4 | SF1 1 | SF2 2 | SF4 4 | SF6 8 | SF8 12 |
| 0 | | | | | | | | |
| 1 | | | | ○ | | | | |
| 2 | | | | | ○ | | | |
| 3 | | | | ○ | ○ | | | |
| 4 | | | ○ | | | | | |
| 5 | | | ○ | ○ | | | | |
| 6 | | | ○ | | ○ | | | |
| 7 | | | ○ | ○ | ○ | | | |
| 8 | | | ○ | | | ○ | | |
| 9 | | | ○ | ○ | | ○ | | |
| 10 | | | ○ | | ○ | ○ | | |
| 11 | | | ○ | ○ | ○ | ○ | | |
| 12 | | ○ | | | | ○ | | |
| 13 | | ○ | | ○ | | ○ | | |
| 14 | | ○ | | | ○ | ○ | | |
| 15 | | ○ | | ○ | ○ | ○ | | |
| 16 | | ○ | | | | | ○ | |
| 17 | | ○ | | ○ | | | ○ | |
| 18 | | ○ | | | ○ | | ○ | |
| 19 | | ○ | | ○ | ○ | | ○ | |
| 20 | | ○ | ○ | | | | ○ | |
| 21 | | ○ | ○ | ○ | | | ○ | |
| 22 | | ○ | ○ | | ○ | | ○ | |
| 23 | | ○ | ○ | ○ | ○ | | ○ | |
| 24 | | ○ | ○ | | | ○ | ○ | |
| 25 | | ○ | ○ | ○ | | ○ | ○ | |

| GRAY SCALE LEVEL | WEIGHS OF SUB-FRAMES WITHIN FRAME | | | | | | | |
|---|---|---|---|---|---|---|---|---|
| | SF7 12 | SF5 8 | SF3 4 | SF1 1 | SF2 2 | SF4 4 | SF6 8 | SF8 12 |
| 26 | | ○ | ○ | | ○ | ○ | ○ | |
| 27 | | ○ | ○ | ○ | ○ | ○ | ○ | |
| 28 | ○ | | ○ | | | ○ | ○ | |
| 29 | ○ | | ○ | ○ | | ○ | ○ | |
| 30 | ○ | | ○ | | ○ | ○ | ○ | |
| 31 | ○ | | ○ | ○ | ○ | ○ | ○ | |
| 32 | ○ | ○ | | | | ○ | ○ | |
| 33 | ○ | ○ | | ○ | | ○ | ○ | |
| 34 | ○ | ○ | | | ○ | ○ | ○ | |
| 35 | ○ | ○ | | ○ | ○ | ○ | ○ | |
| 36 | ○ | ○ | ○ | | | ○ | ○ | |
| 37 | ○ | ○ | ○ | ○ | | ○ | ○ | |
| 38 | ○ | ○ | ○ | | ○ | ○ | ○ | |
| 39 | ○ | ○ | ○ | ○ | ○ | ○ | ○ | |
| 40 | ○ | ○ | ○ | | | ○ | | ○ |
| 41 | ○ | ○ | ○ | ○ | | ○ | | ○ |
| 42 | ○ | ○ | ○ | | ○ | ○ | | ○ |
| 43 | ○ | ○ | ○ | ○ | ○ | ○ | | ○ |
| 44 | ○ | ○ | ○ | | | | ○ | ○ |
| 45 | ○ | ○ | ○ | ○ | | | ○ | ○ |
| 46 | ○ | ○ | ○ | | ○ | | ○ | ○ |
| 47 | ○ | ○ | ○ | ○ | ○ | | ○ | ○ |
| 48 | ○ | ○ | ○ | | | ○ | ○ | ○ |
| 49 | ○ | ○ | ○ | ○ | | ○ | ○ | ○ |
| 50 | ○ | ○ | ○ | | ○ | ○ | ○ | ○ |
| 51 | ○ | ○ | ○ | ○ | ○ | ○ | ○ | ○ |

Fig.38

2nd MODE

NUMBER OF BITS: 8 TOTAL GRAY LEVELS: 52

| GRAY SCALE LEVEL | WEIGHS OF SUB-FRAMES WITHIN FRAME | | | | | | | |
|---|---|---|---|---|---|---|---|---|
| | SF7 12 | SF5 8 | SF3 4 | SF1 1 | SF2 2 | SF4 4 | SF6 8 | SF8 12 |
| 0 | | | | | | | | |
| 1 | | | | O | | | | |
| 2 | | | | | O | | | |
| 3 | | | | O | O | | | |
| 4 | | | | | | O | | |
| 5 | | | | O | | O | | |
| 6 | | | | | O | O | | |
| 7 | | | | O | O | O | | |
| 8 | | | O | | | O | | |
| 9 | | | O | O | | O | | |
| 10 | | | O | | O | O | | |
| 11 | | | O | O | O | O | | |
| 12 | | | O | | | | O | |
| 13 | | | O | O | | | O | |
| 14 | | | O | | O | | O | |
| 15 | | | O | O | O | | O | |
| 16 | | O | | | | | O | |
| 17 | | O | | O | | | O | |
| 18 | | O | | | O | | O | |
| 19 | | O | | O | O | | O | |
| 20 | | O | | | | O | O | |
| 21 | | O | | O | | O | O | |
| 22 | | O | | | O | O | O | |
| 23 | | O | | O | O | O | O | |
| 24 | | O | O | | | O | O | |
| 25 | | O | O | O | | O | O | |

| GRAY SCALE LEVEL | WEIGHS OF SUB-FRAMES WITHIN FRAME | | | | | | | |
|---|---|---|---|---|---|---|---|---|
| | SF7 12 | SF5 8 | SF3 4 | SF1 1 | SF2 2 | SF4 4 | SF6 8 | SF8 12 |
| 26 | | O | O | | O | O | O | |
| 27 | | O | O | O | O | O | O | |
| 28 | | O | O | | | O | | O |
| 29 | | O | O | O | | O | | O |
| 30 | | O | O | | O | O | | O |
| 31 | | O | O | O | O | O | | O |
| 32 | | O | O | | | | O | O |
| 33 | | O | O | O | | | O | O |
| 34 | | O | O | | O | | O | O |
| 35 | | O | O | O | O | | O | O |
| 36 | | O | O | | | O | O | O |
| 37 | | O | O | O | | O | O | O |
| 38 | | O | O | | O | O | O | O |
| 39 | | O | O | O | O | O | O | O |
| 40 | O | | O | | | O | O | O |
| 41 | O | | O | O | | O | O | O |
| 42 | O | | O | | O | O | O | O |
| 43 | O | | O | O | O | O | O | O |
| 44 | O | O | | | | O | O | O |
| 45 | O | O | | O | | O | O | O |
| 46 | O | O | | | O | O | O | O |
| 47 | O | O | | O | O | O | O | O |
| 48 | O | O | O | | | O | O | O |
| 49 | O | O | O | O | | O | O | O |
| 50 | O | O | O | | O | O | O | O |
| 51 | O | O | O | O | O | O | O | O |

Fig.39

GRAY SCALE LEVEL

| | WEIGHS OF SUB-FRAMES WITHIN FRAME (1st MODE) | | | | | | | | |
|---|---|---|---|---|---|---|---|---|---|
| | 24 1 | 16 1 | 8 1 | 4 | 1 | 2 | 8 2 | 16 2 | 24 2 |
| 0 | | | | | | | | | |
| 7 | | | | ○ | ○ | ○ | | | |
| 8 | | | ○ | | | | | | |
| 15 | | | ○ | ○ | ○ | ○ | | | |
| 16 | | | ○ | | | | ○ | | |
| 23 | | | ○ | ○ | ○ | ○ | ○ | | |
| 24 | | ○ | | | | | ○ | | |
| 31 | | ○ | | ○ | ○ | ○ | ○ | | |
| 32 | | ○ | | | | | | ○ | |
| 39 | | ○ | | ○ | ○ | ○ | | ○ | |
| 40 | | ○ | ○ | | | | | ○ | |
| 47 | | ○ | ○ | ○ | ○ | ○ | | ○ | |
| 48 | | ○ | ○ | | | | ○ | ○ | |
| 55 | | ○ | ○ | ○ | ○ | ○ | ○ | ○ | |
| 56 | ○ | | ○ | | | | ○ | ○ | |
| 63 | ○ | | ○ | ○ | ○ | ○ | ○ | ○ | |
| 64 | ○ | ○ | | | | | ○ | ○ | |
| 71 | ○ | ○ | | ○ | ○ | ○ | ○ | ○ | |
| 72 | ○ | ○ | ○ | | | | ○ | ○ | |
| 79 | ○ | ○ | ○ | ○ | ○ | ○ | ○ | ○ | |
| 80 | ○ | ○ | ○ | | | | ○ | | ○ |
| 87 | ○ | ○ | ○ | ○ | ○ | ○ | ○ | | ○ |
| 88 | ○ | ○ | ○ | | | | | ○ | ○ |
| 95 | ○ | ○ | ○ | ○ | ○ | ○ | | ○ | ○ |
| 96 | ○ | ○ | ○ | | | | ○ | ○ | ○ |
| 103 | ○ | ○ | ○ | ○ | ○ | ○ | ○ | ○ | ○ |

GRAY SCALE LEVEL

NUMBER OF BITS: 9

TOTAL GRAY LEVELS: 104

| | WEIGHS OF SUB-FRAMES WITHIN FRAME (2nd MODE) | | | | | | | | |
|---|---|---|---|---|---|---|---|---|---|
| | 24 1 | 16 1 | 8 1 | 4 | 1 | 2 | 8 2 | 16 2 | 24 2 |
| 0 | | | | | | | | | |
| 7 | | | | ○ | ○ | ○ | | | |
| 8 | | | | | | | ○ | | |
| 15 | | | | ○ | ○ | ○ | ○ | | |
| 16 | | | ○ | | | | ○ | | |
| 23 | | | ○ | ○ | ○ | ○ | ○ | | |
| 24 | | | ○ | | | | | ○ | |
| 31 | | | ○ | ○ | ○ | ○ | | ○ | |
| 32 | | ○ | | | | | | ○ | |
| 39 | | ○ | | ○ | ○ | ○ | | ○ | |
| 40 | | ○ | ○ | | | | | ○ | |
| 47 | | ○ | ○ | ○ | ○ | ○ | | ○ | |
| 48 | | ○ | ○ | | | | ○ | ○ | |
| 55 | | ○ | ○ | ○ | ○ | ○ | ○ | ○ | |
| 56 | | ○ | ○ | | | | ○ | | ○ |
| 63 | | ○ | ○ | ○ | ○ | ○ | ○ | | ○ |
| 64 | | ○ | ○ | | | | | ○ | ○ |
| 71 | | ○ | ○ | ○ | ○ | ○ | | ○ | ○ |
| 72 | | ○ | ○ | | | | ○ | ○ | ○ |
| 79 | | ○ | ○ | ○ | ○ | ○ | ○ | ○ | ○ |
| 80 | ○ | | ○ | | | | ○ | ○ | ○ |
| 87 | ○ | | ○ | ○ | ○ | ○ | ○ | ○ | ○ |
| 88 | ○ | ○ | | | | | ○ | ○ | ○ |
| 95 | ○ | ○ | | ○ | ○ | ○ | ○ | ○ | ○ |
| 96 | ○ | ○ | ○ | | | | ○ | ○ | ○ |
| 103 | ○ | ○ | ○ | ○ | ○ | ○ | ○ | ○ | ○ |

Fig.40

| GRAY SCALE LEVEL | WEIGHS OF SUB-FRAMES WITHIN FRAME (1st MODE) | | | | | | | | | |
|---|---|---|---|---|---|---|---|---|---|---|
| | 48 1 | 32 1 | 16 1 | 8 | 1 | 2 | 4 | 16 2 | 32 2 | 48 2 |
| 0 | | | | | | | | | | |
| 15 | | | | ○ | ○ | ○ | ○ | | | |
| 16 | | | ○ | | | | | | | |
| 31 | | | ○ | ○ | ○ | ○ | ○ | | | |
| 32 | | | ○ | | | | | ○ | | |
| 47 | | | ○ | ○ | ○ | ○ | ○ | ○ | | |
| 48 | | ○ | | | | | | ○ | | |
| 63 | | ○ | | ○ | ○ | ○ | ○ | ○ | | |
| 64 | | ○ | | | | | | | ○ | |
| 79 | | ○ | | ○ | ○ | ○ | ○ | | ○ | |
| 80 | | ○ | ○ | | | | | | ○ | |
| 95 | | ○ | ○ | ○ | ○ | ○ | ○ | | ○ | |
| 96 | | ○ | ○ | | | | | ○ | ○ | |
| 111 | | ○ | ○ | ○ | ○ | ○ | ○ | ○ | ○ | |
| 112 | ○ | | ○ | | | | | ○ | ○ | |
| 127 | ○ | | ○ | ○ | ○ | ○ | ○ | ○ | ○ | |
| 128 | ○ | ○ | | | | | | ○ | ○ | |
| 143 | ○ | ○ | | ○ | ○ | ○ | ○ | ○ | ○ | |
| 144 | ○ | ○ | ○ | | | | | ○ | ○ | |
| 159 | ○ | ○ | ○ | ○ | ○ | ○ | ○ | ○ | ○ | |
| 160 | ○ | ○ | ○ | | | | | ○ | | ○ |
| 175 | ○ | ○ | ○ | ○ | ○ | ○ | ○ | ○ | | ○ |
| 176 | ○ | ○ | ○ | | | | | | ○ | ○ |
| 191 | ○ | ○ | ○ | ○ | ○ | ○ | ○ | | ○ | ○ |
| 192 | ○ | ○ | ○ | | | | | ○ | ○ | ○ |
| 207 | ○ | ○ | ○ | ○ | ○ | ○ | ○ | ○ | ○ | ○ |

NUMBER OF BITS: 10 TOTAL GRAY LEVELS: 208

| GRAY SCALE LEVEL | WEIGHS OF SUB-FRAMES WITHIN FRAME (2nd MODE) | | | | | | | | | |
|---|---|---|---|---|---|---|---|---|---|---|
| | 48 1 | 32 1 | 16 1 | 8 | 1 | 2 | 4 | 16 2 | 32 2 | 48 2 |
| 0 | | | | | | | | | | |
| 15 | | | | ○ | ○ | ○ | ○ | | | |
| 16 | | | | | | | | ○ | | |
| 31 | | | | ○ | ○ | ○ | ○ | ○ | | |
| 32 | | | ○ | | | | | ○ | | |
| 47 | | | ○ | ○ | ○ | ○ | ○ | ○ | | |
| 48 | | | ○ | | | | | | ○ | |
| 63 | | | ○ | ○ | ○ | ○ | ○ | | ○ | |
| 64 | | ○ | | | | | | | ○ | |
| 79 | | ○ | | ○ | ○ | ○ | ○ | | ○ | |
| 80 | | ○ | ○ | | | | | | ○ | |
| 95 | | ○ | ○ | ○ | ○ | ○ | ○ | | ○ | |
| 96 | | ○ | ○ | | | | | ○ | ○ | |
| 111 | | ○ | ○ | ○ | ○ | ○ | ○ | ○ | ○ | |
| 112 | | ○ | ○ | | | | | ○ | | ○ |
| 127 | | ○ | ○ | ○ | ○ | ○ | ○ | ○ | | ○ |
| 128 | | ○ | ○ | | | | | | ○ | ○ |
| 143 | | ○ | ○ | ○ | ○ | ○ | ○ | | ○ | ○ |
| 144 | | ○ | ○ | | | | | ○ | ○ | ○ |
| 159 | | ○ | ○ | ○ | ○ | ○ | ○ | ○ | ○ | ○ |
| 160 | ○ | | ○ | | | | | ○ | ○ | ○ |
| 175 | ○ | | ○ | ○ | ○ | ○ | ○ | ○ | ○ | ○ |
| 176 | ○ | ○ | | | | | | ○ | ○ | ○ |
| 191 | ○ | ○ | | ○ | ○ | ○ | ○ | ○ | ○ | ○ |
| 192 | ○ | ○ | ○ | | | | | ○ | ○ | ○ |
| 207 | ○ | ○ | ○ | ○ | ○ | ○ | ○ | ○ | ○ | ○ |

Fig.41

1st MODE

NUMBER OF BITS: 9

TOTAL GRAY LEVELS: 46

| GRAY SCALE LEVEL | WEIGHS OF SUB-FRAMES WITHIN FRAME | | | | | | | | |
|---|---|---|---|---|---|---|---|---|---|
| | 101 | 61 | 41 | 21 | 1 | 22 | 42 | 62 | 102 |
| 0 | | | | | | | | | |
| 1 | | | | | ○ | | | | |
| 2 | | | | ○ | | | | | |
| 3 | | | | ○ | ○ | | | | |
| 4 | | | | ○ | | ○ | | | |
| 5 | | | | ○ | ○ | ○ | | | |
| 6 | | | ○ | | | ○ | | | |
| 7 | | | ○ | | ○ | ○ | | | |
| 8 | | | ○ | | | | ○ | | |
| 9 | | | ○ | | ○ | | ○ | | |
| 10 | | | ○ | ○ | | | ○ | | |
| 11 | | | ○ | ○ | ○ | | ○ | | |
| 12 | | | ○ | ○ | | ○ | ○ | | |
| 13 | | | ○ | ○ | ○ | ○ | ○ | | |
| 14 | | ○ | | ○ | | ○ | ○ | | |
| 15 | | ○ | | ○ | ○ | ○ | ○ | | |
| 16 | | ○ | ○ | | | ○ | ○ | | |
| 17 | | ○ | ○ | | ○ | ○ | ○ | | |
| 18 | | ○ | ○ | ○ | | ○ | ○ | | |
| 19 | | ○ | ○ | ○ | ○ | ○ | ○ | | |
| 20 | | ○ | ○ | ○ | | ○ | | ○ | |
| 21 | | ○ | ○ | ○ | ○ | ○ | | ○ | |
| 22 | | ○ | ○ | ○ | | | ○ | ○ | |

| GRAY SCALE LEVEL | WEIGHS OF SUB-FRAMES WITHIN FRAME | | | | | | | | |
|---|---|---|---|---|---|---|---|---|---|
| | 101 | 61 | 41 | 21 | 1 | 22 | 42 | 62 | 102 |
| 23 | | ○ | ○ | ○ | ○ | | ○ | ○ | |
| 24 | | ○ | ○ | ○ | | ○ | ○ | ○ | |
| 25 | | ○ | ○ | ○ | ○ | ○ | ○ | ○ | |
| 26 | ○ | | ○ | ○ | | | ○ | ○ | |
| 27 | ○ | | ○ | ○ | ○ | | ○ | ○ | |
| 28 | ○ | | ○ | ○ | | ○ | ○ | ○ | |
| 29 | ○ | | ○ | ○ | ○ | ○ | ○ | ○ | |
| 30 | ○ | ○ | | ○ | | ○ | ○ | ○ | |
| 31 | ○ | ○ | | ○ | ○ | ○ | ○ | ○ | |
| 32 | ○ | ○ | ○ | ○ | | | ○ | ○ | |
| 33 | ○ | ○ | ○ | ○ | ○ | | ○ | ○ | |
| 34 | ○ | ○ | ○ | ○ | | ○ | ○ | ○ | |
| 35 | ○ | ○ | ○ | ○ | ○ | ○ | ○ | ○ | |
| 36 | ○ | ○ | ○ | | | ○ | ○ | | ○ |
| 37 | ○ | ○ | ○ | | ○ | ○ | ○ | | ○ |
| 38 | ○ | ○ | ○ | ○ | | ○ | ○ | | ○ |
| 39 | ○ | ○ | ○ | ○ | ○ | ○ | ○ | | ○ |
| 40 | ○ | ○ | ○ | ○ | | ○ | | ○ | ○ |
| 41 | ○ | ○ | ○ | ○ | ○ | ○ | | ○ | ○ |
| 42 | ○ | ○ | ○ | | | ○ | ○ | ○ | ○ |
| 43 | ○ | ○ | ○ | | ○ | ○ | ○ | ○ | ○ |
| 44 | ○ | ○ | ○ | ○ | | ○ | ○ | ○ | ○ |
| 45 | ○ | ○ | ○ | ○ | ○ | ○ | ○ | ○ | ○ |

Fig.42

2nd MODE

NUMBER OF BITS: 9 TOTAL GRAY LEVELS: 46

| GRAY SCALE LEVEL | WEIGHS OF SUB-FRAMES WITHIN FRAME | | | | | | | | |
|---|---|---|---|---|---|---|---|---|---|
| | 101 | 61 | 41 | 21 | 1 | 22 | 42 | 62 | 102 |
| 0 | | | | | | | | | |
| 1 | | | | | O | | | | |
| 2 | | | | | | O | | | |
| 3 | | | | | O | O | | | |
| 4 | | | | O | | O | | | |
| 5 | | | | O | O | O | | | |
| 6 | | | | O | | | O | | |
| 7 | | | | O | O | | O | | |
| 8 | | | O | | | | O | | |
| 9 | | | O | | O | | O | | |
| 10 | | | O | | | O | O | | |
| 11 | | | O | | O | O | O | | |
| 12 | | | O | O | | O | O | | |
| 13 | | | O | O | O | O | O | | |
| 14 | | | O | O | | O | | O | |
| 15 | | | O | O | O | O | | O | |
| 16 | | | O | O | | | O | O | |
| 17 | | | O | O | O | | O | O | |
| 18 | | | O | O | | O | O | O | |
| 19 | | | O | O | O | O | O | O | |
| 20 | | O | | O | | O | O | O | |
| 21 | | O | | O | O | O | O | O | |
| 22 | | O | O | | | O | O | O | |

| GRAY SCALE LEVEL | WEIGHS OF SUB-FRAMES WITHIN FRAME | | | | | | | | |
|---|---|---|---|---|---|---|---|---|---|
| | 101 | 61 | 41 | 21 | 1 | 22 | 42 | 62 | 102 |
| 23 | | O | O | | O | O | O | O | |
| 24 | | O | O | O | | O | O | O | |
| 25 | | O | O | O | O | O | O | O | |
| 26 | | O | O | | | O | O | | O |
| 27 | | O | O | | O | O | O | | O |
| 28 | | O | O | O | | O | O | | O |
| 29 | | O | O | O | O | O | O | | O |
| 30 | | O | O | O | | O | | O | O |
| 31 | | O | O | O | O | O | | O | O |
| 32 | | O | O | | | O | O | O | O |
| 33 | | O | O | | O | O | O | O | O |
| 34 | | O | O | O | | O | O | O | O |
| 35 | | O | O | O | O | O | O | O | O |
| 36 | O | | O | O | | | O | O | O |
| 37 | O | | O | O | O | | O | O | O |
| 38 | O | | O | O | | O | O | O | O |
| 39 | O | | O | O | O | O | O | O | O |
| 40 | O | O | | O | | O | O | O | O |
| 41 | O | O | | O | O | O | O | O | O |
| 42 | O | O | O | O | | | O | O | O |
| 43 | O | O | O | O | O | | O | O | O |
| 44 | O | O | O | O | | O | O | O | O |
| 45 | O | O | O | O | O | O | O | O | O |

Fig.43

1st MODE

NUMBER OF BITS: 10 TOTAL GRAY LEVELS: 92

| GRAY SCALE LEVEL | WEIGHS OF SUB-FRAMES WITHIN FRAME | | | | | | | | | |
|---|---|---|---|---|---|---|---|---|---|---|
| | 20 1 | 12 1 | 8 1 | 4 1 | 1 | 2 | 4 2 | 8 2 | 12 2 | 20 2 |
| 0 | | | | | | | | | | |
| 3 | | | | | O | O | | | | |
| 4 | | | | O | | | | | | |
| 7 | | | | O | O | O | | | | |
| 8 | | | | O | | | O | | | |
| 11 | | | | O | O | O | O | | | |
| 12 | | | O | | | | O | | | |
| 15 | | | O | | O | O | O | | | |
| 16 | | | O | | | | | O | | |
| 19 | | | O | | O | O | | O | | |
| 20 | | | O | O | | | | O | | |
| 23 | | | O | O | O | O | | O | | |
| 24 | | | O | O | | | O | O | | |
| 27 | | | O | O | O | O | O | O | | |
| 28 | | O | | O | | | O | O | | |
| 31 | | O | | O | O | O | O | O | | |
| 32 | | O | O | | | | O | O | | |
| 35 | | O | O | | O | O | O | O | | |
| 36 | | O | O | O | | | O | O | | |
| 39 | | O | O | O | O | O | O | O | | |
| 40 | | O | O | O | | | O | | O | |
| 43 | | O | O | O | O | O | O | | O | |
| 44 | | O | O | O | | | | O | O | |

| GRAY SCALE LEVEL | WEIGHS OF SUB-FRAMES WITHIN FRAME | | | | | | | | | |
|---|---|---|---|---|---|---|---|---|---|---|
| | 20 1 | 12 1 | 8 1 | 4 1 | 1 | 2 | 4 2 | 8 2 | 12 2 | 20 2 |
| 47 | | O | O | O | O | O | | O | O | |
| 48 | | O | O | O | | | O | O | O | |
| 51 | | O | O | O | O | O | O | O | O | |
| 52 | O | | O | O | | | | O | O | |
| 55 | O | | O | O | O | O | | O | O | |
| 56 | O | | O | O | | | O | O | O | |
| 59 | O | | O | O | O | O | O | O | O | |
| 60 | O | O | | O | | | O | O | O | |
| 63 | O | O | | O | O | O | O | O | O | |
| 64 | O | O | O | O | | | | O | O | |
| 67 | O | O | O | O | O | O | | O | O | |
| 68 | O | O | O | O | | | O | O | O | |
| 71 | O | O | O | O | O | O | O | O | O | |
| 72 | O | O | O | | | | O | O | | O |
| 75 | O | O | O | | O | O | O | O | | O |
| 76 | O | O | O | O | | | O | O | | O |
| 79 | O | O | O | O | O | O | O | O | | O |
| 80 | O | O | O | O | | | O | | O | O |
| 83 | O | O | O | O | O | O | O | | O | O |
| 84 | O | O | O | | | | O | O | O | O |
| 87 | O | O | O | | O | O | O | O | O | O |
| 88 | O | O | O | O | | | O | O | O | O |
| 91 | O | O | O | O | O | O | O | O | O | O |

Fig.44

2nd MODE

NUMBER OF BITS: 10 TOTAL GRAY LEVELS: 92

| GRAY SCALE LEVEL | WEIGHS OF SUB-FRAMES WITHIN FRAME | | | | | | | | | |
|---|---|---|---|---|---|---|---|---|---|---|
| | 20 1 | 12 1 | 8 1 | 4 1 | 1 | 2 | 4 2 | 8 2 | 12 2 | 20 2 |
| 0 | | | | | | | | | | |
| 3 | | | | | ○ | | | | | |
| 4 | | | | | | ○ | ○ | | | |
| 7 | | | | | ○ | ○ | ○ | | | |
| 8 | | | | ○ | | ○ | ○ | | | |
| 11 | | | | ○ | ○ | ○ | ○ | | | |
| 12 | | | | ○ | | | | ○ | | |
| 15 | | | | ○ | ○ | | | ○ | | |
| 16 | | | ○ | | | | | ○ | | |
| 19 | | | ○ | | ○ | | | ○ | | |
| 20 | | | ○ | | | ○ | ○ | ○ | | |
| 23 | | | ○ | | ○ | ○ | ○ | ○ | | |
| 24 | | | ○ | ○ | | ○ | ○ | ○ | | |
| 27 | | | ○ | ○ | ○ | ○ | ○ | ○ | | |
| 28 | | | ○ | ○ | | ○ | ○ | | ○ | |
| 31 | | | ○ | ○ | ○ | ○ | ○ | | ○ | |
| 32 | | | ○ | ○ | | | | ○ | ○ | |
| 35 | | | ○ | ○ | ○ | | | ○ | ○ | |
| 36 | | | ○ | ○ | | ○ | ○ | ○ | ○ | |
| 39 | | | ○ | ○ | ○ | ○ | ○ | ○ | ○ | |
| 40 | | ○ | | ○ | | ○ | ○ | ○ | ○ | |
| 43 | | ○ | | ○ | ○ | ○ | ○ | ○ | ○ | |
| 44 | | ○ | ○ | | | ○ | ○ | ○ | ○ | |

| GRAY SCALE LEVEL | WEIGHS OF SUB-FRAMES WITHIN FRAME | | | | | | | | | |
|---|---|---|---|---|---|---|---|---|---|---|
| | 20 1 | 12 1 | 8 1 | 4 1 | 1 | 2 | 4 2 | 8 2 | 12 2 | 20 2 |
| 47 | | ○ | ○ | | ○ | ○ | ○ | ○ | ○ | |
| 48 | | ○ | ○ | ○ | | ○ | ○ | ○ | ○ | |
| 51 | | ○ | ○ | ○ | ○ | ○ | ○ | ○ | ○ | |
| 52 | | ○ | ○ | | | ○ | ○ | ○ | | ○ |
| 55 | | ○ | ○ | | ○ | ○ | ○ | ○ | | ○ |
| 56 | | ○ | ○ | ○ | | ○ | ○ | ○ | | ○ |
| 59 | | ○ | ○ | ○ | ○ | ○ | ○ | ○ | | ○ |
| 60 | | ○ | ○ | ○ | | ○ | ○ | | ○ | ○ |
| 63 | | ○ | ○ | ○ | ○ | ○ | ○ | | ○ | ○ |
| 64 | | ○ | ○ | | | | ○ | ○ | ○ | ○ |
| 67 | | ○ | ○ | | ○ | ○ | ○ | ○ | ○ | ○ |
| 68 | | ○ | ○ | ○ | | | ○ | ○ | ○ | ○ |
| 71 | | ○ | ○ | ○ | ○ | ○ | ○ | ○ | ○ | ○ |
| 72 | ○ | | ○ | ○ | | | | ○ | ○ | ○ |
| 75 | ○ | | ○ | ○ | ○ | ○ | | ○ | ○ | ○ |
| 76 | ○ | | ○ | ○ | | | ○ | ○ | ○ | ○ |
| 79 | ○ | | ○ | ○ | ○ | ○ | ○ | ○ | ○ | ○ |
| 80 | ○ | ○ | | ○ | | | ○ | ○ | ○ | ○ |
| 83 | ○ | ○ | | ○ | ○ | ○ | ○ | ○ | ○ | ○ |
| 84 | ○ | ○ | ○ | ○ | | | | ○ | ○ | ○ |
| 87 | ○ | ○ | ○ | ○ | ○ | ○ | | ○ | ○ | ○ |
| 88 | ○ | ○ | ○ | ○ | | | ○ | ○ | ○ | ○ |
| 91 | ○ | ○ | ○ | ○ | ○ | ○ | ○ | ○ | ○ | ○ |

Fig.45

1st MODE

GRAY SCALE LEVEL

| | WEIGHS OF SUB-FRAMES WITHIN FRAME | | | | | | | | | | |
|---|---|---|---|---|---|---|---|---|---|---|---|
| | 40 1 | 24 1 | 16 1 | 8 1 | 4 | 1 | 2 | 8 2 | 16 2 | 24 2 | 40 2 |
| 0 | | | | | | | | | | | |
| 7 | | | | | O | O | O | | | | |
| 8 | | | | O | | | | | | | |
| 15 | | | | O | O | O | O | | | | |
| 16 | | | | O | | | | O | | | |
| 23 | | | | O | O | O | O | O | | | |
| 24 | | | O | | | | | O | | | |
| 31 | | | O | | O | O | O | O | | | |
| 32 | | | O | | | | | | O | | |
| 39 | | | O | | O | O | O | | O | | |
| 40 | | | O | O | | | | | O | | |
| 47 | | | O | O | O | O | O | | O | | |
| 48 | | | O | O | | | | O | O | | |
| 55 | | | O | O | O | O | O | O | O | | |
| 56 | | O | | O | | | | O | O | | |
| 63 | | O | | O | O | O | O | O | O | | |
| 64 | | O | O | | | | | O | O | | |
| 71 | | O | O | | O | O | O | O | O | | |
| 72 | | O | O | O | | | | O | O | | |
| 79 | | O | O | O | O | O | O | O | O | | |
| 80 | | O | O | O | | | | O | | O | |
| 87 | | O | O | O | O | O | O | O | | O | |
| 88 | | O | O | O | | | | | O | O | |

GRAY SCALE LEVEL

NUMBER OF BITS: 11 TOTAL GRAY LEVELS: 184

| | WEIGHS OF SUB-FRAMES WITHIN FRAME | | | | | | | | | | |
|---|---|---|---|---|---|---|---|---|---|---|---|
| | 40 1 | 24 1 | 16 1 | 8 1 | 4 | 1 | 2 | 8 2 | 16 2 | 24 2 | 40 2 |
| 95 | | O | O | O | O | O | O | | O | O | |
| 96 | | O | O | O | | | | O | O | O | |
| 103 | | O | O | O | O | O | O | O | O | O | |
| 104 | O | | O | O | | | | | O | O | |
| 111 | O | | O | O | O | O | O | | O | O | |
| 112 | O | | O | O | | | | O | O | O | |
| 119 | O | | O | O | O | O | O | O | O | O | |
| 120 | O | O | | O | | | | O | O | O | |
| 127 | O | O | | O | O | O | O | O | O | O | |
| 128 | O | O | O | O | | | | | O | O | |
| 135 | O | O | O | O | O | O | O | | O | O | |
| 136 | O | O | O | O | | | | O | O | O | |
| 143 | O | O | O | O | O | O | O | O | O | O | |
| 144 | O | O | O | | | | | O | O | | O |
| 151 | O | O | O | | O | O | O | O | O | | O |
| 152 | O | O | O | O | | | | O | O | | O |
| 159 | O | O | O | O | O | O | O | O | O | | O |
| 160 | O | O | O | O | | | | O | | O | O |
| 167 | O | O | O | O | O | O | O | O | | O | O |
| 168 | O | O | O | | | | | O | O | O | O |
| 175 | O | O | O | | O | O | O | O | O | O | O |
| 176 | O | O | O | O | | | | O | O | O | O |
| 183 | O | O | O | O | O | O | O | O | O | O | O |

Fig.46

2nd MODE

NUMBER OF BITS: 11 TOTAL GRAY LEVELS: 184

| GRAY SCALE LEVEL | WEIGHS OF SUB-FRAMES WITHIN FRAME | | | | | | | | | | |
|---|---|---|---|---|---|---|---|---|---|---|---|
| | 40 1 | 24 1 | 16 1 | 8 1 | 4 | 1 | 2 | 8 2 | 16 2 | 24 2 | 40 2 |
| 0 | | | | | | | | | | | |
| 7 | | | | | ○ | ○ | ○ | | | | |
| 8 | | | | | | | | ○ | | | |
| 15 | | | | | ○ | ○ | ○ | ○ | | | |
| 16 | | | | ○ | | | | ○ | | | |
| 23 | | | | ○ | ○ | ○ | ○ | ○ | | | |
| 24 | | | | ○ | | | | | ○ | | |
| 31 | | | | ○ | ○ | ○ | ○ | | ○ | | |
| 32 | | | ○ | | | | | | ○ | | |
| 39 | | | ○ | | ○ | ○ | ○ | | ○ | | |
| 40 | | | ○ | | | | | ○ | ○ | | |
| 47 | | | ○ | | ○ | ○ | ○ | ○ | ○ | | |
| 48 | | | ○ | ○ | | | | ○ | ○ | | |
| 55 | | | ○ | ○ | ○ | ○ | ○ | ○ | ○ | | |
| 56 | | | ○ | ○ | | | | ○ | | ○ | |
| 63 | | | ○ | ○ | ○ | ○ | ○ | ○ | | ○ | |
| 64 | | | ○ | ○ | | | | | ○ | ○ | |
| 71 | | | ○ | ○ | ○ | ○ | ○ | | ○ | ○ | |
| 72 | | | ○ | ○ | | | | ○ | ○ | ○ | |
| 79 | | | ○ | ○ | ○ | ○ | ○ | ○ | ○ | ○ | |
| 80 | | ○ | | ○ | | | | ○ | ○ | ○ | |
| 87 | | ○ | | ○ | ○ | ○ | ○ | ○ | ○ | ○ | |
| 88 | | ○ | ○ | | | | | ○ | ○ | ○ | |

| GRAY SCALE LEVEL | WEIGHS OF SUB-FRAMES WITHIN FRAME | | | | | | | | | | |
|---|---|---|---|---|---|---|---|---|---|---|---|
| | 40 1 | 24 1 | 16 1 | 8 1 | 4 | 1 | 2 | 8 2 | 16 2 | 24 2 | 40 2 |
| 95 | | ○ | ○ | | ○ | ○ | ○ | ○ | ○ | ○ | |
| 96 | | ○ | ○ | ○ | | | | ○ | ○ | ○ | |
| 103 | | ○ | ○ | ○ | ○ | ○ | ○ | ○ | ○ | ○ | |
| 104 | | ○ | ○ | | | | | ○ | ○ | | ○ |
| 111 | | ○ | ○ | | ○ | ○ | ○ | ○ | ○ | | ○ |
| 112 | | ○ | ○ | ○ | | | | ○ | ○ | | ○ |
| 119 | | ○ | ○ | ○ | ○ | ○ | ○ | ○ | ○ | | ○ |
| 120 | | ○ | ○ | ○ | | | | ○ | | ○ | ○ |
| 127 | | ○ | ○ | ○ | ○ | ○ | ○ | ○ | | ○ | ○ |
| 128 | | ○ | ○ | | | | | ○ | ○ | ○ | ○ |
| 135 | | ○ | ○ | | ○ | ○ | ○ | ○ | ○ | ○ | ○ |
| 136 | | ○ | ○ | ○ | | | | ○ | ○ | ○ | ○ |
| 143 | | ○ | ○ | ○ | ○ | ○ | ○ | ○ | ○ | ○ | ○ |
| 144 | ○ | | ○ | ○ | | | | | ○ | ○ | ○ |
| 151 | ○ | | ○ | ○ | ○ | ○ | ○ | | ○ | ○ | ○ |
| 152 | ○ | | ○ | ○ | | | | ○ | ○ | ○ | ○ |
| 159 | ○ | | ○ | ○ | ○ | ○ | ○ | ○ | ○ | ○ | ○ |
| 160 | ○ | ○ | | ○ | | | | ○ | ○ | ○ | ○ |
| 167 | ○ | ○ | | ○ | ○ | ○ | ○ | ○ | ○ | ○ | ○ |
| 168 | ○ | ○ | ○ | ○ | | | | | ○ | ○ | ○ |
| 175 | ○ | ○ | ○ | ○ | ○ | ○ | ○ | | ○ | ○ | ○ |
| 176 | ○ | ○ | ○ | ○ | | | | ○ | ○ | ○ | ○ |
| 183 | ○ | ○ | ○ | ○ | ○ | ○ | ○ | ○ | ○ | ○ | ○ |

Fig.47

1st MODE

NUMBER OF BITS: 8 TOTAL GRAY LEVELS: 50

| GRAY SCALE LEVEL | WEIGHS OF SUB-FRAMES WITHIN FRAME | | | | | | | |
|---|---|---|---|---|---|---|---|---|
| | SF7 11 | SF5 8 | SF3 4 | SF1 1 | SF2 2 | SF4 4 | SF6 8 | SF8 11 |
| 0 | | | | | | | | |
| 1 | | | | O | | | | |
| 2 | | | | | O | | | |
| 3 | | | | O | O | | | |
| 4 | | | O | | | | | |
| 5 | | | O | O | | | | |
| 6 | | | O | | O | | | |
| 7 | | | O | O | O | | | |
| 8 | | | O | | | O | | |
| 9 | | | O | O | | O | | |
| 10 | | | O | | O | O | | |
| 11 | | | O | O | O | O | | |
| 12 | | O | | | | O | | |
| 13 | | O | | O | | O | | |
| 14 | | O | | | O | O | | |
| 15 | | O | | O | O | O | | |
| 16 | | O | | | | | O | |
| 17 | | O | | O | | | O | |
| 18 | | O | | | O | | O | |
| 19 | | O | | O | O | | O | |
| 20 | | O | O | | | | O | |
| 21 | | O | O | O | | | O | |
| 22 | | O | O | | O | | O | |
| 23 | | O | O | O | O | | O | |
| 24 | | O | O | | | O | O | |

| GRAY SCALE LEVEL | WEIGHS OF SUB-FRAMES WITHIN FRAME | | | | | | | |
|---|---|---|---|---|---|---|---|---|
| | SF7 11 | SF5 8 | SF3 4 | SF1 1 | SF2 2 | SF4 4 | SF6 8 | SF8 11 |
| 25 | | O | O | O | | O | O | |
| 26 | | O | O | | O | O | O | |
| 27 | O | | O | | | O | O | |
| 28 | O | | O | O | | O | O | |
| 29 | O | | O | | O | O | O | |
| 30 | O | | O | O | O | O | O | |
| 31 | O | O | | | | O | O | |
| 32 | O | O | | O | | O | O | |
| 33 | O | O | | | O | O | O | |
| 34 | O | O | | O | O | O | O | |
| 35 | O | O | O | | | O | O | |
| 36 | O | O | O | O | | O | O | |
| 37 | O | O | O | | O | O | O | |
| 38 | O | O | O | | | O | | O |
| 39 | O | O | O | O | | O | | O |
| 40 | O | O | O | | O | O | | O |
| 41 | O | O | O | O | O | O | | O |
| 42 | O | O | O | | | | O | O |
| 43 | O | O | O | O | | | O | O |
| 44 | O | O | O | | O | | O | O |
| 45 | O | O | O | O | O | | O | O |
| 46 | O | O | O | | | O | O | O |
| 47 | O | O | O | O | | O | O | O |
| 48 | O | O | O | | O | O | O | O |
| 49 | O | O | O | O | O | O | O | O |

Fig.48

2nd MODE

GRAY SCALE LEVEL

| | WEIGHS OF SUB-FRAMES WITHIN FRAME | | | | | | | |
|---|---|---|---|---|---|---|---|---|
| | SF7 11 | SF5 8 | SF3 4 | SF1 1 | SF2 2 | SF4 4 | SF6 8 | SF8 11 |
| 0 | | | | | | | | |
| 1 | | | | ○ | | | | |
| 2 | | | | | ○ | | | |
| 3 | | | | ○ | ○ | | | |
| 4 | | | | | | ○ | | |
| 5 | | | | ○ | | ○ | | |
| 6 | | | | | ○ | ○ | | |
| 7 | | | | ○ | ○ | ○ | | |
| 8 | | | ○ | | | ○ | | |
| 9 | | | ○ | ○ | | ○ | | |
| 10 | | | ○ | | ○ | ○ | | |
| 11 | | | ○ | ○ | ○ | ○ | | |
| 12 | | | ○ | | | | ○ | |
| 13 | | | ○ | ○ | | | ○ | |
| 14 | | | ○ | | ○ | | ○ | |
| 15 | | | ○ | ○ | ○ | | ○ | |
| 16 | | ○ | | | | | ○ | |
| 17 | | ○ | | ○ | | | ○ | |
| 18 | | ○ | | | ○ | | ○ | |
| 19 | | ○ | | ○ | ○ | | ○ | |
| 20 | | ○ | | | | ○ | ○ | |
| 21 | | ○ | | ○ | | ○ | ○ | |
| 22 | | ○ | | | ○ | ○ | ○ | |
| 23 | | ○ | | ○ | ○ | ○ | ○ | |
| 24 | | ○ | ○ | | | ○ | ○ | |

GRAY SCALE LEVEL

NUMBER OF BITS: 8 TOTAL GRAY LEVELS: 50

| | WEIGHS OF SUB-FRAMES WITHIN FRAME | | | | | | | |
|---|---|---|---|---|---|---|---|---|
| | SF7 11 | SF5 8 | SF3 4 | SF1 1 | SF2 2 | SF4 4 | SF6 8 | SF8 11 |
| 25 | | ○ | ○ | ○ | | ○ | ○ | |
| 26 | | ○ | ○ | | ○ | ○ | ○ | |
| 27 | | ○ | ○ | | | ○ | | ○ |
| 28 | | ○ | ○ | ○ | | ○ | | ○ |
| 29 | | ○ | ○ | | ○ | ○ | | ○ |
| 30 | | ○ | ○ | ○ | ○ | ○ | | ○ |
| 31 | | ○ | ○ | | | | ○ | ○ |
| 32 | | ○ | ○ | ○ | | | ○ | ○ |
| 33 | | ○ | ○ | | ○ | | ○ | ○ |
| 34 | | ○ | ○ | ○ | ○ | | ○ | ○ |
| 35 | | ○ | ○ | | | ○ | ○ | ○ |
| 36 | | ○ | ○ | ○ | | ○ | ○ | ○ |
| 37 | | ○ | ○ | | ○ | ○ | ○ | ○ |
| 38 | ○ | | ○ | | | ○ | ○ | ○ |
| 39 | ○ | | ○ | ○ | | ○ | ○ | ○ |
| 40 | ○ | | ○ | | ○ | ○ | ○ | ○ |
| 41 | ○ | | ○ | ○ | ○ | ○ | ○ | ○ |
| 42 | ○ | ○ | | | | ○ | ○ | ○ |
| 43 | ○ | ○ | | ○ | | ○ | ○ | ○ |
| 44 | ○ | ○ | | | ○ | ○ | ○ | ○ |
| 45 | ○ | ○ | | ○ | ○ | ○ | ○ | ○ |
| 46 | ○ | ○ | ○ | | | ○ | ○ | ○ |
| 47 | ○ | ○ | ○ | ○ | | ○ | ○ | ○ |
| 48 | ○ | ○ | ○ | | ○ | ○ | ○ | ○ |
| 49 | ○ | ○ | ○ | ○ | ○ | ○ | ○ | ○ |

Fig.49

1st MODE

NUMBER OF BITS: 9

TOTAL GRAY LEVELS: 44

| GRAY SCALE LEVEL | WEIGHS OF SUB-FRAMES WITHIN FRAME | | | | | | | | |
|---|---|---|---|---|---|---|---|---|---|
| | 91 | 61 | 41 | 21 | 1 | 22 | 42 | 62 | 92 |
| 0 | | | | | | | | | |
| 1 | | | | | O | | | | |
| 2 | | | | O | | | | | |
| 3 | | | | O | O | | | | |
| 4 | | | | O | | O | | | |
| 5 | | | | O | O | O | | | |
| 6 | | | O | | | O | | | |
| 7 | | | O | | O | O | | | |
| 8 | | | O | | | | O | | |
| 9 | | | O | | O | | O | | |
| 10 | | | O | O | | | O | | |
| 11 | | | O | O | O | | O | | |
| 12 | | | O | O | | O | O | | |
| 13 | | | O | O | O | O | O | | |
| 14 | | O | | O | | O | O | | |
| 15 | | O | | O | O | O | O | | |
| 16 | | O | O | | | O | O | | |
| 17 | | O | O | | O | O | O | | |
| 18 | | O | O | O | | O | O | | |
| 19 | | O | O | O | O | O | O | | |
| 20 | | O | O | O | | O | | O | |
| 21 | | O | O | O | O | O | | O | |

| GRAY SCALE LEVEL | WEIGHS OF SUB-FRAMES WITHIN FRAME | | | | | | | | |
|---|---|---|---|---|---|---|---|---|---|
| | 91 | 61 | 41 | 21 | 1 | 22 | 42 | 62 | 92 |
| 22 | | O | O | O | | | O | O | |
| 23 | | O | O | O | O | | O | O | |
| 24 | | O | O | O | | O | O | O | |
| 25 | O | | O | O | | | O | O | |
| 26 | O | | O | O | O | | O | O | |
| 27 | O | | O | O | | O | O | O | |
| 28 | O | | O | O | O | O | O | O | |
| 29 | O | O | | O | | O | O | O | |
| 30 | O | O | | O | O | O | O | O | |
| 31 | O | O | | O | | | O | O | |
| 32 | O | O | O | O | O | | O | O | |
| 33 | O | O | O | O | | O | O | O | |
| 34 | O | O | O | | | O | O | | O |
| 35 | O | O | O | | O | O | O | | O |
| 36 | O | O | O | O | | O | O | | O |
| 37 | O | O | O | O | O | O | O | | O |
| 38 | O | O | O | O | | O | | O | O |
| 39 | O | O | O | O | O | O | | O | O |
| 40 | O | O | O | | | O | O | O | O |
| 41 | O | O | O | | O | O | O | O | O |
| 42 | O | O | O | O | | O | O | O | O |
| 43 | O | O | O | O | O | O | O | O | O |

Fig.50

2nd MODE

NUMBER OF BITS: 9 TOTAL GRAY LEVELS: 44

| GRAY SCALE LEVEL | WEIGHS OF SUB-FRAMES WITHIN FRAME | | | | | | | | |
|---|---|---|---|---|---|---|---|---|---|
| | 91 | 61 | 41 | 21 | 1 | 22 | 42 | 62 | 92 |
| 0 | | | | | | | | | |
| 1 | | | | | O | | | | |
| 2 | | | | | | O | | | |
| 3 | | | | | O | O | | | |
| 4 | | | | O | | O | | | |
| 5 | | | | O | O | O | | | |
| 6 | | | | O | | | O | | |
| 7 | | | | O | O | | O | | |
| 8 | | | O | | | | O | | |
| 9 | | | O | | O | | O | | |
| 10 | | | O | | | O | O | | |
| 11 | | | O | | O | O | O | | |
| 12 | | | O | O | | O | O | | |
| 13 | | | O | O | O | O | O | | |
| 14 | | | O | O | | O | | O | |
| 15 | | | O | O | O | O | | O | |
| 16 | | | O | O | | | O | O | |
| 17 | | | O | O | O | | O | O | |
| 18 | | | O | O | | O | O | O | |
| 19 | | | O | O | O | O | O | O | |
| 20 | | O | | O | | O | O | O | |
| 21 | | O | | O | O | O | O | O | |

| GRAY SCALE LEVEL | WEIGHS OF SUB-FRAMES WITHIN FRAME | | | | | | | | |
|---|---|---|---|---|---|---|---|---|---|
| | 91 | 61 | 41 | 21 | 1 | 22 | 42 | 62 | 92 |
| 22 | | O | O | | | O | O | O | |
| 23 | | O | O | | O | O | O | O | |
| 24 | | O | O | O | | O | O | O | |
| 25 | | O | O | | | O | O | | O |
| 26 | | O | O | | O | O | O | | O |
| 27 | | O | O | O | | O | O | | O |
| 28 | | O | O | O | O | O | O | | O |
| 29 | | O | O | O | | O | | O | O |
| 30 | | O | O | O | O | O | | O | O |
| 31 | | O | O | | | O | O | O | O |
| 32 | | O | O | | O | O | O | O | O |
| 33 | | O | O | O | | O | O | O | O |
| 34 | O | | O | O | | | O | O | O |
| 35 | O | | O | O | O | | O | O | O |
| 36 | O | | O | O | | O | O | O | O |
| 37 | O | | O | O | O | O | O | O | O |
| 38 | O | O | | O | | O | O | O | O |
| 39 | O | O | | O | O | O | O | O | O |
| 40 | O | O | O | O | | | O | O | O |
| 41 | O | O | O | O | O | | O | O | O |
| 42 | O | O | O | O | | O | O | O | O |
| 43 | O | O | O | O | O | O | O | O | O |

INTRAFRAME TIME-DIVISION MULTIPLEXING TYPE DISPLAY DEVICE AND A METHOD OF DISPLAYING GRAY-SCALES IN AN INTRAFRAME TIME-DIVISION MULTIPLEXING TYPE DISPLAY DEVICE

CROSS REFERENCE TO RELATED APPLICATION

This application is a continuation-in-part application of Ser. No. 08/368,002 filed on Jan. 3, 1995 now abandoned.

BACKGROUND OF THE INVENTION

1. Field of the Invention

The present invention relates to a display device using the method of intraframe time-division multiplexing which reduces the gray-scale disturbance occurring when, for example, such a display devices as one using a gas discharge panel is used to display pictures, and to a method therefor.

2. Description of the Related Art

In recent years, as display devices have become larger, there has arisen a demand for thin display devices and a variety of thin display devices has been proposed.

Of these, there are display panels which have two stable operating states and, in order to perform multiple-level gray-scale display with such display panels, the method of intraframe time-division multiplexing is used.

However, when this method is used to display a picture, disturbance of the gray-scales causes a drop in picture quality, and this problem must be solved to achieve an improvement in picture quality.

In the past, intraframe time-division multiplexing was a method used for performing gray-scale display in display panels that had only two stable operating states, on and off.

In the past such devices as gas discharge display panels, liquid-crystal display panels, and fluorescent discharge display panels were used as display devices employing the method of intraframe time-division multiplexing, and an actual example of such a gas discharge display panel would be, for example, a plasma display device.

These intraframe time-division multiplexing type display devices have become small in depth and now have large areas, which has led to a sudden broadening of their applications and growth in production levels.

An actual example of a gas discharge panel which uses the intraframe time-division multiplexing method is described in the form of a plasma display device for the purpose of explaining the prior art in methods of performing gray-scale display.

Such flat plasma display devices generally use the electrical charge accumulated between electrodes to cause the emission of light, and this general display principle and the related construction and operation are described briefly below.

Well-known plasma display devices in the past (AC type PDP) include a two-electrode type in which selection discharge (address discharge) and sustained discharge are performed by two electrodes, and a three-electrode type in which a third electrode is used to perform address discharge.

Specifically, FIG. 5 shows a simplified top plan view an example of the configuration of a three-electrode type plasma display device of the prior art, and FIG. 6 shows a simplified cross-sectional view of one of the discharge cells 10 formed in the plasma display device of FIG. 5.

This plasma display device, as can be seen in FIG. 5 and FIG. 6, is formed from two glass substrates 12 and 13. The 1st glass substrate 13 is provided with 1st electrodes (X electrodes) 14 and 2nd electrodes (Y electrodes) 15 which act as sustaineding electrodes, which are disposed so as to be mutually parallel, these electrodes being covered by an electrolytic layer 18.

In addition, a protective film of MgO (magnesium oxide) is formed, as covering film 21, on the discharge surface represented by the electrolytic layer 18.

On the surface of the 2nd glass substrate 12, which is opposite the above-noted 1st glass substrate 13, is formed a 3rd electrode 16, which acts as an address electrode, and which disposed so as to be perpendicularly to the above-noted sustaineding electrodes 14 and 15.

On top of the address electrodes 16 a phosphor 19 having a color emitting character of red, green, or blue is formed, this being located in the discharge space which is established by the wall 17 which is formed in the same plane in which is located the address electrodes of the above-noted 2nd glass substrate 12.

That is, each of the discharge cells 10 of this plasma display device is separated by a wall (barrier).

In the actual example of a plasma display device noted above, the 1st electrodes (X electrodes) 14 and 2nd electrodes (Y electrode) 15 are disposed so as to be mutually parallel, each forming a pair, with the 2nd electrodes (Y electrodes) 15 being each separately driven by separate Y electrode drive circuits 4-1 to **4-*n* which are connected to a common Y electrode drive circuit 3, and with the 1st electrodes (X electrodes) 14 forming a common electrode and being driven by a single drive circuit 5**.

Perpendicularly crossing the X electrodes 14 and the Y electrodes 15 are the address electrodes 16-1 to **16-*m*, these address electrodes 16-1 to 16-*m* being connected to an appropriate address drive circuit 6**.

In this flat display device, each line of the address electrodes 16 is connected to the address driver 6, the address driver 6 applying the address pulses to each of the address electrodes.

The Y electrodes 15 are each connected separately to the Y scan drivers 4-1 to **4-*n***.

The address scan drivers 4-1 to **4-*n* are further connected to the common Y electrode driver 3, with address discharge pulses being generated by the scan drivers 4-1 to 4-*n*, and with sustained discharge pulses, etc. being generated by the common Y driver 33 shown in FIG. 7, these passing through the Y scan drivers 4-1 to 4-*n* and being applied to the Y electrodes 15**.

The X electrodes 14 are commonly connected and driven across the entire display line of the panel of this flat display device.

That is, the common X electrode driver 5 (32 in FIG. 7) generates write pulses and sustained pulses, these being applied in parallel to each of the X electrodes 14.

These drive circuits are controlled by a control circuit (not shown in the drawings), this control circuit being in turn controlled by synchronization signals and display data signals applied from outside the device.

As described above, in a display panel 1 of a prior art flat display device, the above-noted sustained electrodes 10 are located so as to form a matrix of m in the horizontal direction and n in the vertical direction, with the Y side scan driver circuit 4-1 driving the Y electrodes that are connected to sustained discharge cells 10 that are uppermost in the vertical direction and arranged in a row of m cells, and in the same manner each of the Y side scan drive circuits 4-2 to **4-*n*** separately drive the Y electrodes which are the scan display lines corresponding to each of them.

The X electrode drive circuit 5 drives the X electrodes, which run in parallel to the Y electrodes, but which form a common electrode and are thus driven in common by a single X electrode driver circuit 5.

FIG. 7 is a simplified block diagram which shows the peripheral circuitry which drives the plasma display shown in FIG. 5 and FIG. 6, in which address electrodes 16 are each connected separately to address driver 31, this address driver 31 applying address pulses to each of the address electrodes at the time of address discharge.

The Y electrodes 15 are connected separately to a Y scan driver 34.

This Y scan driver 34 is further connected to a common Y driver 33, with pulses generated by the scan driver 34 at the time of address discharge, and sustained discharge pulses, etc. generated by the common Y driver 33, passing through the Y scan driver 34 to the Y electrodes 15.

The X electrodes 14 are connected in common across the entire display line of the panel of this flat display device.

That is, the common X electrode driver 32 shown in FIG. 7 (5 in FIG. 5) generates such pulses as write pulses and sustained pulses, these pulses being applied in parallel and simultaneously to each of the Y electrodes 15.

The driver circuits are controlled by a control circuit, this control circuit being controlled by synchronization signals and data signals input from outside the device.

Specifically, as can be seen from FIG. 7, the address driver 31 is connected to the display data control section 36 provided in the control circuit 35, this display data control section 36 receiving externally applied inputs, such as display data signals (R7 to R0, G7 to G0, B7 to B0) and a dot clock signal (CLOCK), via a display data pre-processor section 43 and storing them into, for example, a frame memory 71, and the address driver outputs the output data within a single frame from the frame memory 71, for example, which is synchronized to the address timing of the address electrodes to be selected.

The Y scan driver 34 is connected to the scan driver control section 39 of the panel drive control circuit section 38 provided in the control circuit 35, the Y scan driver 34 being driven in response to an externally input vertical synchronization signal $V_{SYNC}$ which is the signal indicating the start of one frame (one field), a number of Y electrodes 15 in the flat display device 1 being selected in sequence to display one frame of the image.

In FIG. 7, the Y-DATA which is output from the scan driver control section 39 is scanning data for the purpose of setting one bit of the Y scan driver on at a time.

Both the common X electrode driver 32 and the common Y electrode driver 33 in this example are connected to the common driver control section 40 provided in the control circuit 35, these acting to reverse the polarity of the voltage applied to the voltage alternately applied to the X electrodes 14 and the Y electrodes 15 while driving them both, thereby achieving the sustained discharge noted above.

Within the above-noted display data control section 36 a frame memory control circuit 42 is additionally provided, this frame memory control circuit 42 being controlled by the PDP timing generation circuit 74 provided in the panel driver control circuit section 38.

FIG. 8 shows the waveforms associated with the previous method of driving the plasma display device PDP shown in FIG. 5 and FIG. 6, this drawing showing the operating waveforms in one sub-frame of the several sub-frames (the six sub-frames SF1 to SF6 in FIG. 8) which make up a frame in what is known as the time-separated address/sustained type of write addressing.

In this example, a single sub-frame SF is composed of at least the three period, such as reset period S1, addressing period S2, and sustaineded discharge period S3, and in this reset period S1, as described above, immediately before displaying the image for a new sub-frame, to erase the display (lighted) states for each sub-frame of the previous frame, all the Y electrodes are set to 0 V level and, simultaneously, the write pulse (WP) consisting of the voltage $V_W$ is applied to the X electrodes.

After that, when the Y electrode voltage becomes Vs and the X electrode voltage becomes 0 V, sustained discharge is performed on all cells, this executing writing processing over the entire surface, an erase pulse (EP) being applied to X electrodes 14 to first erase the information stored at each of the cells 10.

This period is called the reset period S1.

What happens is that, in the reset period S1 of the example being described, all Y electrodes are set to a 0 V level and, simultaneously, a write pulse consisting of a voltage $V_W$ is applied to the X electrodes, thereby causing discharge at all cells of all display lines. Following that, the potential at the Y electrodes becomes the level Vs and simultaneously the potential at the X electrodes become the level 0 V, so that sustained discharge is performed on all cells. In addition, after that, with the potential on the Y electrodes at the 0 V level, the erase pulse (EP), which is a potential of $V_E$ is applied to the X electrodes, this causing an erase discharge between the X and Y electrodes, which reduces the wall electrical charge (neutralizes part of the wall electrical charge).

This reset period S1 has the effect of setting all cells to the same state, regardless of the states of the cells in the previous sub-frame and, as its object, leaves a wall electrical charge advantageous for address discharge, so that discharge will not start even if a sustained pulse is applied.

Next, in this actual example, following this reset period S1, there is provided an addressing period S2, during which, in response to display data, an address discharge is performed in line sequence for the purpose of setting cells on and off.

First, along with a scan pulse SCP, at a 0 V level, being applied to the Y electrodes, addressing pulse ADP, at a voltage Va, is selectively applied to the address electrodes of those cells which are to be sustained discharged, that is, which are to be lighted, so that write discharge is performed on the cells to be lighted. By doing this, a small discharge that cannot be directly perceived occurs between these address electrodes and the selected Y electrodes, and writing (addressing) of the display line is completed when the prescribed amount of electrical charge is accumulated in the corresponding cells 10.

Thereafter, the same type of operations are performed for the other display lines, so that new display data is written to all the display lines.

After that, when the sustained discharge period S3 is entered, a sustained pulse of a voltage Vs is alternately applied to the Y electrodes and X electrodes to perform sustained discharge, so that one sub-frame of the image is displayed.

In this time-separated address/sustained type of write addressing, the length of the sustained discharge period, that is, the number of sustained pulses, establishes the intensity of the displayed image.

The intensity of display pixels of this displayed image is dependent upon the number of sustained discharges in the sustained discharge period S3, which is based on the sub-frame setting conditions selected in each sub-frame, or stated differently, it is dependent upon the length of the sustained discharge period.

Basically, the larger the number of sustained discharges during this sustained discharge period S3 is, the higher will be the intensity, and the smaller the number of sustained discharges during this sustained discharge period S3 is, the lower will be the intensity.

In the example of the sub-frame of FIG. 8, in the case in which the sub-frame SF1 is used to execute the sustained discharge operation, the displayed image is the darkest. In contrast to this, in the case in which the sub-frame SF6 is used to execute the sustained discharge operation, the display is the brightest.

If these sub-frames are combined appropriately, it is possible to produce a gray-scale display with a large number of levels. In the example shown in FIG. 8, as shown in FIG. 10, there is a method of combining these to enable a display of 64 gray-scale levels.

Therefore, the adjustment of the gray-scale display levels of intensity is done by appropriately selecting sub-frame patterns from a number of sub-frame patterns set to given weights in terms of number of sustained discharges for each sub-frame, sustained discharge being executed at each of the sub-frames, the overall combined result being the gray-scale display level of a given single frame.

Although the rest period S1 and addressing period S2 of each of sub-frame SF1 to SF6 in FIG. 8 are the same length in time, the time length of the sustained discharge periods S3 are different for each of the sub-frames. For example, the number of sustained discharges from sub-frame SF1 to sub-frame SF6 is set to run in the series 1:2:4:8:16:32, and it is possible to set the number of sustained discharges in a given single sub-frame as desired, by using an appropriate address to select one or a number of the sub-frames SF1 to SF6.

That is, in the example shown, it is possible to display the intensity as gray-scale display levels 0 through 63, by using selected combinations of the sub-frames.

Furthermore, in the example of FIG. 8, there are six types of sub-frames. The present invention, however, is not limited to six sub-fields, it being possible to make use of any combination of either eight types or four types.

In this manner, the time-separated address/sustained method of write addressing makes use of the memory function of an AC type PDP plasma display device, and is even to this day an advantageous method of efficiently making use of time in achieving a gray-scale display.

FIG. 9 shows the display data control section and the timing generation section 74 of the plasma display (PDP). The display data control section 35 receives the display data of the CRT-interface signals and temporarily stores this into the frame memory section 71.

This is done for the purpose of dividing the gray-scale data of the display data of the CRT-interface signals in the time-axis direction. To divide it in the time-axis direction, and to prevent contention between the input of the input data to and the output from the output data of the display data control section 35 from the frame memory section 71, this frame memory is formed from two frame memories, which alternately perform write and read out of data for each frame.

That is, when frame memory A44 is performing a writing operation, frame memory B45 is performing a readout operation.

In the drawing, 46 and 47 are line switchers, the switching direction of which differs depending upon the operational states of the frame memories.

The display data pre-processing section 43 is a circuit which performs pre-processing of the data to be written into the frame memory 71 so as to achieve efficient readout of address driver data (A-DATA) from frame memory section 71.

The frame memory control circuit section 42 receives control signals from the PDP timing generation circuit section 74, and generates the write/read address signals for the frame memory section 71.

The switching of the frame memory section 71 write/read address signals is performed by selectors 48 and 49.

The switching of selectors 48 and 49 is executed by the FTOG signal (a signal whose logic state inverts every frame).

The write address MWA (multiplex write address) is derived by multiplexing, by multiplexer MUX 51, the write ROW address signal (RWA) generated by the write ROW address generation circuit 53 and the write COLUMN address signal (CWA) generated by the write COLUMN address generation circuit 55.

The write ROW address generation circuit 53 is reset by FLCR (frame clear) signal, and the address is incremented by the DWST (data write start) signal.

The FLCR (frame clear) signal is output at the vertical synchronization signal $V_{SYNC}$, and the DWST (data write start) signal is output each time the BLANK signal is input.

The write COLUMN address generation circuit is reset by the DWST signal and is incremented at each dot clock.

The read address signal MRA (multiplex read address) is derived by the multiplexer MUX 50 multiplexing the read ROW address (RRA) signal generated by the read ROW address generation circuit 52, the lower order read COLUMN address (RCAO) generated by the read COLUMN address generation circuit 54, and the output of the sub-frame counter within the PDP timing generation circuit section 74 (RCA1: upper order read COLUMN address).

The read ROW address generation circuit 52 is reset by the SFCLR (sub-frame clear) signal, and incremented by the ADTT (address data transmission timing) signal which is output for each panel scan line.

The read COLUMN address generation circuit 54 is reset by the ADTT signal and incremented in synchronization with the address data transmission clock (A-CLOCK).

The sub-frame display data to be read is determined by the RCA1 signal.

The PDP timing generation circuit 74 is formed from the interface circuit section 70, the sub-frame forming means 73, and the sub-frame counter 72.

The interface circuit section 70 has the unit control signals ($V_{SYNC}$, $H_{SYNC}$, BLSNK, and CLOCK) input to it, and generates the FCLR, FTOG, and DWST signals.

The sub-frame counter 72 is reset by the FCLR signal and incremented by the SFCLR signal.

When the FCLR signal is input, the drive sequence within the sub-frame, that is, the sequence S1, S2, S3 is executed, and when this sequence is completed, the sub-frame forming means 73 outputs the SFCLR signal.

The generation of the SFCLR signal causes the sub-frame forming means 73 to start the sub-frame internal drive sequence again.

These operations are repeated until the prescribed number of sub-frames within the frame are executed.

The drive sequence S3 within the sub-frame, that is, the sustained discharge pulse selection, is determined by the value of the output RCA1 of the sub-frame counter.

In the above-described plasma display device, as described above, a single frame is composed of a number (N) of sub-frame having mutually different intensities, these sub-frames being appropriately combined to obtain a display with $2^N$ gray-scale display levels. However, in the past, the selection of the number of sub-frames and sequence for driving each of the sub-frame to perform sustained discharge is limited to a predetermined fixed sequence, this sequence being uniform along the time axis.

In such a case, when displaying a moving image, or when performing analog-to-digital conversion for display of an analog signal source such as a video signal, a particular gray-scale level often occurs repeatedly.

When this condition occurs at, for example, a point at which there is a bit carry (for example between 127 and 128, 63 and 64, 31 and 32, or 15 and 16), with prior art, even if the frame frequency is one at which flicker does not normally occur (for example, 60 Hz), a low-frequency (display drive) component (30 Hz) occurs, this appearing as a partial flickering, causing a significant reduction in image quality.

To explain this problem more specifically, consider, as in the case described above, the case in which, as shown in FIG. 8 there are six sub-frames from SF1 to SF6, and wherein the intensity ratios between these sub-frames, that is, the sustained discharge period ratios between the sub-frames is set to be as follows.

SF1:SF2:SF3:SF4:SF5:SF6=1:2:4:8:16:32

In this case, the 31st gray-scale level is the condition in which sustained discharge is done so that all the sub-frames from SF1 to SF5 are lighted simultaneously, and the 32nd gray-scale level is the condition in which sustained discharge is done so that only sub-frame SF6 is lighted.

In this case, if the display data fluctuates between gray-scale level 31 and gray-scale level 32, as shown in FIG. 11, the lighted states in each sub-frame are as indicated by the circles and Xs (circle indicating on and X indicating off), and as a result, this is equivalent of having the 63rd gray-scale level (that is, the condition in which all the sub-frames from SF1 to SF6 are on simultaneously) turn on and off every alternately every frame, so that for two adjacent frames a low-frequency component is formed, this generating a prominent flicker.

This relationship would generate the same condition if, for example, the display data fluctuated between the 15th and 16th gray-scale levels as shown in FIG. 11 a pseudo-flickering condition being generated at the 31st gray-scale level at a low frequency corresponding to the 31st gray-scale level.

Because this phenomenon tends to occur more, the higher the intensity level is, a method has been proposed as in, for example, Japanese Unexamined Patent Publication No. 3-145691, of reducing this phenomenon by locating sub-frames having relatively higher intensity, as much as possible near the center of a single frame. The example given being that of the position-changing method, in which the sub-frame with the highest intensity is located in the center of the frame, with successively lower 2nd highest and 3rd highest intensity sub-frames located to either side of that sub-frame. However, even this method fails to achieve a sufficient effect.

In the gray-scale display of FIG. 8, it is known that, with the intensity being approximately the same, in the case in which there is no overlap of "on" sub-frames, or little overlap in terms of time, that is, in the case in which gray-scale levels in which the sub-frames having overlapping of low intensity weights are laid positioned next to one another, flicker occurs in their boundary areas, this reducing the quality of the display.

The higher the intensity is, the more prevalent this phenomenon becomes. This phenomenon is observed to be prominent in such displays as gray-scale displays.

The principle behind the problem involved is almost the same as described for the previous problem. In the case of this phenomenon, however, because the eyeball vibrates very minutely, the image projected on to the retina of the eye vibrates, there being a characteristic repetition generated at the retina between specific grayscale levels, this appearing as a 30-Hz flicker.

With regard to this, it has been reported (in Japanese Unexamined Patent Publication No. 4-127194) that an improvement is produced by dividing the emitted light of the uppermost order sub-frame into two and positioning it so that the light-emitting period of sub-frames with high intensity is double the frame frequency.

However, sub-frames with low intensity still produce flicker as before.

The above-noted two problems are phenomena that occur with static images.

In the case of moving images, for a reason completely different from the above-noted problems, there is an additional disturbance in the gray-scale levels, as made clear from experiments done by the inventors of the present invention.

This gray-scale level disturbance specifically manifests itself as either bright lines or dark lines appearing in specific gray-scale levels when a gray-scale display is scrolled in the intensity gradient direction.

The intensity of the bright lines and the grayscale level at which they appear depend upon the scroll direction and on the sub-frame arrangement.

As a more specific example, when the flesh-colored part of a persons cheek, for example, moves, a false contour in reddish purple or green is generated at the flesh-colored part (this phenomenon being referred to hereafter as false colored contour), this reducing the quality of the moving image display.

The mechanism by which the gray-scale level disturbance occurs in a moving image is described below, for the case in which there are six sub-frames in one frame, with reference being made to FIG. 13 through FIG. 15.

In this case, however, the arrangement of the sub-frames from the start is SF6, SF5, SF4, . . . , SF1.

When a display of the sub-frame SF6 (uppermost order sub-frame SF) of one vertical blue line is scrolled from the right to the left, if for example there is movement of one pixel in one frame in the display, it will appear as if this has moved to another sub-pixel that is not on, and a smooth motion will be observed.

This smooth motion will be observed even if the moving pixel in the frame is quite large.

In the field of psychology, this phenomenon is known as apparent movement or b movement.

Next, if a display of the sub-frames SF6 and SF5 of one vertical blue line is turned on and scrolled in the same manner as described above, as shown in FIG. 13, it is observed that the color of each sub-frame will be displayed spatially separated. FIG. 13 shows the appearance of the colored cells when displaying the blue SF6 and SF5 sub-frames and scrolling one dot from the right to the left at 1

Vsync, and while this is simply shown as the coloring of the sub-frame SF6 over the blue sub-pixel (B), it will appear, for the same reason as noted above, as if it was moving over sub-pixels of other colors as well.

This is because after the sub-frame SF6 is turned on the sub-frame SF5 emits color after an approximately 2 ms display data write period, the above-noted apparent movement phenomenon causing the appearance to the human eye of the sub-frame SF6 moving in the scrolling direction, with the color emission of sub-frame SF5 appearing to chase the sub-frame SF6.

In the same manner, if all the sub-frames within one frame are turned on and this is scrolled, as shown in FIG. 14, the color emissions of blue sub-frames SF6 to SF1 appear to be displayed spatially separated. FIG. 14 shows the appearance of the color emitting cells when displaying the blue sub-frames SF6 to SF1 and scrolling one dot from right to left at 1 Vsync.

In addition, FIG. 15 shows the appearance of the color emitting cells resulting from displaying the blue sub-frames SF6 to SF1 and scrolling two dots from the right to the left at 1 Vsync, that is, the observed results in the case of moving one frame by 2 pixels.

In this case, what is actually causing emitted colors is the doubling or the spacing of the sub-pixels so that the speed of the apparent movement is faster to the extent that the movement distance increases. Therefore, if sub-frame SF5 emits color approximately 2 ms after the sub-frame SF6 emits its color, the color-emitting part of the sub-frame SF6 is more distant, so that there is the appearance that there is more sub-frame spatial separation, that is, the appearance that the color-emitting spacing is widened.

The spatial widening of the sub-frames when apparent movement takes place was seen, from observations, to be approximately widened within a pixel which moves within one frame period.

Therefore, whereas a gray-scale value should be expressed as the result of turning the same pixel on and integrating the intensity of each sub-frame in the time direction, it was found that with a moving image it is not possible to express a gray-scale level as the sum of the intensities of each sub-frame within the frame, a gray-scale disturbance occurring for moving images.

In a display with no color (white display), this disturbance occurs as bright or dark lines, and in a display having color, it appears as a color other than the original color being generated.

FIGS. 32 and 33 are diagrams for explaining a mechanism of generating a gray-scale level disturbance during display of a dynamic image. Referring to the drawings, the mechanism of generating a gray-scale level disturbance will be described.

In FIGS. 32 and 33, the number of sub-frames within a frame is six. Blue, red, and green pixels are repeatedly displayed in that order during the sub-frames. The sub-frames are arranged in the sequence of sub-frames SF6, SF5, SF4, etc., and SF1 from the leading sub-frame.

When a display containing one blue vertical line produced by cells lit during sub-frame SF6 (highest level sub-frame SF) is scrolled from right to left, for example, when a display is shifted by one pixel per frame, and the blue vertical line appears to move over sub-pixels of other colors corresponding to unlit cells. A smooth motion is observed. The smooth motion is observed even when the number of pixels to be shifted per frame is considerably large. This phenomenon is referred to as a quasi-color pixel effect or beta movement in the field of psychology.

Next, when a display in which one blue vertical line produced by cells lit within sub-frames SF6 and SF5 is scrolled from right to left, as shown in FIG. 32, states of light emission or glow occurring during the sub-frames are seen spatially separately displayed. FIG. 32 shows how states of glow occurring during sub-frames SF6 and SF5 are seen when a display is scrolled by one dot from right to left synchronously with a signal Vsync. Glow occurring during sub-frame SF6 is exhibited as a blue sub-pixel (B). For the aforesaid reason, the sub-pixel is seen as if it were moving over other sub-pixels.

When a cell is lit during sub-frame SF6, if the cell is lit during sub-frame SF5 that lags behind sub-frame SF6 by approximately 2 msec. of a display data writing period, the glow occurring during sub-frame SF6 is seen to move in the scroll direction because of the aforesaid quasi-color pixel effect. Human eyes therefore discern the image as if the glow occurring during sub-frame SF5 were chasing the glow occurring during sub-frame SF6. The glow during sub-frame SF5 is seen as if it were the glow of a cell corresponding to an adjoining red sub-pixel (R). This results in great deterioration of color discernment.

Likewise, when a cell is lit during all sub-frames within one frame, if a display is scrolled, as shown in FIG. 33, the glow occurring during sub-frames SF6 to SF1 is seen spatially separated at the same one pixel. FIG. 33 is a diagram showing how the blue glow occurring during sub-frames SF6 to SF1 is seen when a display is scrolled from right to left by two dots synchronously with a signal Vsync. In this case, since a spacing by which a sub-pixel is seen separated is doubled, the speed of light seen moving because of the quasi-color pixel effect increases. If glow occurs during sub-frame SF5 within approximately 2 msec. after glow occurs during sub-frame SF6, therefore, the glow during sub-frame SF6 is seen having moved farther. The spatial separation occurring during sub-frames, that is, the spread of glow extends over sub-pixels over which a pixel is seen moving during one frame.

Fundamentally, the luminance levels associated with sub-frames during which one cell corresponding to a sub-pixel glows are integrated with respect to time, whereby a gray-scale level is expressed. In the case of a dynamic image, since the glow occurring during the sub-frames within one frame is seen spatially different, a gray-scale level cannot be expressed by the sum of the luminance levels associated with the sub-frames. Consequently, a gray-scale level disturbance occurs in a dynamic image.

In a colorless (white) display, the disturbance appears as a dark line or bright line. In a color display, the disturbance appears as a color different from an original color.

Furthermore, Japanese Unexamined Patent Publication No. 3-145691 has, as already mentioned, disclosed the method in which a sub-frame to which the largest weight is assigned is arranged in the center of one frame in an effort to reduce the occurrence of flicker. FIG. 34 shows a sequence of sub-frames, during which a cell is lit, based on the method disclosed in the Japanese Unexamined Patent Publication No. 3-145692 and employed when a gray-scale level varies between gray-scale levels 127 and 128 depending on a frame. According to the sequence shown in FIG. 34, sub-frames are arranged in the sequence of sub-frames SF1, SF3, SF5, SF7, SF8, SF6, SF4, and SF2 in an effort to suppress flicker. As apparent from the drawing, when sub-frames are arranged in the sequence of sub-frames SF1, SF3, SF5, SF7, SF8, SF6, SF4, and SF2, a glow cycle or an interval between sub-frames during which a cell is lit becomes shorter than that in the case shown in FIG. 9, that is, becomes equal to one frame. Consequently, no flicker appears.

As mentioned above, according to the method of rendering a gray-scale level in an AC type PDP display device shown in FIG. 34, flicker occurring with a high-order bit of value transition or a high-order bit making a transition from the value of a preceding bit to another value (when a gray-scale level is high) can surely be suppressed. However, there is a problem that flicker occurring with a low-order bit of value transition (when a lower gray-scale level is low) becomes more conspicuous. Referring to FIG. 35, a mechanism of bringing about the problem with a low-order bit of value transition will be described.

FIG. 35 shows the lit states during sub-frames within frames associated with lower gray-scale levels in contrast with FIG. 34.

In FIG. 35, the states of a cell lit with a low-order bit of value transition according to, for example, gray-scale level 1 (during sub-frame SF1) and gray-scale level 2 (during sub-frame SF2) alternately frame by frame are shown. As illustrated, a glow interval or the interval between sub-frames SF1 and SF2 within adjoining frames during which the cell is lit is so short that the cell is seen lit at gray-scale level 3 at intervals of a cycle that is double that of a frame. The lit state of the cell at gray-scale level 3 is discerned as flicker by human eyes. Thus, when a gray-scale level is low, flicker occurs with a low-order bit of value transition, for example, with a change of gray-scale levels according to which a cell glows alternately during sub-frames SF1 and SF2 within adjoining frames.

SUMMARY OF THE INVENTION

Therefore, an object of the present invention is to provide an improved method which solves the above-noted problems which occur in the intraframe time-division multiplexing method and is capable of displaying a high-quality image.

The intraframe time-division multiplexing method and intraframe time-division multiplexing type display device of the present invention also provide an intraframe time-division multiplexing type display device and a display method of the intraframe time-division multiplexing type which suppress not only the problems of the examples given above, but also prevents the generation of border darkening with respect to specific gray-scale level changes, and prevents the generation of false colored contour caused by the occurrence of dark parts due to sub-frame separation occurring with a moving image, and which is capable of providing a high-quality image.

To achieve the above-noted objects, the present invention has the technological constitution which is described below.

Specifically, it is an intraframe time-division multiplexing type display device in which, when a single frame of an image is displayed while changing the grayscale level of a number of sub-frames, each of the number of sub-frames is composed of at least an addressing period and a sustained discharge period and further in which each of the number of sub-frames is composed so that their sustained discharge periods mutually differ in length, in which a gray-scale level adjustment means is provided, whereby the sequence of selecting the number of sub-frames for sustained discharge within a single frame can be arbitrarily set.

In addition, another basic constitution of the present invention to achieve the above-noted objects is that of a gray-scale level display method in an intraframe time-division multiplexing type display device, wherein, for example, from a group of sub-frames which have mutually differing sustained discharge periods (intensity weights), a number of sub-frames are selected to compose one frame, and wherein when displaying a grayscale level having the required intensity within this one frame, sub-frames are selected from this number of sub-frames so that of the number of sub-frames making up the one frame at least one group of at least two sub-frames having the same or similar sustained discharge periods exits.

Because the intraframe time-division multiplexing type display device has the above-described technical constitution, even in the case in which a specific grayscale level is repeatedly displayed, because the sustained discharge sequence of the sub-frames is caused to change appropriately, repetition of the sustained discharge of the same pattern is prevented, so that sub-frames having high intensity are mainly located at the temporal center of the sustained discharge period, thereby preventing the formation of the above-described low-frequency component and, as a result, enabling effective avoidance of the generation of image defects such as flicker.

Furthermore, according to another aspect of the present invention, there is provided an image display method in which one frame, during which an image represented by display data is displayed on a display panel, is composed of a plurality of sub-frames associated with different luminance levels, and in which when a gray-scale level is rendered by lighting a cell selectively during the plurality of sub-frames, a bit corresponding to a sub-frame within an adjoining frame is used as a bit corresponding to a sub-frame within one frame during which the cell should be lit according to a gray-scale level represented by display data.

In a first method of correcting display data together with display data corresponding to an adjoining frame, or preferably, in an image display method of the present invention, when a sequence of sub-frames is such that sub-frames associated with smaller weights of luminance are arranged alternately across a sub-frame associated with the largest weight of luminance within one frame, a bit corresponding to a sub-frame within one frame associated with a smallest weight of luminance is converted into a bit corresponding to a sub-frame within an adjoining frame in order to render a gray-scale level.

More preferably, in an image display method of the present invention, sub-frames associated with smaller weights of luminance are arranged across a sub-frame associated with the largest weight of luminance of all the small weights of luminance associated with a plurality of sub-frames within different frames.

Furthermore, in a second correction method, or preferably, in an image display method of the present invention, when a sequence of sub-frames is such that sub-frames associated with larger weights of luminance are arranged alternately at the start and end of one frame, a bit corresponding to a sub-frame associated with a larger weight of luminance is converted into a bit corresponding to a sub-frame within an adjoining frame in order to render a gray-scale level.

More preferably, in an image display method of the present invention, sub-frames associated with smaller weights of luminance are arranged across a sub-frame associated with the largest weight of luminance of all the small weights of luminance associated with a plurality of sub-frames within the same frame.

BRIEF DESCRIPTION OF THE DRAWINGS

FIG. 16 is a drawing which explains the method of gray-scale display in the first example of the present invention (for the 1st mode).

FIG. 17 is a drawing which explains the method of gray-scale display in the first example of the present invention (for the 2nd mode).

FIG. 18 is a drawing which explains the method of gray-scale display in the second example of the present invention (for the 1st mode).

FIG. 19 is a drawing which explains the method of gray-scale display in the second example of the present invention (for the 2nd mode).

FIG. 20 is a drawing which explains the method of gray-scale display in the third example of the present invention (for the 1st mode).

FIG. 21 is a drawing which explains the method of gray-scale display in the third example of the present invention (for the 2nd mode).

FIG. 22 is a drawing which explains the method of gray-scale display in the fourth example of the present invention (for the 1st mode).

FIG. 23 is a drawing which explains the method of gray-scale display in the fourth example of the present invention (for the 2nd mode).

FIGS. 24(A) to 24(D) are drawings which explain the method of the arrangement of the 1st and 2nd modes in the present invention.

FIG. 25 is a drawing which explains another method of the arrangement of the 1st and 2nd modes in the present invention.

FIG. 26 is a drawing which explains yet another method of the arrangement of the 1st and 2nd modes in the present invention.

FIG. 27 is a drawing which shows an example of the method of using each of the gray-scale display levels in the 1st and 2nd mode to display the overall gray-scale level in the present invention.

FIG. 28 is a drawing which shows the method of displaying gray-scale levels in a fifth example of the present invention (1st mode).

FIG. 29 is a drawing which shows the method of displaying gray-scale levels in a fifth example of the present invention (2nd mode).

FIGS. 30 and 31 are drawings which show the method of displaying gray-scale levels in a sixth example of the present invention.

FIG. 36 is a table for indicating the relationship between gray-scale levels and sub-frames during which a cell glows in the seventh embodiment;

FIG. 37 is a table for indicating the relationship between gray-scale levels and sub-frames during which a cell glows in first mode in the eighth embodiment;

FIG. 38 is a table for indicating the relationship between gray-scale levels and sub-frames during which a cell glows in second mode in the eighth embodiment;

FIG. 39 is a table for indicating the relationship between gray-scale levels and sub-frames during which a cell glows in the ninth embodiment;

FIG. 40 is a table for indicating the relationship between gray-scale levels and sub-frames during which a cell glows in the tenth embodiment;

FIG. 41 is a table for indicating the relationship between gray-scale levels and sub-frames during which a cell glows in first mode in the eleventh embodiment;

FIG. 42 is a table for indicating the relationship between gray-scale levels and sub-frames during which a cell glows in second mode in the eleventh embodiment;

FIG. 43 is a table for indicating the relationship between gray-scale levels and sub-frames during which a cell glows in first mode in the twelfth embodiment;

FIG. 44 is a table for indicating the relationship between gray-scale levels and sub-frames during which a cell glows in second mode in the twelfth embodiment;

FIG. 45 is a table for indicating the relationship between gray-scale levels and sub-frames during which a cell glows in first mode in the thirteenth embodiment;

FIG. 46 is a table for indicating the relationship between gray-scale levels and sub-frames during which a cell glows in second mode in the thirteenth embodiment;

FIG. 47 is a table for indicating the relationship between gray-scale levels and sub-frames during which a cell glows in first mode in the fourteenth embodiment;

FIG. 48 is a table for indicating the relationship between gray-scale levels and sub-frames during which a cell glows in second mode in the fourteenth embodiment;

FIG. 49 is a table for indicating the relationship between gray-scale levels and sub-frames during which a cell glows in first mode in the fifteenth embodiment;

FIG. 50 is a table for indicating the relationship between gray-scale levels and sub-frames during which a cell glows in second mode in the fifteenth embodiment;

DETAILED DESCRIPTION OF THE PREFERRED EMBODIMENT

The following is a detailed description of a specific example of the constitution and operation of a intraframe time-division multiplexing type display device according to the present invention as embodied in the form of a plasma display device, which is a typical gas discharge panel type display device, with reference made to the drawings. It should be noted that, as described above, the present invention is not limited to this example.

Figure 1:
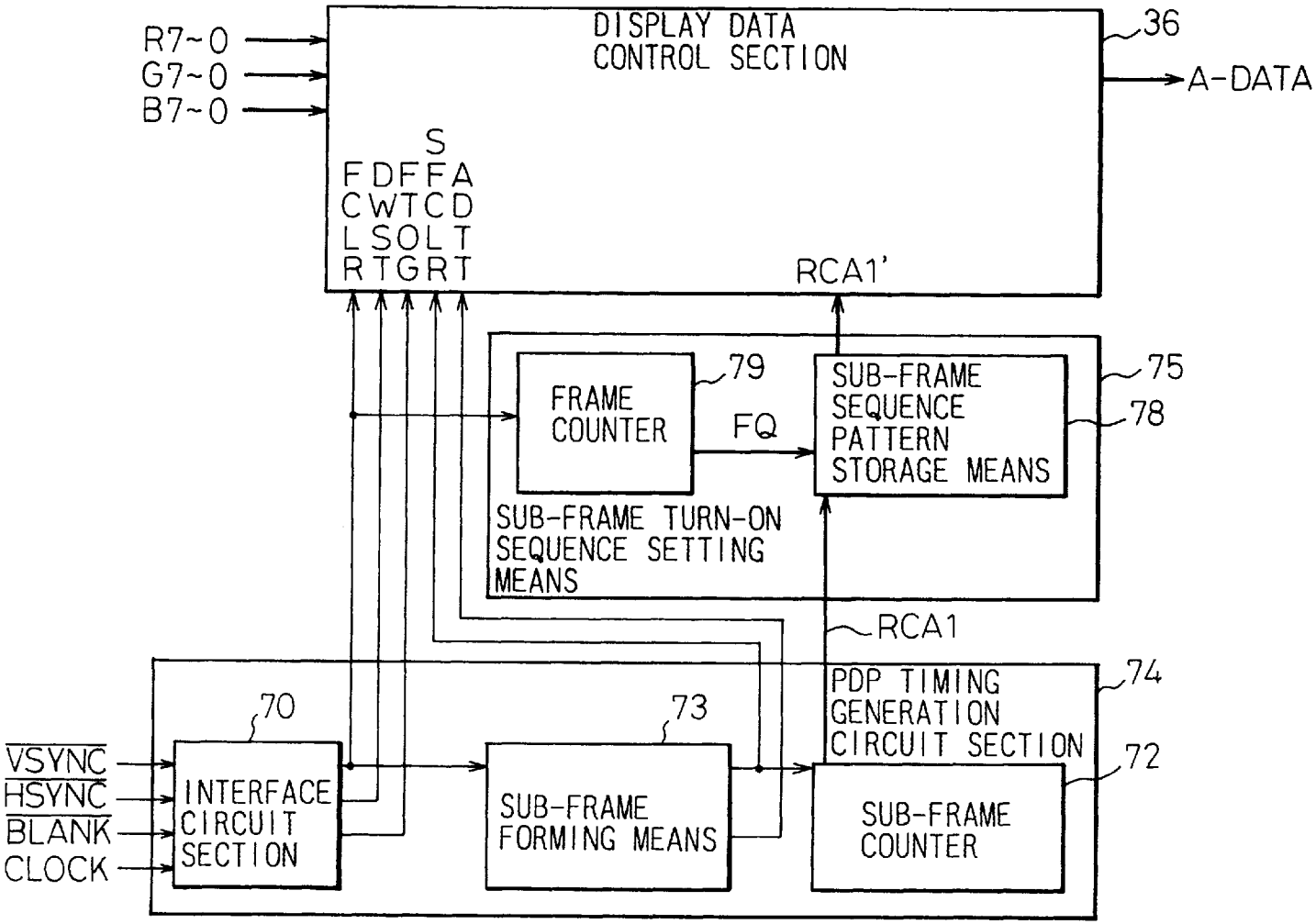
FIG. 1 is a block diagram which shows an example of a plasma display device which is one example of an intraframe time-division multiplexing type display device according to the present invention.

FIG. 1 is a block diagram which shows an example of the specific configuration of a plasma display device, which is one example of an intraframe time-division multiplexing type display device according to the present invention. In the plasma display device shown in this drawing, in displaying one frame of the image displayed on display device 1 while varying the gray-scale level by means of a number of sub-frames, each of these number of sub-frames consists of at least an addressing period S2 and a sustained discharge period S3, and further each of these number of sub-frames has a sustained discharge period S3 which differs from that of the other sub-frames, a gray-scale level adjustment means 75 being provided which is capable of arbitrarily selecting the sequence of each of these number of sub-frames to be sustained discharged during a single frame.

Figure 7:
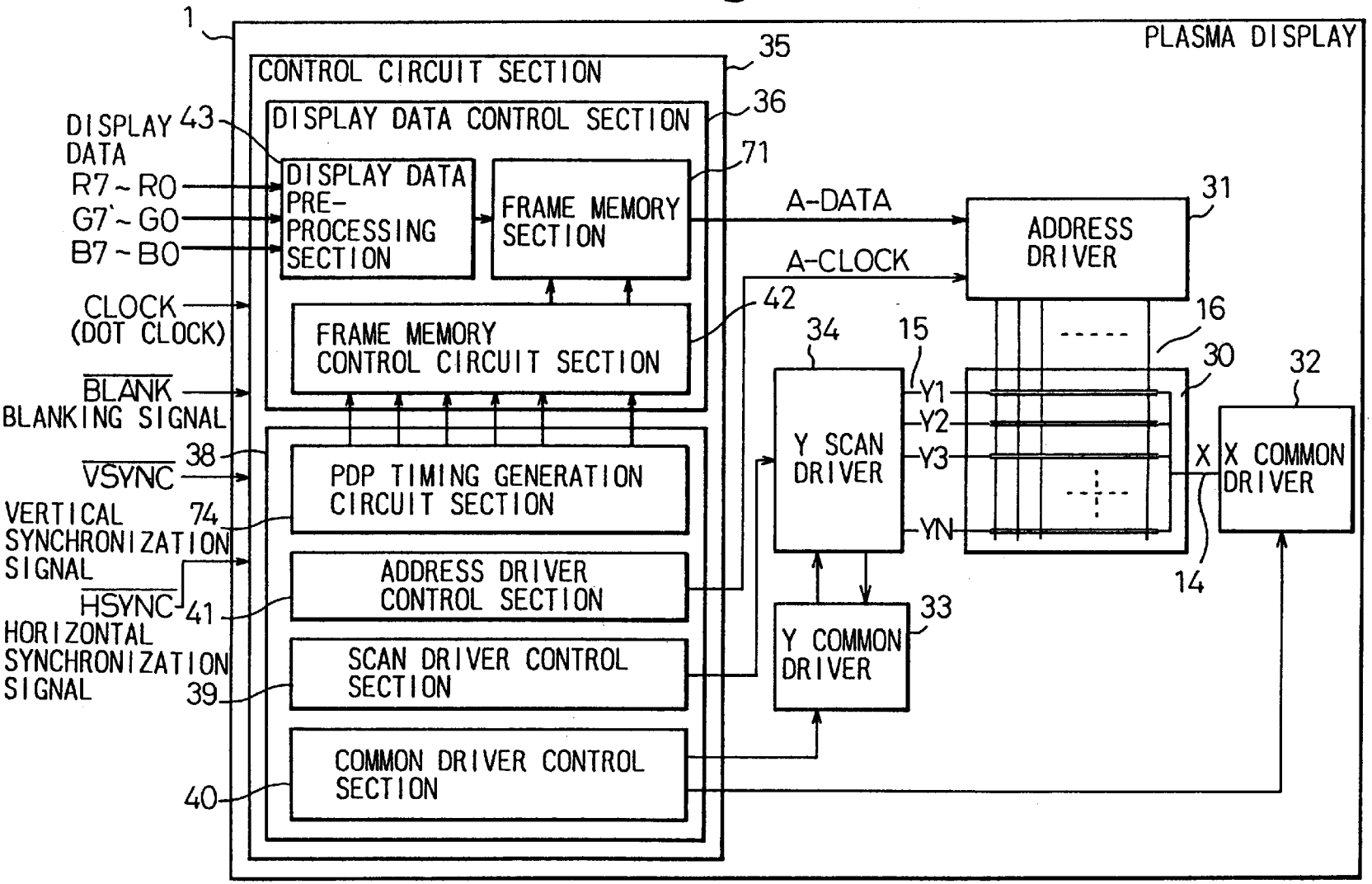
Fig.7 PRIOR ART
FIG. 7 is a block diagram which shows the configuration of a circuit which drives a prior art plasma display device.
Figure 8:
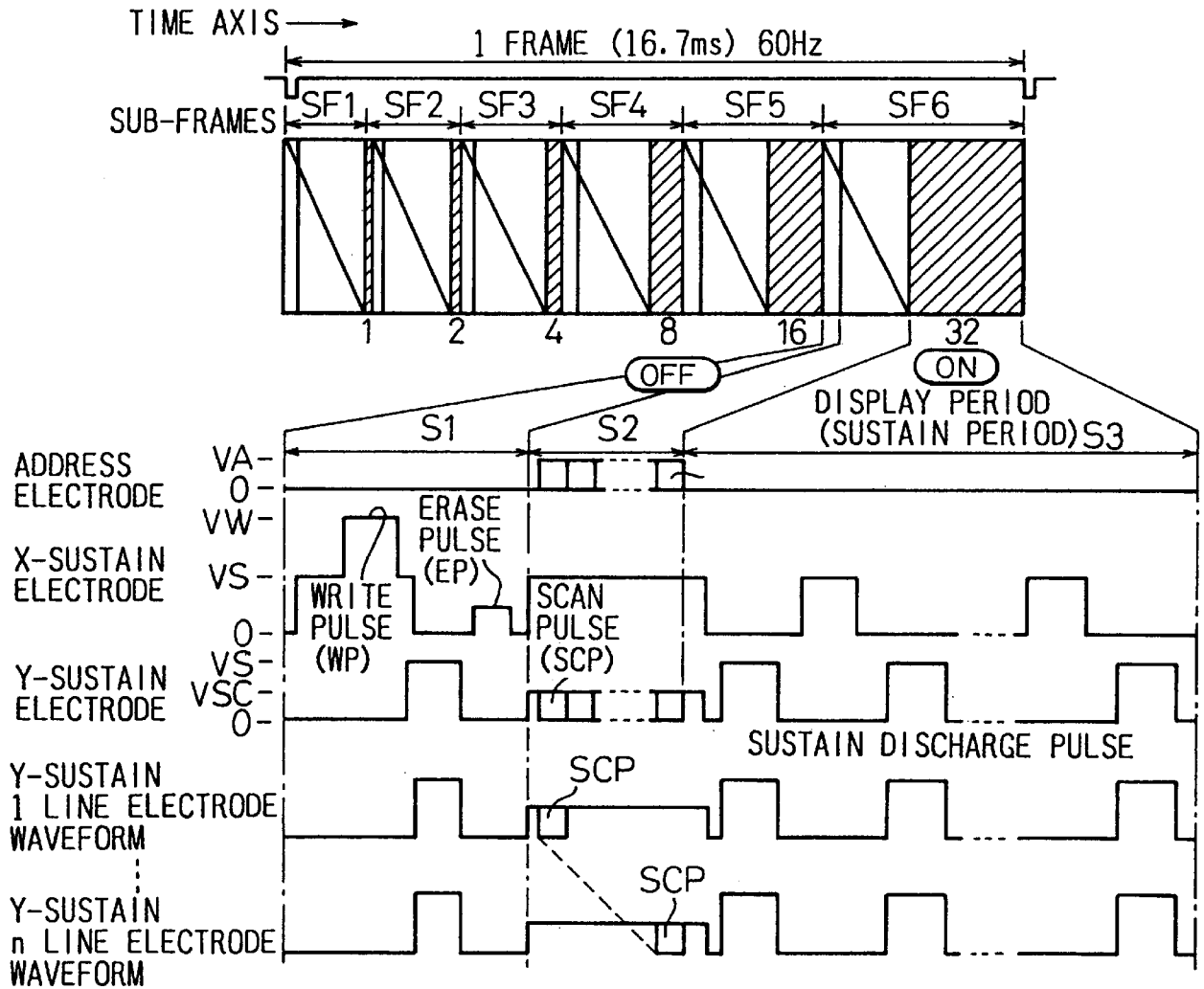
Fig.8 PRIOR ART
FIG. 8 is a waveform drawing which explains the drive cycles of a prior art plasma display.
Figure 9:
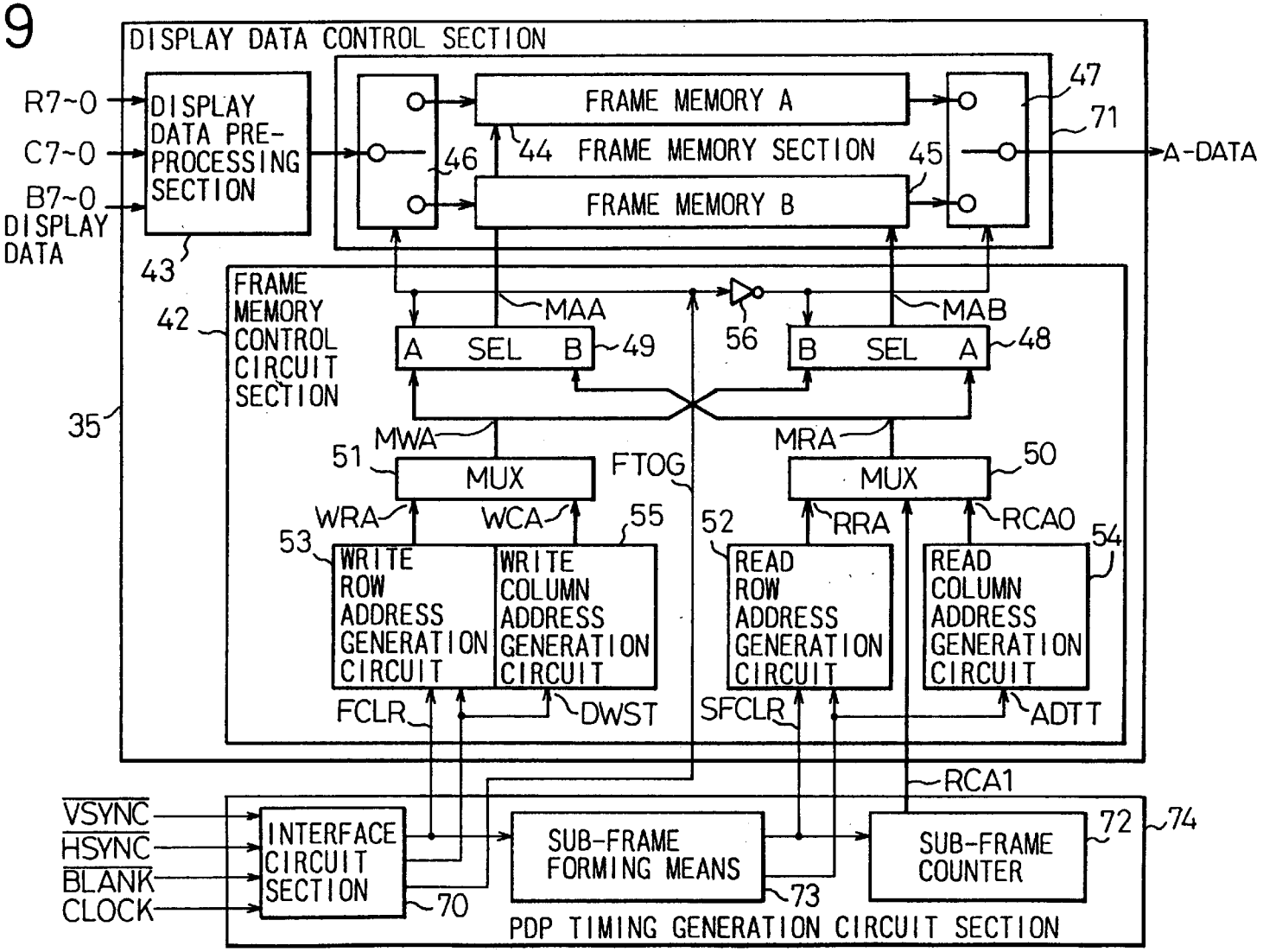
Fig.9 PRIOR ART
FIG. 9 is a block diagram which shows an example of the configuration of a circuit of a display control section of a prior art plasma display device.

In the example of the present invention shown in FIG. 1, the basic configuration of the circuit which operates the sustained discharge periods is the same as the prior art configuration shown in FIG. 7, with corresponding elements assigned the same reference symbols as assigned in FIG. 7 and omitted from the explanation herein.

That is, the technical characteristic of the present invention is that, whereas, as noted above, in a plasma display device of prior art image sub-frames having mutually differing sustained discharge periods were used to perform the sustained discharge operation, in which case the sequence of sustained discharge was pre-established, this fixed sustained discharge sequence being fixed along the time axis for all subsequent display operations, resulting in the occurrence of the problems described above, in the present invention when performing the sustained discharge operation using a number of sub-frames having mutually differing sustained discharge periods, the sustained discharge operation is performed while arbitrarily varying the sequence of this sustained discharge either every frame or every number of frames.

As long as this gray-scale level adjustment means 75 has the above-noted function, there is no particular limitation to its configuration, and it can be used as long as it appropriately establishes which sub-frames having mutually differing sustained discharge periods are to be used, which sub-frames are to be combined, and how these are to be arranged in sequence, and produces an output to the address driver 31.

In the example shown in FIG. 1, the gray-scale level adjustment means 75 is formed from a frame counter 79 and a sub-frame sequence pattern storage means 78, and this has the function of setting the turn-on sequence of sub-frames, for the purpose of appropriately re-arranging the sustained discharge sequence of the number of sub-frames.

That is, this gray-scale level adjustment means 75 which has a sub-frame turn-on sequence setting function, is provided with a sub-frame sustained discharge sequence pattern storage means 78, into which is stored beforehand the specific prescribed sustained discharge sequences patterns based on a pre-established number of types of sustained discharge sequences of the sub-frame group thought to be appropriate, and a frame counter 79.

For example, there could be the case in which the sub-frame SF6, having the highest intensity, is located at the center of one frame, with sub-frames SF1 and SF2, which have relatively low intensities, positioned at the ends of the frame.

The frame counter 79 is controlled by the vertical synchronization signal $V_{SYNC}$ and, in response to this vertical synchronization signal $V_{SYNC}$, outputs a frame selection signal (FQ). This frame selection signal (FQ) is connected to the sub-frame sustained discharge sequence pattern storage means 78, and selects the region that indicates the sequence of sustained discharge of the sub-frames within the frame.

The sub-frame sustained discharge sequence pattern storage means 78 has connected to it a sub-frame counter 72 within a PDP timing generation circuit 74.

Therefore, the sub-frame sustained discharge sequence pattern storage means 78 outputs the intensity data bit number (RCA1') corresponding to the sub-frame within the frame from the region selected by the frame selection signal (FQ).

The intensity data bit number (RCA1') is connected to the display data control section 36.

The thus connected intensity data bit number (RCA1') generates the readout address of the frame memory control section 71. The frame memory control section 71 outputs the intensity data it is instructed to output by this intensity data bit number (RCA1').

In this example, there is provided a control section 74 which forms the PDP timing generation circuit, this PDP timing generation circuit 74 being formed from an interface section 70, a sub-frame forming means 73, and a sub-frame counter 72.

The externally input control signals such as $V_{SYNC}$, $H_{SYNC}$, BLANK, and CLOCK pass through the interface section 70 and are output to the display data control section 36 as well as to the sub-frame forming means 73.

The output signal of this sub-frame forming means 73 is input to the sub-frame counter 72, the sub-frame counter 72, in response to this input signal, performing control of the sub-frame sustained discharge sequence pattern storage means 78.

That is, in this example, the sub-frame turn-on sequence is changed for each frame, in accordance with the pattern of sub-frame turn-on sequences that is stored in the sub-frame sustained discharge sequence pattern storage means.

Figure 2:
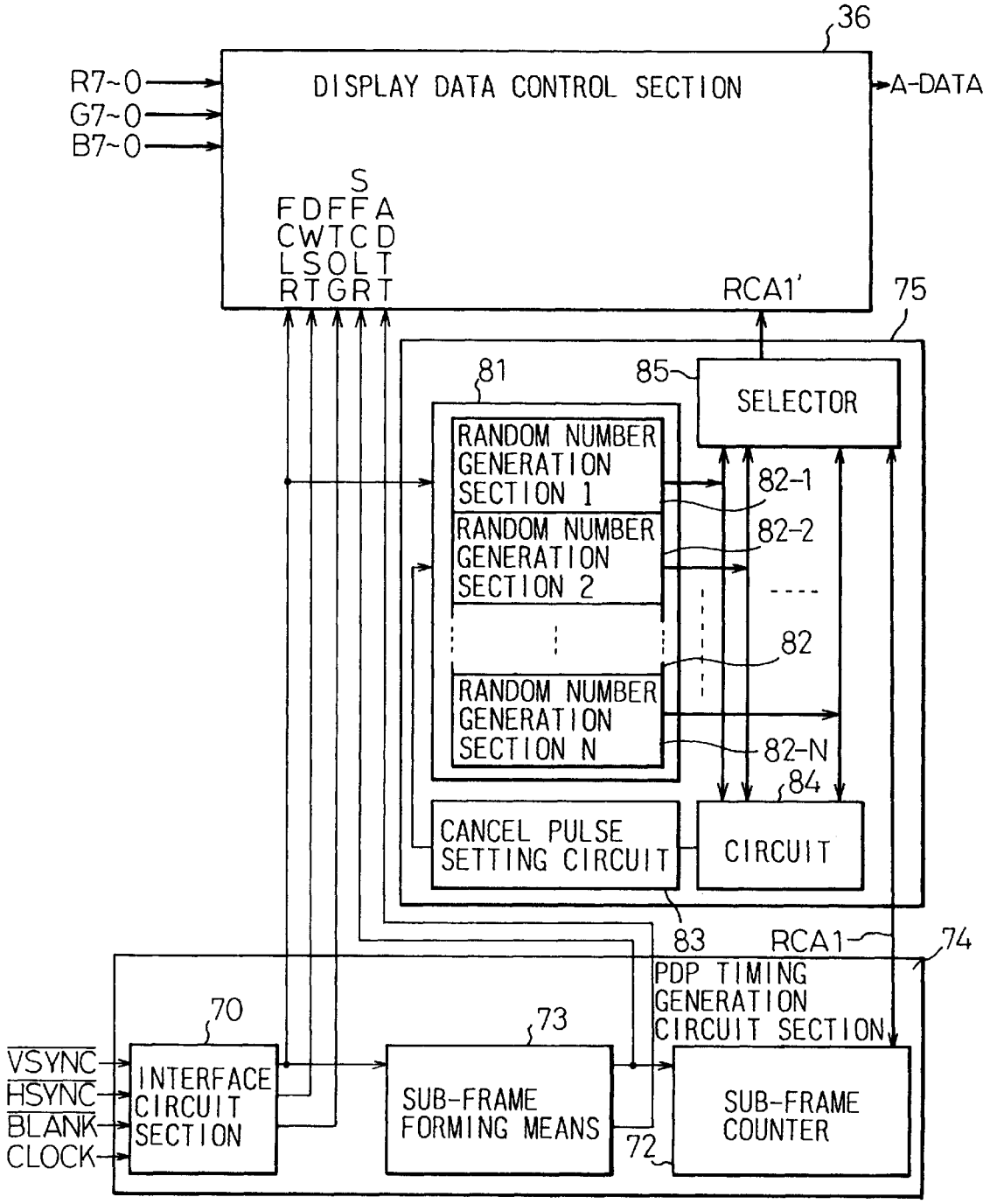
FIG. 2 is a block diagram which shows another example of a plasma display device which is one example of an intraframe time-division multiplexing type display device according to the present invention.

FIG. 2 is block diagram which shows the configuration of another example of the present invention. In this example as well, the basic configuration of the circuit that performs the sustained discharge operation is the same as that of the prior art which is shown in FIG. 7, corresponding elements having been assigned the same reference symbols as in FIG. 7, and the detailed descriptions thereof having been omitted herein.

The technical characteristic of this example is that, in place of the above-noted sub-frame sustained discharge sequence pattern storage means 78 which has a sub-frame turn-on sequence setting function, a sustained discharge sequence pattern randomization means 81 is provided.

In the example shown in FIG. 2, the gray-scale adjustment means 75 has a sustained discharge sequence randomization means 81 which randomly re-arranges the sustained discharge sequence of the number of sub-frames.

This sustained discharge sequence randomization means 81 has a random number generation circuit 82, this random number generation circuit 82 being provided with an appropriate number of random number generation circuit sections 82-1, 82-2, . . . 82-N (where N is a number corresponding to the number of sub-frames being used). This random number is used to select the sub-frames for sustained discharge, to combine several sub-frames to set the sustained discharge sequence.

In this example, the random numbers generated from the random number generation circuit sections 82-1, 82-2, . . . , 82-N are output to a selector circuit section 85 and, in response to the selection count value (RCA1) for the purpose of sub-frame selection which is output from the sub-frame counter 72 provided in the PDP timing generation circuit 74, the sub-frames corresponding to the random numbers generated from the random number generation circuit sections 82-1, 82-2, . . . , 82-N are selected and the associated sustained discharge sequence information is output.

As a result, the prescribed intensity data bit number (RCA1') is output from the selector circuit section 85.

In addition, in this example, the gray-scale adjustment means 75 has, in addition to the sustained discharge sequence randomization means 81 which has the function of randomly re-arranging the sustained discharge sequence of the number of sub-frames, a sustained discharge sequence cancel pattern setting means 83, which cancels the sustained discharge sequence of the number of sub-frames generated by the sustained discharge sequence randomization means 81.

That is, in this example, the sustained discharge sequence is established in accordance with random numbers generated randomly from the random number generation circuit 82, and as a result, if for example the specification of the designated sub-frames to be selected is unrealistic, such as the repetition of a sub-frame six times consecutively, since this would result in a poor display, it is desirable that this special sustained discharge sequence should be invalidated, a new random number should be generated, and a different sustained discharge sequence should be set.

To do this, the sustained discharge sequence cancel pattern setting means 83 is provided, the forbidden sustained discharge sequences are stored beforehand, and a comparison is made by a comparison circuit 84 between the stored data in the sustained discharge sequence cancel pattern setting means 83 and the sustained discharge sequence pattern output from the random number generation circuit 82, and in the case in which the output sustained discharge sequence pattern which was output is the same as a cancel pattern, a trigger is applied to the random number generation circuit 82 from this sustained discharge sequence cancel pattern setting means 83, this causing a new random number to be generated.

Furthermore, the configuration and control system of the PDP timing generation circuit 74 used in this example is the same as that of FIG. 1.

Because an intraframe time-division multiplexing type display device having, as one example, the above-described plasma display device has the above-described configuration, even in the case in which a specific grayscale level is repeatedly displayed, because the sub-frame sustained discharge sequence is appropriately varied, thereby preventing the repeated sustained discharge of the same pattern and because high-intensity sub-frames are largely located in the temporal center of the sustained discharge period of the frame, it is possible to prevent the above-described formation of a low-frequency component, and as a result there is effective avoidance of such image defects as flicker.

In the present invention, since there is no periodicity in the turn-on sequence in the sub-frame sustained discharge period, it is possible to prevent the generation of partial flicker such as occurred with the prior art method.

Specifically, in one example of a gray-scale display method in an intraframe time-division multiplexing type display device according to the present invention, in selecting and turning on one or more sub-frames selected for sustained discharge in accordance with the gray-scale level to be displayed from the group of sequences, when a number of selectable patterns exist, it is possible to select from the selectable patterns and perform turn-on processing, and it is also possible to select one or more sub-frames to be sustained discharged in accordance with the gray-scale level to be displayed, with priority given to the sustained discharge of sub-frames of the sub-frame group making up one frame which located in the approximate center of the frame.

In addition, of this group, in selecting and performing turn-on processing of one or more sub-frames to be sustained discharged in accordance with the grayscale level to be displayed, in the case in which there are $N_{ALL}$ selectable patterns, it is possible to select from these N patterns (where $N \leqq N_{ALL}$), to set each of the selected patterns to a mode from the 1st mode to the N-th mode, these modes being appropriately selected for execution of sustained discharge processing.

What follows is a description of another example of a method of selection of each of the sub-frames in a plasma display device which is one example of an intraframe time-division multiplexing type of display device according to the present invention.

In this example, one frame is made up of sub-frames selected from a pre-established number of sub-frames from the group of a number of sub-frames having mutually differing sustained discharge periods as described above, that is, the group of sub-frames SFn, SFn-1, . . . , SF1 having mutually differing intensity weights, an example of this selection being, as shown in FIG. 16 and FIG. 17, a frame composed of sub-frames with an intensity level of 1 (SF1), an intensity level of 2 (SF2), an intensity level of 4 (SF4), an intensity level of 8 (SF8), and an intensity level of 16 (SF16), an additional important point of this example being that, of the number of sub-frames making up one frame, it is necessary to select at least two sub-frames having either the same or approximately the same sustained discharge period.

That is, as an example of this selection, as shown in FIG. 16 and FIG. 17, selection is made, for example of one sub-frame with an intensity level of 1 (SF1), one sub-frame with an intensity level of 2 (SF2), one sub-frame with an intensity level of 4 (SF4), three sub-frames with an intensity level of 8 (SF8), and two sub-frames with an intensity level of 16 (SF16), and in this case there are a first group with three SF8 sub-frames having the same intensity level of 8, and a second group with two SF16 sub-frames having the same intensity level of 16.

In this example, the intensity levels that make up this group do not necessarily need to be the same, and it is also possible to group sub-frames having slightly different intensity levels into one group. For example, in the case of forming one group with a number of sub-frames having the intensity level of 16, it is possible to include sub-frames having intensity levels such as 15 or 17 in this same group.

There must be at least one group but there can be two or more groups.

However, it is desirable that the sub-frames that make up the above-noted sub-frame groups be selected so as to have as high an intensity (intensity weight) as possible.

In this example, it is desirable that the number of sub-frames having differing intensity levels selected as described above be appropriately distributed within one frame in accordance with their intensity levels, and for this example, it is desirable to avoid positioning a number of sub-frames having the same or similar intensity levels next to one another.

In particular, as described above, it is desirable that the sustained discharge periods, that is, the individual sub-frames which make up a group of one type of sub-frames having the same or similar intensity levels are appropriated dispersed throughout one frame.

In addition, in this example, of a number of sub-frames selected as described above, in the case in which there are two sub-frames of the same type, having the same or similar intensity levels making up a group within the frame, it is desirable that, as shown in FIG. 16 for example, the two sub-frames SF16 having the highest intensity level of 16 (in this example) be positioned at the beginning or end, or near these positions in the frame, so that they are positioned symmetrically left-to-right, and in the case in which there are three sub-frames of the same type, having the same or similar intensity levels making up a group with the frame, it is desirable that, as shown in FIG. 16 for example, the three sub-frames SF8 which have the second highest intensity level of 8 be positioned at the beginning and end and at the center of the frame, or near these positions, so as to be distributed with left-to-right symmetry.

Therefore, in the examples shown in FIG. 16 and FIG. 17, one frame is displayable with 64 gray-scale levels using 8 bits, with the sub-frames arranged in the direction from the left side of the frame, from which the sustained discharge scan begins to the right side of the frame, at which the sustained discharge scans is complete, being sub-frame SF8, sub-frame SF16, sub-frame SF2, sub-frame SF8, sub-frame SF4, sub-frame SF1, sub-frame SF16, sub-frame SF 8.

In FIG. 16 and FIG. 17, while the same frame arrangement pattern is shown, the modes, to be described later, are different, with FIG. 16 showing the 1st mode and FIG. 17 showing the 2nd mode.

As another example of the selection and arrangement of sub-frames in this example, it is possible, as shown in FIG. 18 and FIG. 19, to have the arrangement sequence of sub-frame SF8, sub-frame SF16, sub-frame SF2, sub-frame SF16, sub-frame SF4, sub-frame SF1, sub-frame SF16, sub-frame SF4, sub-frame SF1, sub-frame SF16, sub-frame SF8. Additionally, it is possible, as shown in FIG. 20 and FIG. 21, to have the arrangement sequence of sub-frame SF4, sub-frame SF8, sub-frame SF2, sub-frame SF16, sub-frame SF1, sub-frame SF8, sub-frame SF4. Additionally, it is possible, as shown in FIG. 22 and FIG. 23, to have the arrangement sequence sub-frame SF4, sub-frame SF8, sub-frame SF2, sub-frame SF1, sub-frame SF8, sub-frame SF4.

Next, after establishing the sub-frames to be arranged in one frame, in this example, there is the problem of what method is to be used to turn on each one of the sub-frames for the purpose of performing sustained discharge.

In this example according to the present invention, since there is a plurality of sub-frames within a given single frame that have the same gray-scale level, it is possible to vary the sub-frames that are caused to go through sustained discharge for each dot individually. In additional, in this example, in the case in which there are two or more sub-frames which have gray-scale level next to the heaviest one, it is possible to express that gray-scale level with a single sub-frame expressing the same gray-scale level, and it is also possible to express that gray-scale level with different sub-frames used to express the same gray-scale level.

Specifically, in the above-noted example, in the case of expressing the gray-scale level of 16, it is possible to simply turn on one sub-frame SF16 that has the heaviest gray-scale level, and is also possible to turn on two sub-frames SF8 which have the gray-scale level next to the heaviest one.

That is, in FIG. 16 and FIG. 17, in the case of expressing a gray-scale with an intensity level of 16, it is possible to turn on any two of the three sub-frames SP8, and also possible to turn on any one of two sub-frames SF16.

Essentially, in the above example of the present invention, of the plurality of sub-frame groups which are in a given sequence and make up one frame, this is a plasma display method whereby either one, sub-frame or more than one sub-frames, to be turned on is selected, in accordance with the gray-scale level to be displayed.

In the present invention, as described above, in the examples of FIG. 16 and FIG. 17, in the case of expressing a gray-scale level of 8 or higher it is desirable that a setting is made so that two or more sub-frames are turned on continuously, so that there is no non-uniformity in the sustained discharge within a given single frame.

It is also desirable that as many sub-frames and dispersed light emission as possible which make up a single frame be turned on.

In addition, in the case in which a single frame is made up of an odd number of sub-frames, it is also possible to execute sustained discharge processing of the sub-frame positioned at the center of the frame with first priority, followed by turning on of sub-frames near the center of the frame.

As an example of a plasma display method according to the present invention, in the case in which a number of sub-frames having the same gray-scale level exist within the same frame, it is possible to perform turn-on starting with the sub-frame SF1 which has the lightest intensity level within the frame, in the priority sequence of sub-frames at the exact center of the frame, sub-frames at the starting position of the direction in which sustained discharge is executed, and then sub-frames at the ending position of the direction in which sustained discharge is executed, achieving gray-scale level display using as many as possible sub-frames from SF1 to SFn, and, in the present invention, it is not necessary to position the sub-frame having the lowest intensity level at the center of a frame, it also being desirable to position the sub-frame having the highest or second highest intensity level at the center of a frame.

In the above-noted example, if we call the setting mode in which turn-on is done in the priority sequence of sub-frames at the exact center of the frame, sub-frames at the starting position of the direction in which sustained discharge is executed, and then sub-frames at the ending position of the direction in which sustained discharge is executed the 1st mode, and call the setting mode in which turn-on is done in the priority sequence of frames at the exact center of the frame, sub-frames at the ending position of the direction in which sustained discharge is executed, and then sub-frames at the starting position of the direction in which sustained discharge is executed the 2nd mode, in the 1st mode the intensity level is highest in the first half of a single frame and in the 2nd mode the intensity level is highest in the second half of a single frame.

That is, in the above-noted example of the present invention, it is possible to perform control by providing a mode setting means which is capable of appropriately setting the 1st mode and the 2nd mode, and also by providing a mode selection means for the purpose of executing either the 1st mode or the 2nd mode.

In the case of the above-noted example of the present invention, in positioning the one or more than one sub-frames that are selected for turn-on and which are to be caused to go through sustained discharge, it is possible to set the 1st mode by positioning the sub-frame or sub-frames with highest priority at the edge or in the vicinity of the edge at which sustained discharge begins, and it is possible to set the 2nd mode by positioning the sub-frame or sub-frames with highest priority at the edge or in the vicinity of the edge at which sustained discharge ends.

Basically, in the above-noted example of the present invention, of the group of sub-frames which are selected for turn-on and arranged in a prescribed sequence to make up one frame, it is desirable to give priority to sustained discharge of the sub-frames in the approximate center of the frame, and additionally it is desirable that the group of a number of sub-frames which are selected for turn-on and arranged in a prescribed sequence to make up one frame be sustained discharged starting from one end of the frame and proceeding in sequence toward the other end.

Of the drawings, FIG. 16 and FIG. 17, which show the same sub-frame arrangement pattern, FIG. 16 shows the condition in which the sub-frame groups selected and arranged within a given frame are selected for turn-on for each gray-scale level in the 1st mode, and FIG. 17 shows the condition in which the sub-frame groups selected and arranged within a given frame are selected for turn-on for each gray-scale display level in the 2nd mode.

Furthermore, in each of the above-noted drawings, the circles represent sub-frames which are selected for turn-on in each of the various gray-scale display levels.

In the same manner, FIG. 18, FIG. 20, and FIG. 22 indicate the 1st mode, while FIG. 19, FIG. 21, and FIG. 23 indicate the 2nd mode.

As can be seen from these drawings, in each of the selected sub-frame group arrangements, the sub-frames located at the starting position, center position, and ending position within a given single frame are often selected for turn-on.

Next, as another example of the present invention, in the case in which there is at least one group made up of at least three sub-frames of one type having the same or similar sustained discharge periods, it is possible to establish as the 1st mode the condition in which these sub-frames are selected for turn-on sustained discharge in the sequence of <1> sub-frames located in the approximate center of the frame, <2> sub-frames located at the end of the frame from which sequential sustained discharge is done starting at one end of the frame and proceeding to the other, and then <3> sub-frames located at the end of the frame at which the sequential sustained discharge ends, and further possible to establish as the 1st mode the condition in which these sub-frames are selected for turn-on sustained discharge in the sequence of <1> sub-frames located in the approximate center of the frame, <2> sub-frames located at the end of the frame at which sequential sustained discharge ends when it is done starting from one end of the frame and proceeding to the other, and then <3> sub-frames located at end of the frame from which the sequential sustained discharge starts.

However, in the plasma display method of the above-noted example of the present invention, in the 1st mode it is basically desirable that the sub-frame groups that make up a frame be positioned with relatively high priority at the end of the frame from which the sustained discharge scan starts and in the center of the frame, and in the 2nd mode, it is basically desirable that they be positions with priority at the end of the frame at which the sustained discharge ends and at the center of the frame.

In addition, in an example of the present invention, in executing sustained discharge processing, it is possible to have a 1st mode (A) and a 2nd mode (B) which are as shown in FIG. 24(A), selected alternately for each sustained discharge cell or group of sustained discharge cells made up of a number of sustained discharge cells along a scan line, or, as shown in FIG. 24 (B) are alternated between scan lines.

As shown in FIG. 24(C) and FIG. 24(D), it is possible to execute sustained discharge processing, making selection of the 1st mode (A) and the 2nd mode (B) so that they alternate in both the direction along the scan lines and in the direction perpendicular to that direction so that they form a staggered pattern, and further it is possible, although not shown in the drawings, to select the 1st mode (A) and the 2nd mode (B) in a completely random manner in both the direction along the scan lines and in the direction perpendicular to that direction.

In the above-noted example of the present invention, as noted above, in the case in which there exist two or more sub-frames having the same intensity level, sub-frames having the lowest intensity levels, which are SF8 sub-frames in the examples of FIG. 16 and FIG. 17, are turned on in a priority sequence of the very center, then the starting position, and then ending position of the corresponding frame, after which sub-frames having a high intensity level, which are SF16 sub-frames in the examples of FIG. 16 and FIG. 17, are turned on in the priority sequence of the very center, then the starting position, and then ending position of the corresponding frame, so that sub-frames existing at the center, the starting end, and the ending end of a given frame are constantly at a given gray-scale display level of, for example, SF8 or above, thus shortening the long blank periods that are a cause of flicker.

In the present invention, as described above, because the setting is made so as to turn on as many sub-frames as possible, it has the effect of causing blur of the image, which makes it difficult to see the separation of sub-frames in the case of a moving image.

In addition, in the present invention, by appropriately causing overlap of the 1st mode and 2nd mode as shown in FIG. 24, because it is possible to make light and dark dots, which had been generated in the past when a gray-scale display level change occurred, for every other of the pixel dots which are made up of sustained discharge cells, there is an apparent cancellation, this having the effect of not being able to select the dark and light parts, thereby making it also possible to suppress the generation of a false color contour.

In the present invention, as shown in FIG. 24, by mixing different modes, because it is possible to change the sequence of color emission of the sustained discharge cells which make up each of dots for each dot individually, for the display of a given gray-scale display level, because there exist lighted sub-frames and non-lighted sub-frames, there is a temporal dispersion of the load, the result being that there is an apparent drop of the line-impedance.

In addition, in the display method of FIG. 24(C) and (D), the 1st and 2nd modes are arranged in a staggered manner, and in this condition, there is the effect that there is a reduction of the line-impedance and a reduction in the gray-scale display level load ratio dependency of the sustainer output impedance.

In the present invention, as shown in FIG. 24, in contrast to the intraframe time-division multiplexing method in which the mode is changed for each sustained discharge cell, it is also possible to incorporate the surface gray-scale method.

That is, as shown in FIG. 25, in this method, taking two dots as a group, the desired gray-scale display level is displayed by specifying the gray-scale display level for the group of two dots, which is formed from two sustained discharge cells, and in this method, it is possible to display double the number of gray-scale display levels.

Specifically, in the condition in which sustained discharge cells specified in the 1st mode and sustained discharge cells specified in the 2nd mode are arrange alternately in both the scan line direction and in the direction perpendicular to the scan line direction, so as to form a staggered arrangement pattern, with respect to the overall desired gray-scale display level, the grayscale display level of the 1st sustained discharge cells and the gray-scale display level of the 2nd sustained discharge cells are summed to obtain the overall desired gray-scale display level and, in doing this, sustained discharge processing control is performed in a manner such that at least some of the gray-scale display levels of each mode differ.

Specifically, with reference to the example shown in FIG. 22 and FIG. 23, if the specified gray-scale display level is 1, in the case in which a gray-scale display level of 1 is selected in the 1st mode, the gray-scale display level will not be selected in the 2nd mode, if the specified gray-scale display level is 2, the grayscale display level of 1 is selected in the 1st mode and also in the 2nd mode, and if the specified gray-scale display level is 3, the gray-scale display level of 2 is selected in the 1st mode, the gray-scale display level of 1 is selected in the 2nd mode, thus the gray-scale is selected according to each mode.

Essentially, in the above-described example of the present invention, in each of the modes, the point of change of the gray-scale display level is shifted for each dot.

In this method, more specifically, as shown in FIG. 27, with respect to the desired overall gray-scale display level, in displaying the overall gray-scale display level by adding the gray-scale display level of the 1st sustained discharge cell and the gray-scale display level of the 2nd sustained discharge cell, in part of the gray-scale display levels, the gray-scale display levels of each of the modes are selected so that the total of the gray-scale display levels of each of the modes does not actually coincide with the specified overall gray-scale display level, although the selection is made so that, viewed overall, it does approximately coincide.

That is, as can be seen in FIG. 27, if the overall gray-scale display level is 45, or 47 to 49, the grayscale display level of the 1st and 2nd modes do not add up to the actual overall gray-scale display level.

It is also possible, in a different method as shown in FIG. 26, to take four sustained discharge cells as a pixel group, and to use the matrix arrangement of these four neighboring sustained discharge cells to display the gray-scale level, and in this method it is possible to display four times the number of gray-scale levels.

Specifically, in this example, with respect to the specified overall gray-scale display level, in displaying the overall desired gray-scale level by adding the grayscale display level of two sustained discharge cells in the 1st mode to the gray-scale display level of two sustained discharge cells in the 2nd mode, sustained discharge processing is performed so that at the grayscale display level of at least two 1st sustained discharge cells and two 2nd sustained discharge cells are separately selected.

As another example of the present invention, in the case in which a continuously input desired overall grayscale display level is shifted by one gray-scale display level at a time, it is possible, in selecting the sub-frame pattern to display the gray-scale level corresponding to the desired gray-scale display level each time the gray-scale display level is changed, to perform sustained discharge processing control in a manner such that the 1st mode and 2nd mode are switched alternately.

In addition, in the above-noted method, in the case in which a continuously input desired overall gray-scale display level is changed, it is possible, in response to the change in the gray-scale display level, to perform sustained discharge processing control in a manner such that, when selecting the sub-frame pattern to display the gray-scale level corresponding to the desired gray-scale display level, there is random switching between the 1st and 2nd modes.

That is, as shown in FIGS. 28 and 29, in contrast to the example shown in FIG. 16 and FIG. 17, it can be seen that in the gray-scale display levels between 16 and 24 there is alternation of the form of the arrangement of sub-frames between the 1st mode and the 2nd mode.

Rather than alternating the switching between adjacent gray-scale display levels, it is also possible to make this alternating switching random.

A more detailed example of the above-noted plasma display method will be presented below, with reference made to the drawings.

As shown in FIG. 16 and FIG. 17, the first example is that in which the gray-scale intensity of one frame is in the sub-frame sequence sub-frame SF8 (1), sub-frame SF16 (1), sub-frame SF2, sub-frame SF8 (3), sub-frame SF4, sub-frame SF1, sub-frame SF16 (2), sub-frame SF8 (2), this sub-frame arrangement enabling the display of 64 gray-scale levels.

In FIG. 16 and FIG. 17, for the gray-scale levels 0 to 7, these levels can be expressed by combinations of sub-frames SFs having intensity levels of 1, 2, and 4, and because the method is the same for gray-scale display levels up to 63, the explanation will only be presented for changes in gray-scale to levels that are multiples of 8.

First, in the case of the 1st mode, in the case in which the gray-scale display level changes from 7 to 8, the sub-frame SF8 (3) in the very center is turned on.

In the case in which the gray-scale display level changes from 15 to 16, the sub-frame SF8 (1) which is close to the beginning and the sub-frame SF8 (3) which is at the very center are turned on.

In addition, in the case in which the gray-scale display level changes from 23 to 24, in order to turn on as many sub-frames as possible, the sub-frame SF8 (1) near the beginning, the sub-frame SF8 (3) at the very center, and the sub-frame SF8 (3) near the end are turned on.

In the case in which the gray-scale display level changes from 31 to 32, the sub-frame SF16 (1) near the beginning, the sub-frame SF8 (3) at the very center, and the sub-frame SF8 (2) near the end are turned on, and in the case in which the gray-scale display level changes from 39 to 40 in order not to turn ON as concentrated with one frame as possible, the sub-frame SF16 (1) near the beginning, the sub-frame SF16 (2) near the end, and the sub-frame SF8 (3) at the very center are turned on.

In the case in which the gray-scale display level changes from 47 to 48, the sub-frame SF8 (1) and sub-frame SF16 (1) which are at the beginning and near the beginning, the sub-frame SF8 (3) at the very center, and the sub-frame SF16 (2) near the end are turned on, and in the case in which the gray-scale display level changes from 55 to 56, the sub-frame SF8 (1) and sub-frame SF16 (1) which are near the beginning, the sub-frame SF8 (3) at the very center, and the sub-frame SF16 (2) and the sub-frame SF8 (2) near the end are turned on.

In the 2nd mode, in the cases in which the grayscale display level changes from 7 to 8, from 23 to 24, from 39 to 40, and from 55 to 56, the same operations occur as is described above for the case of the 1st mode, so these will not be specifically stated. In the case in which the gray-scale display level changes from 15 to 16, the sub-frame SF8 (3) at the very center and the sub-frame SF8 (2) near the end are turned on, and the in case in which the gray-scale display level changes from 31 to 32, the sub-frame SF16 (2) near the end, the sub-frame SF8 (3) near the center, and the sub-frame SF8 (1) near the beginning are turned on.

In the case in which the gray-scale display level changes from 47 to 48, the sub-frame SF8 (2) and sub-frame SF16 (2) which are at and near the end, the sub-frame SF8 (3) at the very center, and the sub-frame SF16 (1) near the beginning are turned on.

By using this type of selection and arrangement of sub-frames within a given frame, for both the 1st mode and the 2nd mode, the sustained discharge light emission from the sub-frames within a single frame is dispersed, and when the gray-scale display level at the beginning and end or in neighboring positions thereto is 24 or greater, since the on condition is continuous, the long blank periods are shortened, making it possible to suppress the generation of flicker and other phenomena.

In addition, in the case of a moving image, this has the effect of generating blur.

In the cases in which the gray-scale level changes from 15 to 16, from 31 to 32, or from 47 to 48, if the setting is made as shown in FIG. 24(C) and (D), the bright line which occurred, in the prior art, in a moving image display when the mode changed from the 1st mode to the 2nd mode and the dark line which occurred when the mode changed from the 2nd mode to the 1st mode are generated as light/dark lines in a single line. However, in this actual example, since the light/dark line generation can be reduced considerably, it is possible to suppress the generation of false color contours.

Next, an example of a plasma display device, embodying the example of the present invention described above, will be explained with reference made to the drawings.

Figure 3:
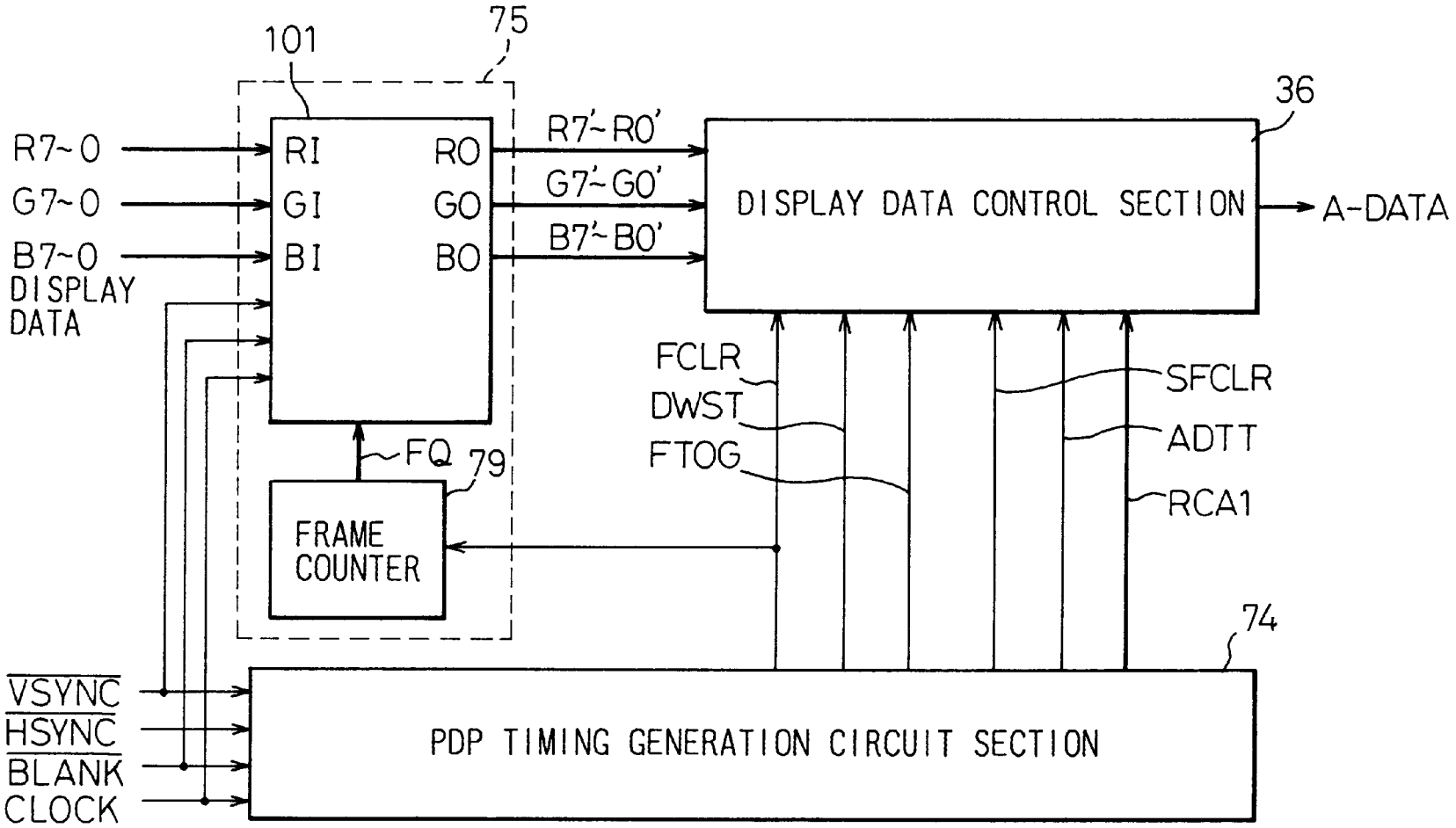
FIG. 3 is a block diagram which shows yet another example of a plasma display device which is one example of an intraframe time-division multiplexing type display device according to the present invention.

FIG. 3 is basically the same as the plasma display device 1 shown in FIG. 1 and FIG. 2, and while a detailed description will not be given of the various parts of the circuit, the characteristic part of the plasma display device 1 of this example is the configuration of the gray-scale adjustment means 75, which differs from the configuration in FIG. 1 and FIG. 2.

Specifically, the gray-scale adjustment means 75 used in the plasma display device 1 of this example has as its object the effective execution of the processing described above, and is basically for the purpose of displaying the desired gray-scale levels in a given single frame of a moving image to be displayed on the display panel section 30 and, in addition to arbitrary selection of a number of sub-frames that are to be sustained discharged, it also has a function capable of making an arbitrary setting of the sequence in which these selected sub-frames are to be sustained discharged, this gray-scale adjustment means 75 including an intensity data arrangement switching means 101 and a frame counter 79, which select, from a number of sub-frame groups (SF1 to SFn) having mutually differing sustained discharge periods (intensity weights), a number of sub-frames having predetermined numbers to make up one frame, and which, in displaying the gray-scale levels required within this frame, select sub-frames from the number of existing sub-frame groups, so that there is at least one sub-frame group of a number of sub-frames making up the single frame in which there are at least two selected sub-frames which have the same, or similar, sustained discharge periods.

It is desirable that this intensity data arrangement switching means 101 has, as described above, a function which disperses and arranges the sub-frames making up the sub-frame groups so that sub-frames having relatively long sustained discharge periods are positioned at the left and right ends of the frame, or near thereto.

Also, in the case in which a group is composed of three similar sub-frames, it is desirable that the intensity data arrangement switching means 101 has a function which performs dispersion and arrangement so that one of the sub-frames is positioned at the approximate center of that frame, and that the remaining two sub-frames are positioned at the left and right ends of the frame, or near thereto.

Figure 4:
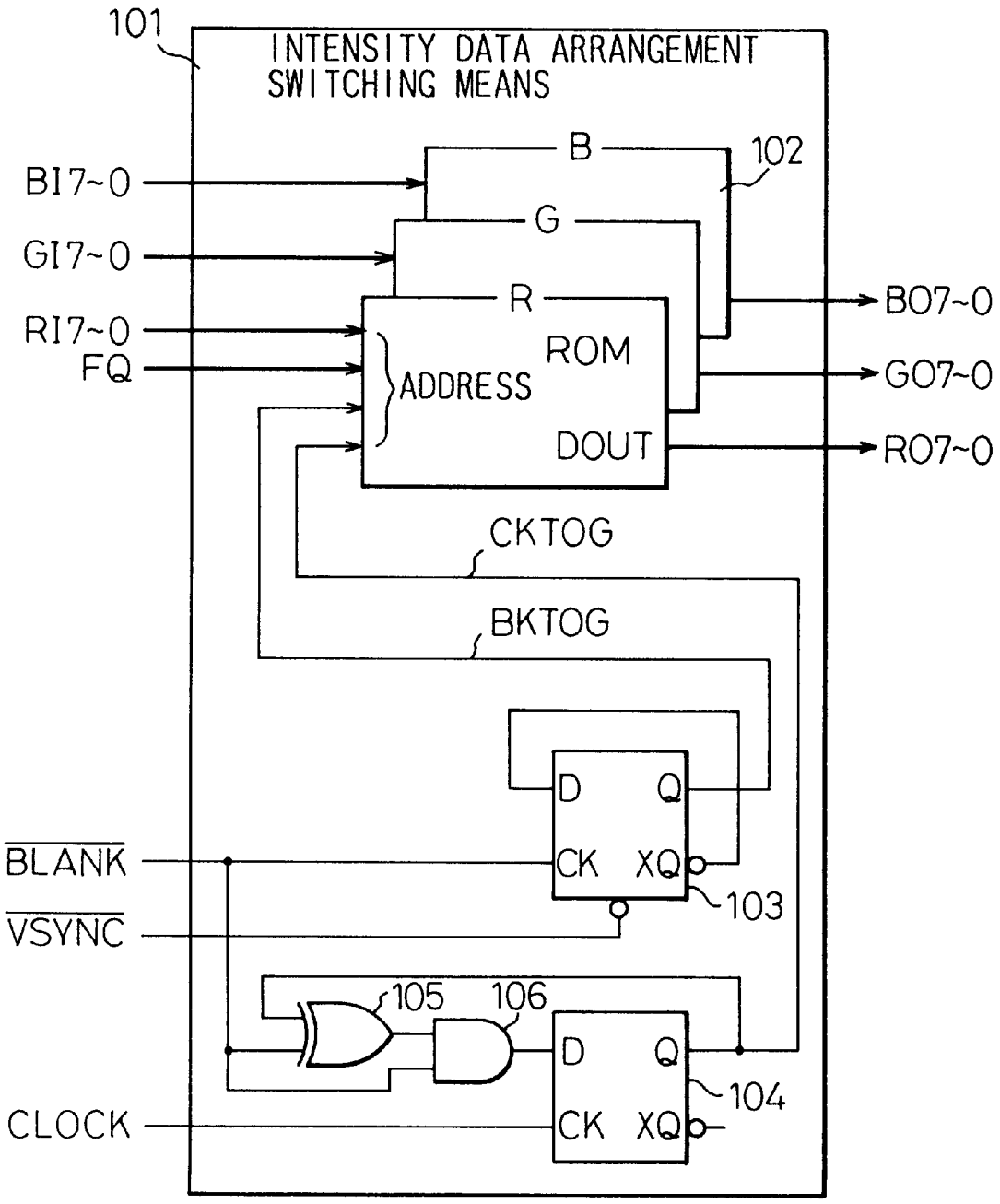
FIG. 4 is a block diagram which shows one example of the configuration of an intensity data arrangement switching means in FIG. 3.
Figure 5:
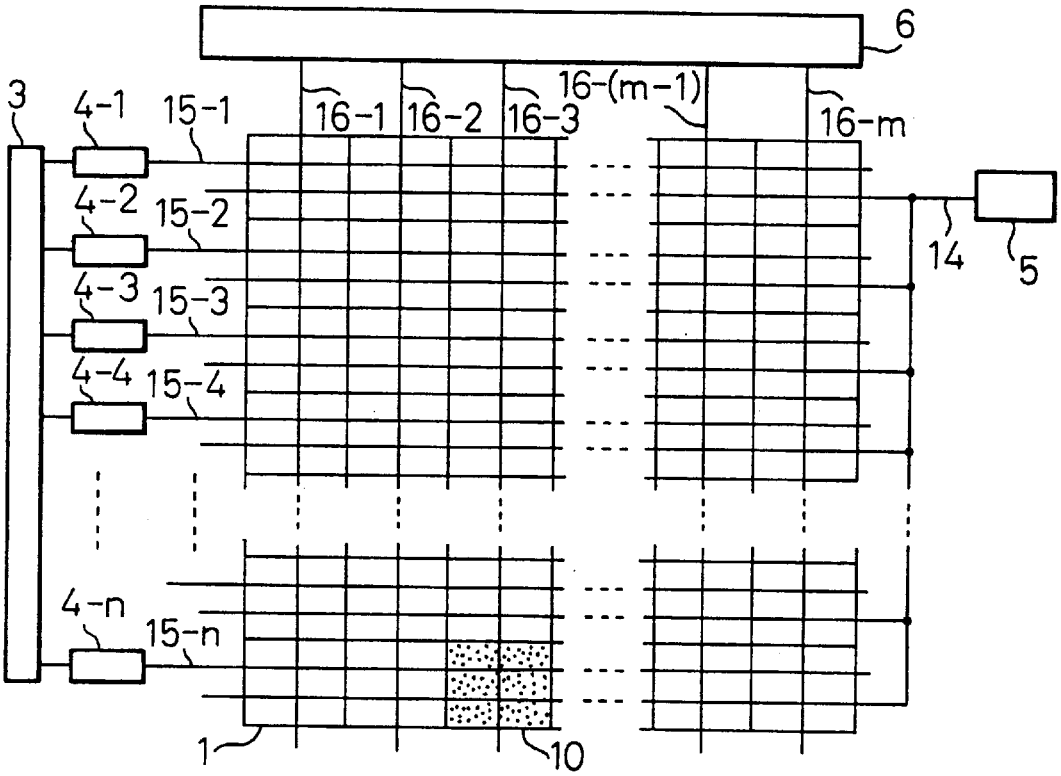
Fig.5 PRIOR ART
FIG. 5 is a block diagram which shows one example of a plasma display device which is one example of a prior art intraframe time-division multiplexing type display device.
Figure 6:
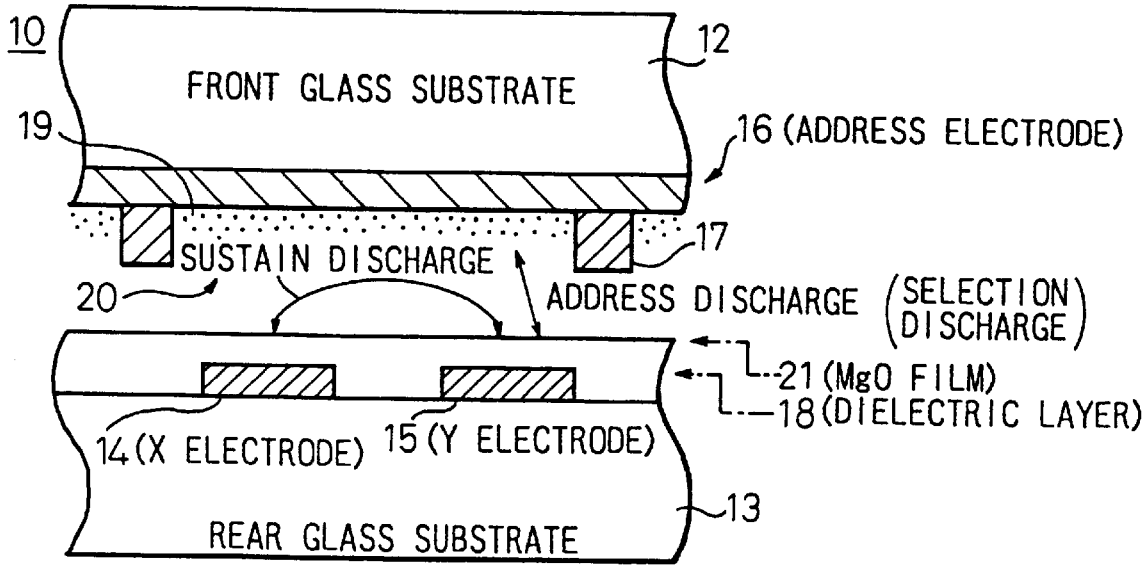
Fig.6 PRIOR ART
FIG. 6 is a block diagram which shows an example of the configuration of the cell part of a plasma display device which is one example of an intraframe time-division multiplexing type display device according to the present invention.

The intensity data arrangement switching means 101, which is provided with a gray-scale adjustment means 75 as shown in FIG. 4, is formed from ROMs 102 which are provided for each of the RGB colors, flip-flops 103 and 104, exclusive-OR element 105, and AND element 106, the flip-flop 103 being reset each time the vertical synchronization signal $V_{SYNC}$ is input, its output being logically inverted each time the blanking signal is input. That is, the logical level of the output of the flip-flop being inverted for every new input scan line.

In the circuit with the flip-flop 104, the exclusive-OR element 105, and the AND element 106 connected as shown in the drawing, the output of flip-flop 104 is logically inverted when the blanking signal (BLANK) is high each time the dot clock (CLOCK) is input.

When the blanking signal (BLANK) is at a low level, the flip-flop 104 output is at a low level.

Display data applied to the intensity data arrangement switching means 101, the FQ input, and the CKTOG and the BKTOG signals are input to the address terminals of the ROM 102.

Since the data numbered 7 to 0 (for example RO7) of the output of the ROM 102 indicates which sub-frame of a given single frame is to be turned on to achieve overlapping of sub-frames, conversion patterns for display data inputs such as would result in the turn-on sequence shown in FIG. 16 are previously written into ROM 102 and read out if necessary. In FIG. 4, the number of sub-frames in a single frame is eight. However, when the number of sub-frames is increased as shown in FIGS. 16, 17 and so forth, the number of data outputs of ROM 102 is also increased.

In the case of changing the sub-frame turn-on pattern by each frame, line, or dot, it is merely necessary to add the appropriate number of conversion patterns.

Specifically, in this example, it is desirable to have a function in which, by means of the intensity data arrangement switching means 101, appropriate selection is made of one or more sub-frames to be sustained discharged from the number of sub-frames which are arranged in a sequence to form one frame, in response to the desired gray-scale display level.

The intensity data arrangement switching means 101 can be implemented by generating a table, as shown in FIGS. 16 through 23 or in FIGS. 28 and 29, in which it is specified which sub-frames are to be turn-on or left off for each gray-scale display level and storing this in an appropriate storage means.

In addition, the intensity data arrangement switching means 101 of the gray-scale adjustment means 75 has a function of scanning from one end to the other, and performing sustained discharge processing of, a number of sub-frames selected for turn-on and arranged in the desired sequence to form one frame, and in a different example it has a function which gives priority to sub-frames, among the group of sub-frames which are selected for turn-on and which are arranged to form one frame, which are located at the approximate center of that frame.

As a more specific example, it is possible for the intensity data arrangement switching means 101 to cause the sub-frame located at the very center of the frame to be turned on first, after which it causes the sub-frame at the beginning position of the frame to be turned on, followed by the sub-frame and the ending position of the frame. Additionally, it is also possible that the sub-frame at the very center of the frame is turned on first, followed by the sub-frame at the end position of the frame and then the sub-frame at the beginning position of the frame.

In the gray-scale adjustment means 75 in this example, it is desirable that there be a function that, as noted above, sets one or more sub-frames to be sustained discharged in the 1st mode, which performs positioning with priority given to the position at or near the end of frame at which sustained discharge processing is begun, or sets one or more sub-frames to be sustained discharged in the 2nd mode, which performs positioning with priority given to the position at or near the end of the frame at which sustained discharging ends.

As a more specific example, it is desirable to set a 1st mode, in the case in which there is at least one group made up by selecting at least three of one type of sub-frame, to have a 1st mode which, in executing sequential sustained discharge processing of the least three sub-frames that make up that group, executes this in the sequence of <1> sub-frames located in the approximate center of the frame, <2> sub-frames located at the beginning end of the frame in direction in which the gray-scale adjustment means 75 performs sequential sustained discharge processing, and <3> sub-frames located at the end of the frame in that direction, and also to set a 2nd mode which in executing sequential sustained discharge processing of the least three sub-frames that make up that group, executes this in the sequence of <1> sub-frames located in the approximate center of the frame, <2> sub-frames located at the ending end of the frame in direction in which the gray-scale adjustment means 75 performs sequential sustained discharge processing, and <3> sub-frames located at the starting end of the frame in that direction.

In the present invention, this mode selection function can alternately select these 1st and 2nd modes for each of the sustained discharge cells or groups of sustained discharge cells arranged along the scan lines, or can select these 1st and 2nd modes alternately every other scan line.

In addition, this mode selection function can select these 1st and 2nd modes alternately in both the direction along the scan line and the direction perpendicular to the scan lines, thereby creating a staggered arrangement, and can also select these 1st and 2nd modes randomly in both the direction along the scan lines and in the direction perpendicular to the scan lines to create a random arrangement.

In the above example of the present invention, the 1st sustained discharge cells specified for the 1st mode and the 2nd sustained discharge cells specified for the 2nd mode by this mode selection function are in a staggered arrangement in which the modes alternate along both the scan line direction and the direction perpendicular to the scan line direction, in which condition the turn-on sub-frame selection means 103, in adding the 1st sustained discharge cell gray-scale display level to the 2nd sustained discharge gray-scale display level to display the desired overall gray-scale display level, can also have a function which makes a selection so that at least part of the gray-scale display levels in each of the modes mutually differ.

Additionally, as another example of the plasma display device 1 of the above-described example of the present invention, in the condition in which the 1st sustained discharge cells set to the 1st mode and the 2nd sustained discharge cells set to the 2nd mode by the mode selection means are arranged so as to be staggered in alternating fashion in both the scan line direction and the direction perpendicular to the scan line direction, it is possible for the turn-on sub-frame selection means to have a function which, when adding the gray-scale display level of the 1st sustained discharge cells to the gray-scale display level of the 2nd sustained discharge cells to display the overall desired gray-scale display level, selects the gray-scale display levels of each of the modes in such a manner that the sum of those selected gray-scale display levels is not equal to the actual overall specified gray-scale display level, and in the condition in which at least two 1st sustained discharge cells set to the 1st mode and at least two 2nd sustained discharge cells set to the 2nd mode by the mode selection means are arranged so as to be staggered in alternating fashion in both the scan line direction and the direction perpendicular to the scan line direction, it is possible for the turn-on sub-frame selection means to have a function which, when adding four types of gray-scale display level of the two 1st sustained discharge cells to the gray-scale display level of the two 2nd sustained discharge cells to display the overall desired gray-scale display level, separately selects the gray-scale display levels of at least two 1st sustained discharge cells and at least two 2nd sustained discharge cells.

In addition, in the plasma display device 1, in the case in which the desired overall gray-scale display level which is continuously input to the gray-scale adjustment means 75 changes continuous by one gray-scale display level each time, in selecting the sub-frame patterns which display the gray-scale level corresponding to the specified gray-scale display level, it is possible to have a function which alternately switches between the 1st mode and the 2nd mode, or to have a function which, in the case in which the desired overall gray-scale display level, which is continuously input to the grayscale adjustment means 75, changes, in selecting the sub-frame patterns to display the gray-scale level corresponding to the desired gray-scale display level in response to the change in the gray-scale display level, randomly sets the 1st mode and the 2nd mode.

The 2nd example of the above-noted example is shown in FIG. 18 and FIG. 19.

Specifically, FIG. 18 shows the example of the sub-frame arrangement where the gray-scale intensity display sequence of the sub-frames is sub-frame SF8 (1), sub-frame SF16 (1), sub-frame SF2, sub-frame SF16 (3), sub-frame SF4, sub-frame SF1, sub-frame SF16 (2) and sub-frame SF8 (2).

In comparison with FIG. 16 and FIG. 17, the sub-frame at the center is changed from sub-frame SF8 (3) to sub-frame SF16 (3), this increasing the gray-scale level at the center from 64 to 72, thereby increasing the grayscale display levels that can be expressed.

The turning-on method is similar to that in the previously described first example, except that when the gray-scale display level changes from 15 to 16, in displaying the gray-scale display level of 16, rather than turning on sub-frame SF8 (1) and sub-frame SF8 (2), the centrally positioned sub-frame SF16 (3) is turned on.

A third example of the above-noted example is shown in FIG. 20 and FIG. 21.

Specifically, in the example shown in FIG. 20 and FIG. 21, the intensity levels of one frame are displayed using seven bits, the gray-scale intensity display sequence of the sub-frames being in the sequence sub-frame SF4 (1), sub-frame SF8 (1), sub-frame SF2, sub-frame SF4 (3), sub-frame SF1, sub-frame SF8 (2) and sub-frame SF4 (2).

In this third example, while 32 gray-scale display levels can be expressed, as shown in the drawings.

First, in the case of the 1st mode, when the gray-scale display level changes from 3 to 4, the sub-frame SF4 (3), at the center is turned on.

When the gray-scale display level changes from 7 to 8, sub-frame SF4 (1) which is near the beginning and sub-frame SF4 (3) at the center are turned on.

When the gray-scale display level changes from 11 to 12, to avoid concentrations of light areas within one frame, sub-frame SF4 (1) near the beginning, sub-frame SF4 (3) at the very center, and sub-frame SF4 (2) near the end are turned on. Further, when the gray-scale display level changes from 15 to 16, sub-frame SF8 (1), near the beginning and sub-frame SF4 (3) at the very center and sub-frame SF4 (2) near the end are also turned on.

When the gray-scale display level changes from 19 to 20, the sub-frame SF8 (1) at the beginning, sub-frame SF4 (3) at the very center and sub-frame SF8 (2) near the end are turned on, and when the gray-scale display level changes from 23 to 24, sub-frame SF4 (1) and sub-frame SF8 (1) near the beginning, sub-frame SF4 (3) at the very center, and sub-frame SF8 (2) near the end, are turned on. Further, when the gray-scale display level changes from 27 to 28, the sub-frame SF4 (1), sub-frame SF8 (1) near the beginning, sub-frame SF4 (3) at the very center, sub-frame SF8 (2) and sub-frame SF4 (2) near the end are turned on.

In the 2nd mode, when the gray-scale level changes from 3 to 4, from 11 to 12, from 19 to 20, or from 27 to 28, what happens is the same as that described above for the 1st mode, and so will not be repeated here. When the gray-scale display level changes from 7 to 8, the sub-frame SF4 (3) at the very center and the sub-frame SF4 (2) near the end are turned on, and when the gray-scale display level changes from 15 to 16, the sub-frame SF4 (1) near the beginning, the sub-frame SF4 (3) in the very center, and the sub-frame SF8 (2) near the end are turned on.

In addition, when the gray-scale display level changes from 23 to 24, the sub-frame SF8 (1) near the beginning, the sub-frame SF4 (3) at the very center, and the sub-frame SF8 (2) and sub-frame SF4 (2) near the end are turned on.

FIG. 22 and FIG. 23 show the above-mentioned fourth example of the present invention.

Specifically, in this example, the gray-scale intensity display sequence of the sub-frames are in the sequence of sub-frame SF4 (1), sub-frame SF8 (1), sub-frame SF2, sub-frame SF1, sub-frame SF8 (2), and sub-frame SF4 (2), FIG. 22 indicating the case of the 1st mode, with the 2nd mode shown in FIG. 23, this having, however, the same arrangement sequence.

The method of selecting the sub-frames to be turned on in this fourth example is approximately the same as the above-mentioned examples 1 to 3.

In this example, the overall number of displayable gray-scale display levels is 28, and there is the danger that it might not be possible to express a gray-scale smoothly.

In this case, as described below in the case of the fifth example, it is possible to shift the weight of each of the sub-frames which express each of the gray-scale display levels to overcome this problem by using the surface gray-scale method.

In this display method, gray-scale levels are displayed by means of the surface gray-scale method and, in this example, two dots which are made up of two adjacent sustained discharge cells, are used to display one gray-scale level, and specifically, as shown in FIG. 25, when performing sustained discharge processing, two dots adjacent to each other in the line direction, for example, are taken as a group, one of the dots being set to the 1st mode (A) and the other being set to the 2nd mode (B).

In an actual example of this, as shown in FIG. 27, the overall gray-scale display level is expressed as the sum of the gray-scale level of the dot which is set to the 1st mode and the gray-scale level of the dot which is set to the 2nd mode.

Basically, in each of the modes, a value is selected that is one-half of the specified gray-scale display level. The gray-scale display level combinations will be mixed in each mode such that there are cases for example the case in which the gray-scale level is 45 or 48 in which different combinations occur and the case in which the gray-scale level is 47, 48, and 49, which will not necessarily be equal to the specified overall gray-scale display level.

In this example, although in the case in which the overall gray-scale display level is an odd number, in the 1st and 2nd modes, different gray-scale levels will occur, by maintaining a certain amount of viewing distance between the view point and the display, it is possible to express, using a two dots vertically and horizontally, gray-scale levels which cannot be expressed with a single dot, so that it is possible to display double the number of gray-scale levels.

It can be seen from FIG. 27, that in this example, although for a gray-scale display level of 46 or lower the gray-scale level is changed linearly, when the gray-scale display level is greater than 47, the method of changing is adjusted to change every other time, to enable expression of 64 gray-scale levels.

The principle involved in this can also be applied to a four-dot combination and, as shown in FIG. 26, it is possible to have at least two 1st sustained discharge cells A1 and A2 set to the 1st mode and at least two 2nd sustained discharge cells B1 and B2 set to the 2nd mode, these cells being alternated in both the scan line direction and in the direction perpendicular to the scan line direction, thereby forming a staggered arrangement pattern within each thus-formed dot group, these being used to display the desired gray-scale levels, and in this case it is possible to set four times the number of gray-scale display levels.

In a fifth example of the present invention, in contrast to previous examples, in which there was spatial or temporal dispersion of the 1st and 2nd modes, a given fixed number is established for each gray-scale level, with either the 1st and 2nd modes distributed for each gray-scale display level or distributed randomly.

Specifically, as shown in FIG. 28 and FIG. 29, the gray-scale intensity display sequence of the sub-frames are in the sequence of sub-frame SF8 (1), sub-frame SF16 (1), sub-frame SF2, sub-frame SF8 (3), sub-frame SF4, sub-frame SF1, sub-frame SF16 (2), and sub-frame SF8 (2).

In this example, when the gray-scale level changes to a level which is a multiple of 8 (for example, as change in the gray-scale level from 15 to 16 or from 31 to 32), the same type of effect is achieved as in the example shown in FIG. 16 and FIG. 17, making it possible to reduce the generation of false color contours.

However, in the case of the example shown in FIG. 16 and FIG. 17, with respect to changes other than the generation of false color contours, that is, with respect to, for example, moving images which change by one or two gray-scale levels, there inevitably occurred a light/dark dot every other dot, this causing the problem of the generation of a staggered pattern hatching. In this example, however, because, at least for the same grayscale display level, when viewed for each dot and when viewed spatially, the sub-frame arrangement is the same and the generation of the light/dark dots is eliminated, this enabling the suppression of the staggered hatching while maintaining the effect of suppressing the false color contours.

Next, the sixth example of the present invention is explained hereunder with reference to FIGS. 30 and 31.

Specifically, in the sixth example shown in FIG. 30 and FIG. 31 the intensity levels of one frame are displayed using seven bits, the gray-scale intensity display sequence of the sub-frames being in the sequence sub-frame SF2, sub-frame SF8 (1), sub-frame SF6 (1), sub-frame SF4, sub-frame SF16 (2), sub-frame SF8 (2), and sub-frame SF1.

In this sixth example, while only 56 gray-scale display levels can be expressed, as shown in the drawings, by using the high-intensity gray-scale display levels two times each, it is possible to express 64 gray-scale levels.

First, in the case of the 1st mode, when the grayscale display level changes from 7 to 8, the sub-frame SF8 (1) is turned on.

When the gray-scale display level changes from 15 to 16, sub-frame SF8 (1) near the beginning and sub-frame SF8 (2) near the end are turned on.

When the gray-scale display level changes from 23 to 24, sub-frame SF16 (1) near the beginning and sub-frame SF8 (2) at the end are turned on and, when the gray-scale display level changes from 31 to 32, sub-frame SF16 (1) near the beginning, sub-frame SF16 (2) at the end, are turned on.

When the gray-scale display level changes from 39 to 40, the sub-frame SF8 (1), sub-frame SF16 (1) near the beginning and sub-frame SF16 (2) near the end are turned on, and when the gray-scale display level changes from 47 to 48, sub-frame SF8 (1) and sub-frame SF16 (1) near the beginning, and sub-frame SF16 (2) and sub-frame SF8 (2) near the end, are turned on.

In the 2nd mode, when the gray-scale level changes from 7 to 8, from 15 to 16, from 23 to 24, from 31 to 32, or from 47 to 48, what happens is the same as that described above for the 1st mode, and so will not be repeated here. When the gray-scale display level changes from 7 to 8, the sub-frame SF8 (2) near the beginning is turned on, and when the gray-scale display level changes from 23 to 24, the sub-frame SF8 (1) near the beginning, the sub-frame SF16 (2) near the end are turned on.

In addition, when the gray-scale display level changes from 39 to 40, the sub-frame SF16 (1) near the beginning, the sub-frame SF16 (2) and the sub-frame SF8 (2) near the end are turned on.

The aforesaid first to sixth embodiments can suppress occurrence of a false colored contour. However, further improvement is still demanded. The present inventor has made profound studies and invented the arrangement of sub-frames and the sequences of sub-frames in first and second mode, which are more helpful in suppressing occurrence of a false colored contour than those in the first to sixth embodiments.

According to the invented arrangement of sub-frames and the first examples of sequences of sub-frames in first and second modes, the highest luminance level is made equal to the sum of the second and third highest luminance levels. Thus, the number of combinations of sub-frames for realizing desired display luminances can be increased efficiently. Specifically, when the luminance levels associated with a plurality of sub-frames are set in descending order from the highest level as luminance levels Nn, Nn-1, Nn-2, etc., and N1, the relationship of Nn=Nn-1+Nn-2 is established. When many luminance levels are associated with sub-frames, the above relationship should preferably be established among the second, third, and fourth highest luminance levels.

Moreover, as long as the number of combinations of sub-frames for realizing desired display luminances can be increased efficiently, the above relationship may not be established from a strict viewpoint. For example, if there is any sub-frame relative to which the above relationship is established, it is advantageous. In this case, preferably, the sum of luminance levels associated with the other two sub-frames exceeds the highest luminance level.

Alternatively, two sub-frames may be associated with a high luminance level and arranged near both ends of one frame. Moreover, two modes of sequences of sub-frames may be set and combined appropriately.

For minimizing a disturbance in gray-scale display, that is, for improving display quality, the following three requirements should presumably be met:

(1) sub-frames during which light is irradiated are sequenced within one frame in well-balanced fashion;

(2) a change in weighted mean of luminance levels associated with sub-frames, during which light is irradiated, caused by a change of gray-scale levels is made as small as possible; and (3) an interval between sub-frames during which light is irradiated is made as short as possible.

For realizing the minimization of a disturbance or improvement of display quality, many sub-frames are associated with the same luminance level, sub-frames are combined properly so that the above three requirements can be met, and thus a gray-scale level to be displayed is realized.

On the other hand, the performance for achieving the brightest possible display and rendering numerous gray-scale levels during a given frame is required. In the case of a PDP display device, as described previously, each sub-frame must include a reset period and addressing period. When the number of sub-frames is increased, the ratio of reset periods and addressing periods during which no contribution is made to a display luminance gets larger. Consequently, the highest luminance of the display device, that is, the display luminance attained by lighting a cell during all sub-frames decreases. For increasing the number of gray-scale levels that can be rendered, it is necessary to increase the number of luminance levels associated with sub-frames.

The display quality and performance have a trade-off relationship. It is difficult to realize a combination of sub-frames satisfying the requirements for both the display quality and performance. In the first to sixth embodiments, a plurality of sub-frames are associated with the highest and second highest luminance levels and arranged at both ends of one frame. Thus, an attempt has been made to satisfy the requirements. However, the luminance levels associated with sub-frames are n factorial 2 as they are in the prior art. On the contrary, in a method of displaying grayscale in an intraframe time-division multiplexing type display device of the present invention, the sum of the second and third highest luminance levels is made equal to the highest luminance level. The number of combinations of sub-frames for attaining gray-scale levels can be increased efficiently.

The arrangement of sub-frames and sequences thereof in first and second modes in line with the foregoing rule will be described below.

FIG. 36 is a table for indicating sequences of sub-frames during which a cell is lit in the seventh embodiment.

As shown in FIG. 36, in the first embodiment, one frame is composed of seven sub-frames SF1, SF2, SF3, SF4, SF5, SF6, and SF7. The ratio of luminance levels associated with the sub-frames is 1:2:2:4:4:6:6. The sub-frames are arranged in the sequence of sub-frames SF6, SF4, SF2, SF1, SF3, SF5, and SF7.

In the seventh embodiment, sub-frames are associated with four luminance levels. The three higher luminance levels are each associated with two sub-frames. The three higher luminance levels have the relationship of 6=4+2. The luminance level associated with sub-frames SF6 and SF7 is therefore attained by adding the luminance level associated with sub-frames SF2 and SF3 to the one associated with sub-frames SF4 and SF5. A total of 26 gray-scale levels can be rendered.

As illustrated, in the seventh embodiment, two modes of first and second modes are available. Either of the modes is selected for each cell. Alternatively, as described later, a plurality of adjoining cells are grouped together, and the cells of each group are set to either of the modes. In the first mode, sub-frames succeeding sub-frame SF6 or a sub-frame during which light is irradiated first within one frame are selected in preference. In the second mode, sub-frames preceding sub-frame SF7 or a sub-frame during which light is irradiated last within one frame are selected in preference.

Owing to the foregoing arrangements of sub-frames, taking the first mode for instance, when the thirteenth gray-scale level is changed to the fourteenth level, the states of a cell during the four preceding sub-frames SF6, SF4, SF2, and SF1 are changed from unlit, lit, lit, and lit states respectively to lit, unlit, lit, and unlit states respectively. A difference in relative timing of a sub-frame associated with a higher luminance level during which a cell glows within one frame, which derives from a change of gray-scale levels, can be minimized. Consequently, a false colored contour phenomenon that takes place in a dynamic image can be suppressed.

FIGS. 37 and 38 are tables for indicating sequences of sub-frames during which a cell is lit in the eighth embodiment. FIG. 37 relates to the first mode, while FIG. 38 relates to the second mode.

As shown in FIGS. 37 and 38, in the eighth embodiment, a frame is composed of eight sub-frames SF1, SF2, SF3, SF4, SF5, SF6, SF7, and SF8. The ratio of luminance levels associated with the sub-frames is 1:2:4:4:8:8:12:12. The sub-frames are arranged in the sequence of sub-frames SF7, SF5, SF3, SF1, SF2, SF4, SF6, and SF8.

In the eighth embodiment, sub-frames are associated with five luminance levels. The three higher luminance levels are each associated with two sub-frames. The three higher luminance levels have the relationship of 12=8+4. The luminance level associated with sub-frames SF7 and SF8 is attained by adding the luminance level associated with sub-frame SF3 and SF4 to the one associated with sub-frames SF5 and SF6. A total of 52 gray-scale levels can be rendered.

FIG. 39 is a table for indicating sequences of sub-frames during which a cell is lit in the ninth embodiment.

As apparent from FIG. 39, in the ninth embodiment, a frame is composed of nine sub-frames. The ratio of luminance levels associated with the sub-frames is 24:14:8:4:1:2:8:16:24. In the ninth embodiment, the sub-frames are associated with six luminance levels. The three higher luminance levels are each associated with two sub-frames. The three higher luminance levels have the relationship of 24=16+8. The highest luminance level can be attained by combining sub-frames associated with the second and third highest luminance levels. A total of 104 gray-scale levels can be rendered.

FIG. 40 is a table for indicating sequences of sub-frames during a cell is lit in the tenth embodiment.

As apparent from FIG. 40, in the tenth embodiment, a frame is composed of ten sub-frames. The ratio of luminance levels associated with the sub-frames is 48:32:16:8:1:2:4:16:32:48. In the tenth embodiment, the sub-frames are associated with seven luminance levels. The three higher luminance levels are each associated with two sub-frames. The three higher luminance levels have the relationship of 48=32+16. The highest luminance level can be attained by combining sub-frames associated with the second and third highest luminance levels. A total of 208 gray-scale levels can be rendered.

FIGS. 41 and 42 are tables for indicating sequences of sub-frames during which a cell is lit in the eleventh embodiment. FIG. 41 relates to the first mode, while FIG. 42 relates to the second mode.

As apparent from FIGS. 41 and 42, in the eleventh embodiment, a frame is composed of nine sub-frames. The ratio of luminance levels associated with the sub-frames is 10:6:4:2:1:2:4:6:10. In the eleventh embodiment, the sub-frames are associated with five luminance levels. The four higher luminance levels are each associated with two sub-frames. The three higher luminance levels have the relationship of 10=6+4. The second to fourth highest luminance levels have the relationship of 6=4+2. The highest luminance level can be attained by combining sub-frames associated with the second and third highest luminance levels. The second highest luminance level can be attained by combining sub-frames associated with the third and fourth highest luminance levels. A total of 46 gray-scale levels can be rendered.

FIGS. 43 and 44 are tables for indicating sequences of sub-frames during which a cell is lit in the twelfth embodiment. FIG. 43 relates to the first mode, while FIG. 44 relates to the second mode.

As apparent from FIGS. 43 and 44, in the twelfth embodiment, a frame is composed of ten sub-frames. The ratio of luminance levels associated with the sequenced sub-frames is 20:12:8:4:1:2:4:8:12:24. In the twelfth embodiment, the sub-frames are associated with six luminance levels. The four higher luminance levels are each associated with two sub-frames. The three higher luminance levels have the relationship of 20=12+8. The second to fourth highest luminance levels have the relationship of 12=8+4. The highest luminance level can be attained by combining sub-frames associated with the second and third highest luminance levels. The second highest luminance levels can be attained by combining sub-frames associated with the third and fourth luminance levels. A total of 92 gray-scale levels can be rendered.

FIGS. 45 and 46 are tables for indicating sequences of sub-frames during which a cell is lit in the thirteenth embodiment. FIG. 45 relates to the first mode, while FIG. 46 relates to the second mode.

Figures 10, 11:
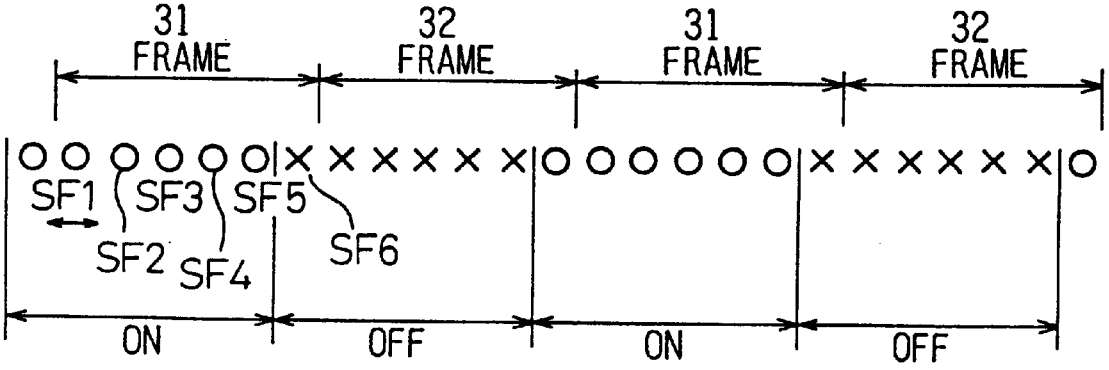
Fig.10 PRIOR ART
Fig.11 PRIOR ART
FIG. 10 is a drawing which explains the combinations of displayed gray-scales and sustained discharged sub-frames in a prior art plasma display device.
FIG. 11 is a drawing which explains the occurrence of problems in a prior art plasma display device.
Figure 12:
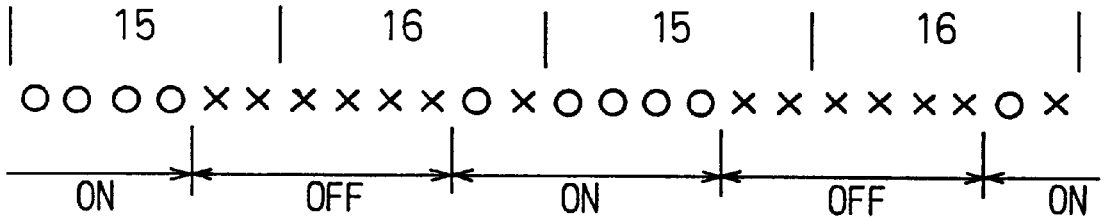
Fig.12 PRIOR ART
FIG. 12 is a drawing which explains the occurrence of problems in a prior art plasma display device.
Figure 13:
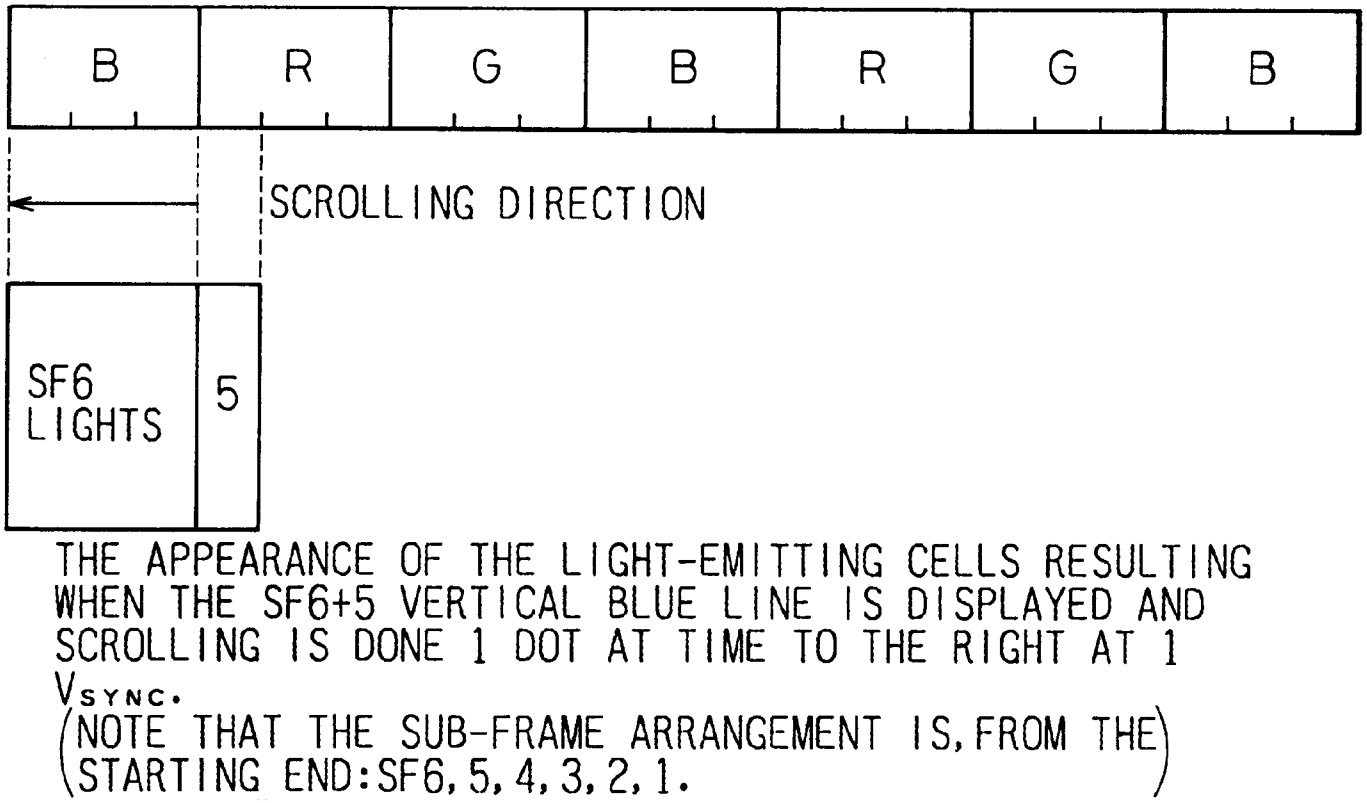
FIG. 13 is a drawing which explains the occurrence of problems in a prior plasma display device.
Figure 14:
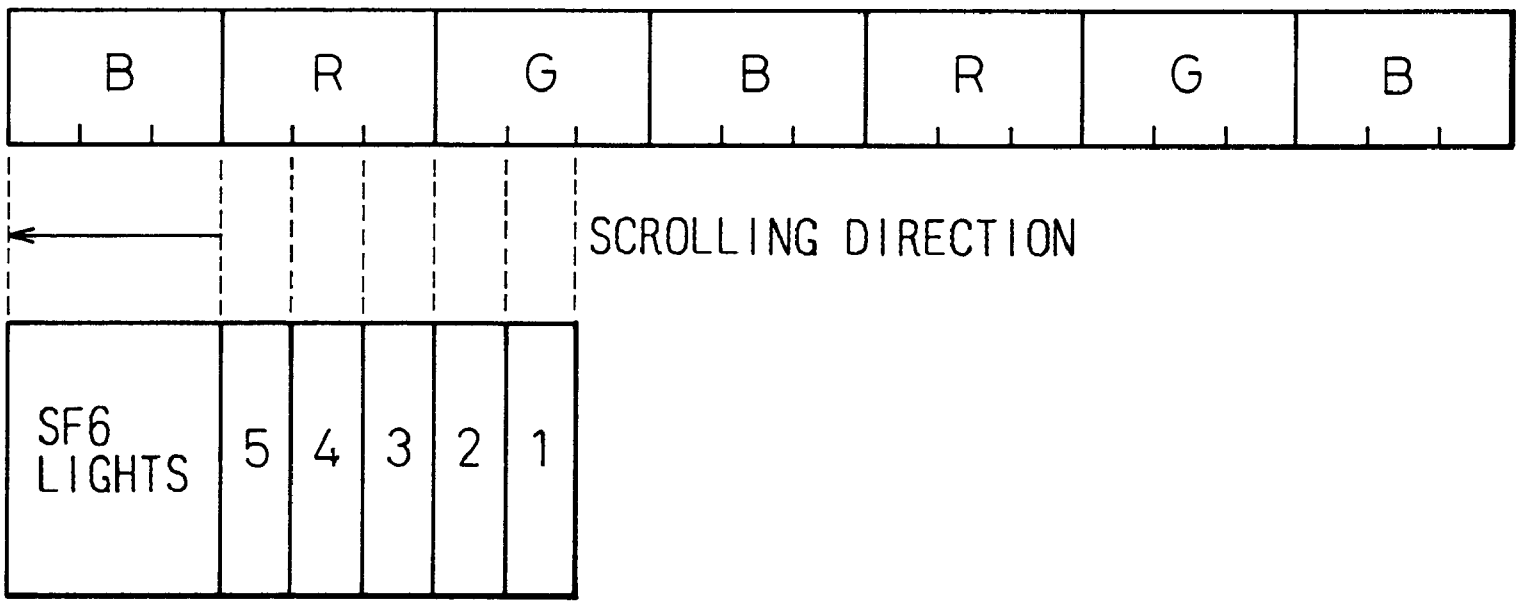
FIG. 14 is a drawing which explains the occurrence of problems in a prior art plasma display device.
Figure 15:
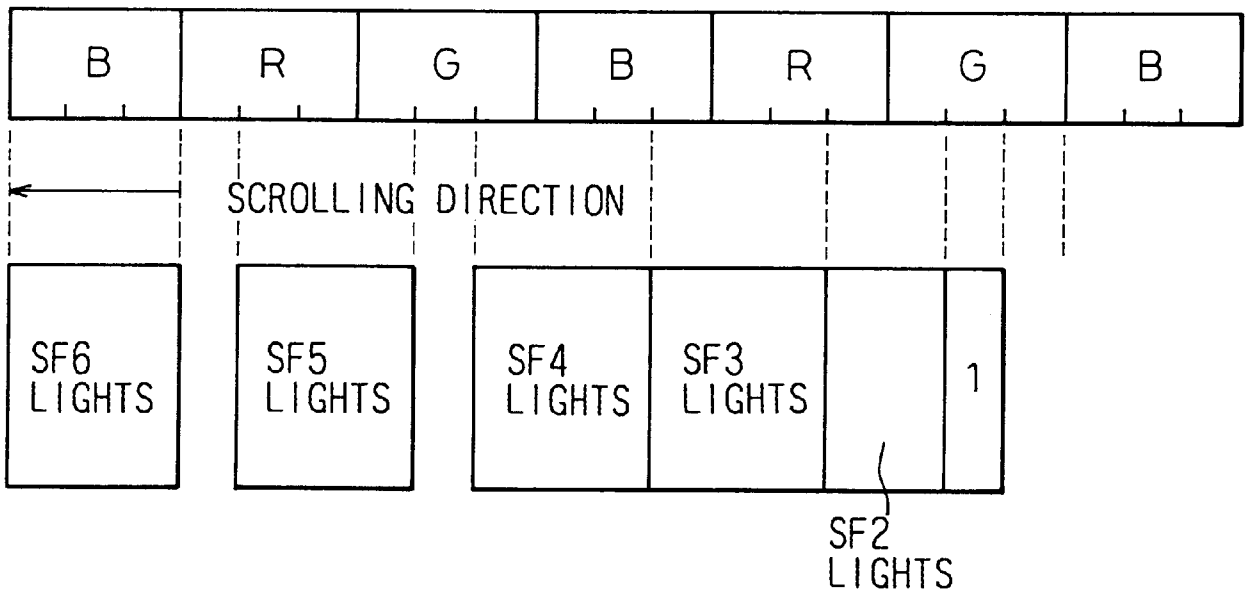
FIG. 15 is a drawing which explains the occurrence of problems in a prior art plasma display device.
Figure 32:
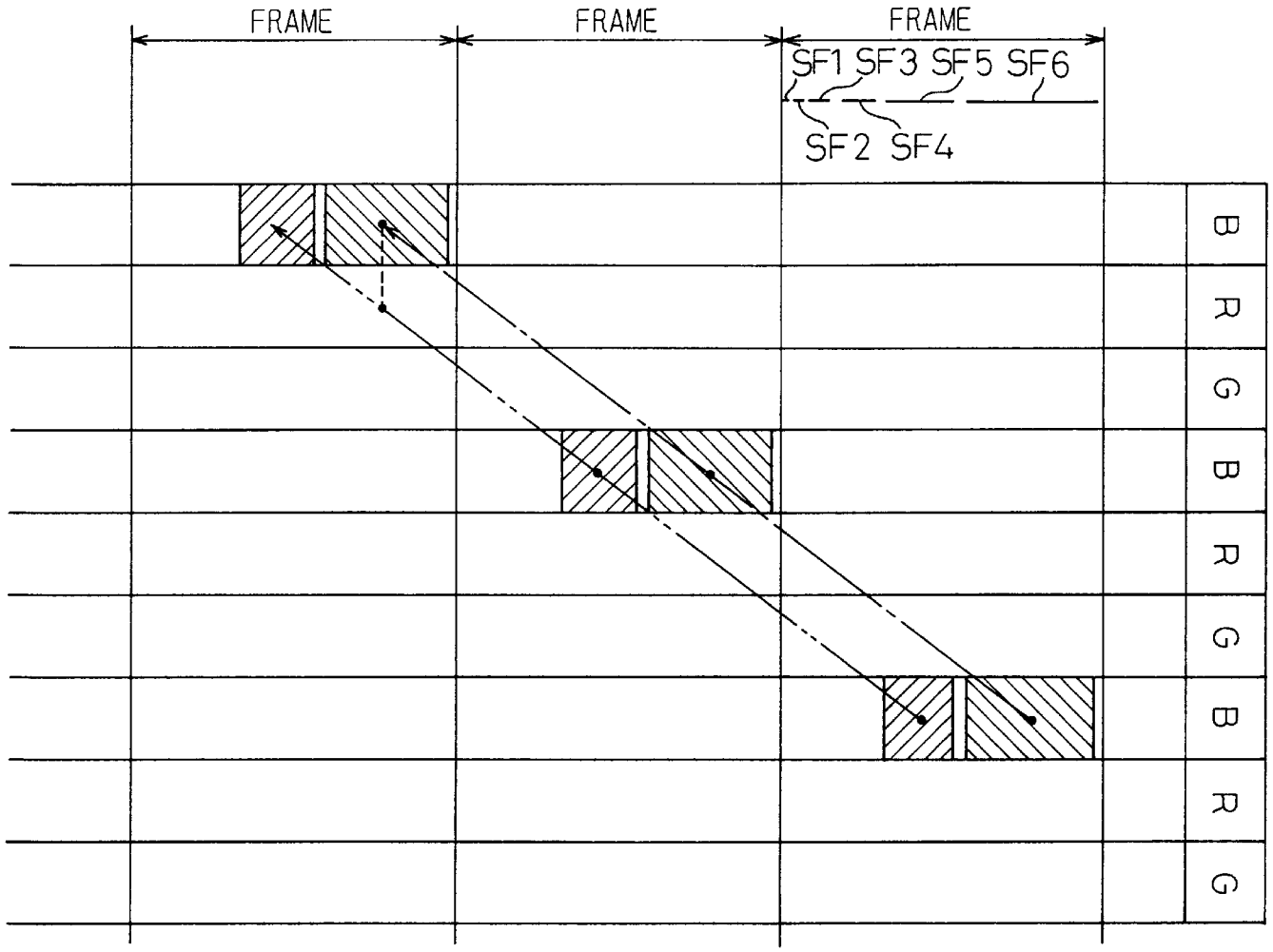
FIGS. 32 and 33 are diagrams for explaining occurrence of a false colored contour phenomenon in a dynamic image due to a method of displaying gray-scale in an intraframe time-division multiplexing type display device.
Figure 33:
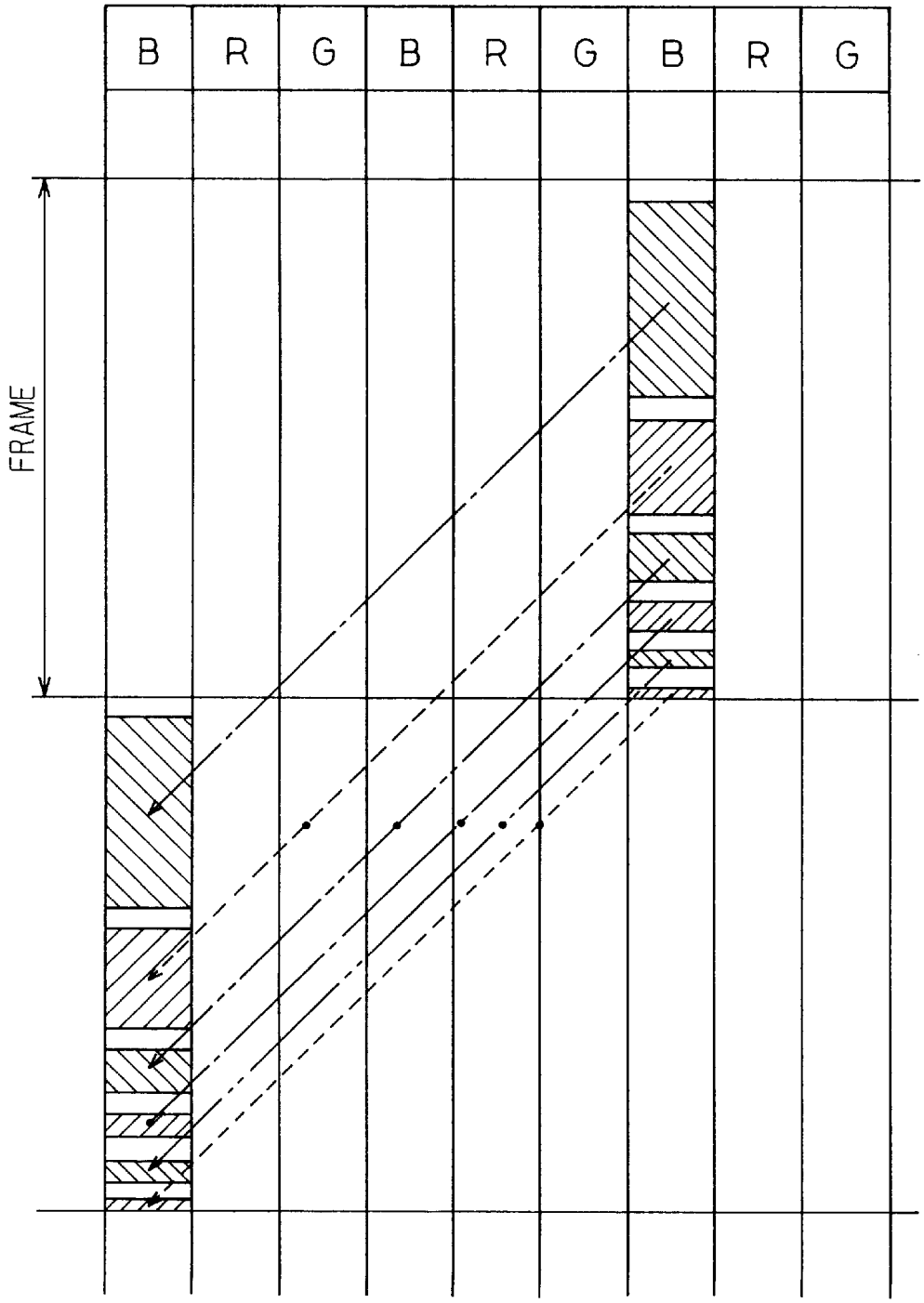

As apparent from FIGS. 11 and 12, in the thirteenth embodiment, a frame is composed of eleven sub-frames. The ratio of luminance levels associated with the sequenced sub-frames is 40:24:16:8:4:1:2:8:16:24:40. In the thirteenth embodiment, the sub-frames are associated with seven luminance levels. The four higher luminance levels are each associated with two sub-frames. The three higher luminance levels have the relationship of 40=24+16. The second to fourth highest luminance levels have the relationship of 24=16+8. The highest luminance level can be attained by combining sub-frames associated with the second and third highest luminance levels. The second highest luminance level can be attained by combining sub-frames associated with the third and fourth highest luminance levels. A total of 184 gray-scale levels can be rendered.

In the aforesaid seventh to tenth embodiments, assuming that the highest luminance level is a (a: integer), a value obtained by increasing a so that a becomes a multiple of 3 is 3m (m: integer), and sub-frames are divided into three groups A, B, and C according to the associated luminance levels under the conditions of $2m<A\leqq 3m$, $m<B\leqq 2m$, and $C\leqq m$, when the highest luminance level associated with each group is Xmax (X: A, B, or C), there is a sub-frame relative to which the relationship of a=Bmax+Cmax is established. However, the above conditions need not always be met strictly. A variety of modifications are conceivable.

FIGS. 47 and 48 are tables for indicating sequences of sub-frames during which a cell is lit in the fourteenth embodiment. FIG. 47 relates to the first mode, while FIG. 48 relates to the second mode.

As apparent from FIGS. 47 and 48, in the fourteenth embodiment, a frame is composed of eight sub-frames SF1, SF2, SF3, SF4, SF5, SF6, SF7, and SF8. The ratio of luminance levels associated with the sub-frames is 1:2:4:4:8:8:11:11. The sub-frames are arranged in the sequence of sub-frames SF7, SF5, SF3, SF1, SF2, SF4, SF6, and SF8. Assuming that the highest luminance level is a (a: integer), a value obtained by increasing a so that a becomes a multiple of 3 is 3m (m: integer), and the sub-frames are divided into three groups A, B, and C according to the associated luminance levels under the conditions of $2m<A\leqq 3m$, $m<B\leqq 2m$, and $C\leqq m$, when the maximum luminance level associated with each group is Xmax (X: A, B. or C), there is no sub-frame relative to which the relationship of a=Bmax+Cmax is established but there is a sub-frame relative to which the relationship of a<Bmax+Cmax is established.

As apparent from the comparison of FIGS. 37 and 38, the sequences of sub-frames during which a cell is lit in the fourteenth embodiment are substantially identical to those in the eighth embodiment. The only difference lies in that the ratio of the luminance level associated with sub-frames SF7 and SF8 to the other luminance levels is not 12 but is 11 in the fourteenth embodiment. In the eighth embodiment, the number of gray-scale levels to be rendered is 52. In the fourteenth embodiment, the number thereof is decreased to 50.

FIGS. 49 and 50 are tables for indicating sequences of sub-frames during which a cell is lit in the fifteenth embodiment. FIG. 49 relates to the first mode, while FIG. 50 relates to the second mode.

As apparent from FIGS. 49 and 50, in the fourteenth embodiment, a frame is composed of eight sub-frames SF1, SF2, SF3, SF4, SF5, SF6, SF7, SF8, and SF9. The ratio of luminance levels associated with the sub-frames is 1:2:2:4:4:6:6:9:9. The sub-frames are arranged in the sequence of sub-frames SF8, SF6, SF4, SF3, SF1, SF2, SF4, SF6, and SF8. The four higher luminance levels are each associated with two sub-frames. The sum of the second and third highest luminance levels is larger than the highest luminance level. The sum of the third and fourth highest luminance levels equals to the second highest luminance level.

As apparent from the comparison with FIGS. 41 and 42, the sequences of sub-frames during which a cell is lit in the fifteenth embodiment are substantially identical to those in the eleventh embodiment. The only difference is that the ratio of the luminance level associated with sub-frames SF8 and SF9 to the other levels is not 10 but is 9. In the eleventh embodiment, the number of gray-scale levels that can be rendered is 46. In the fifteenth embodiment, the number thereof is decreased to 44.

The embodiments of the present invention have been described so far. The embodiments present only some examples. Many variants are conceivable.

In general, it is thought that good display can be achieved when the conditions described below are met. Specifically, assuming that the highest luminance level of all luminance levels associated with a plurality of sub-frames is a (a: integer), a value obtained by increasing a so that a becomes a multiple of 3 is 3m (m: integer), and the sub-frames are divided into three groups A1, B1, and C1 according to the associated luminance levels under the conditions of $2m<A1\leqq 3m$, $m<B1\leqq 2m$, and $C1\leqq m$, when the maximum luminance level associated with each group is X1max (X1: A1, B1, or C1), there is a sub-frame relative to which the relationship of $a\leqq B1max+C1max$ is established. In addition, more preferably, assuming that the lowest luminance level of which the ratio is not a power of 2 is b (b:

integer), a value obtained by increasing b so that b becomes a multiple of 3 is 3m (m: integer), and said sub-frames are divided into three groups B1, C1, and D1 according to the associated luminance levels under the conditions of $2m<B1\leqq 3m$, $m<C1\leqq 2m$, and $D1<m$, when the highest luminance level associated with each group is X1max (X1: B1, C1, or D1), the relationships of $b<C1max+D1max$ is established and there are at least two sub-frames of luminance level a to which the relationship of $a\leqq B1+C1$ is established.

Furthermore, like the methods of the first to sixth embodiments, three sub-frames may be associated with high luminance levels and arranged near both ends of a frame and in the center thereof.

Furthermore, the method shown in FIG. 24 in which adjoining cells are set to the first and second modes respectively is effective even in the seventh to fifteenth embodiments. Moreover, the surface gray-scale system shown in FIGS. 25 to 27 in which pairs of adjoining cells set to different modes are combined properly may be adopted. In addition, when the gray-scale levels in a full screen vary continually in units of one gray-scale level, it is effective to select patterns of sub-frames so that the first and second mode can alternate every time the gray-scale levels vary.

Figure 34:
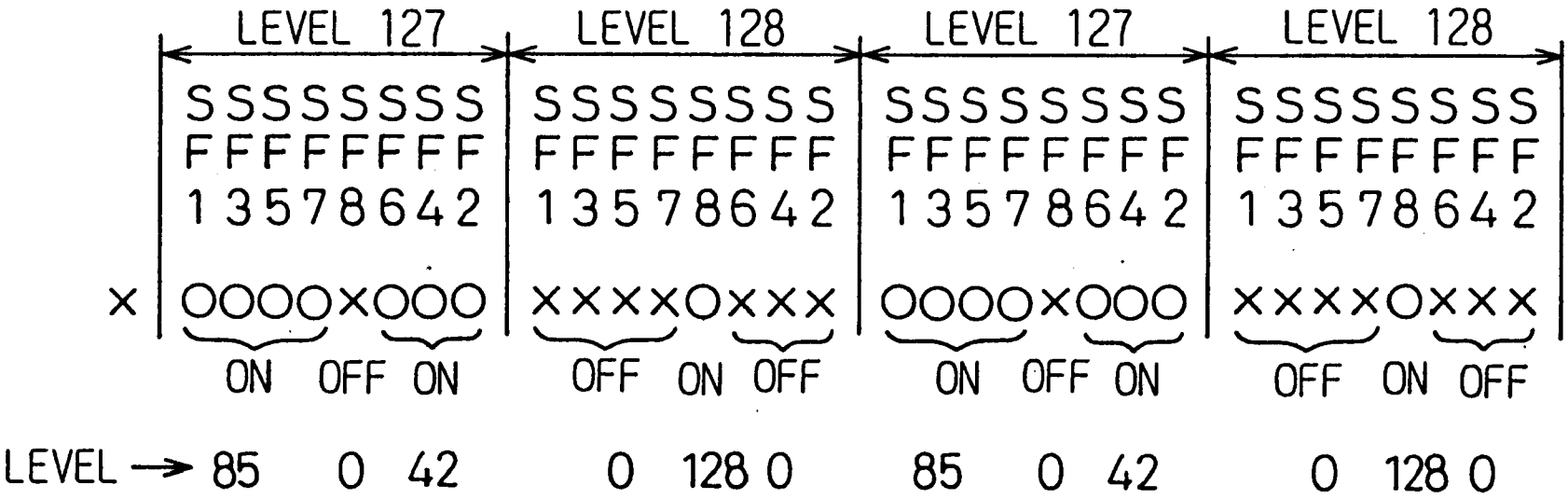
Fig. 34 PRIOR ART
FIG. 34 is a diagram for explaining a technique of suppressing occurrence of flicker in the prior art.
Figure 35:
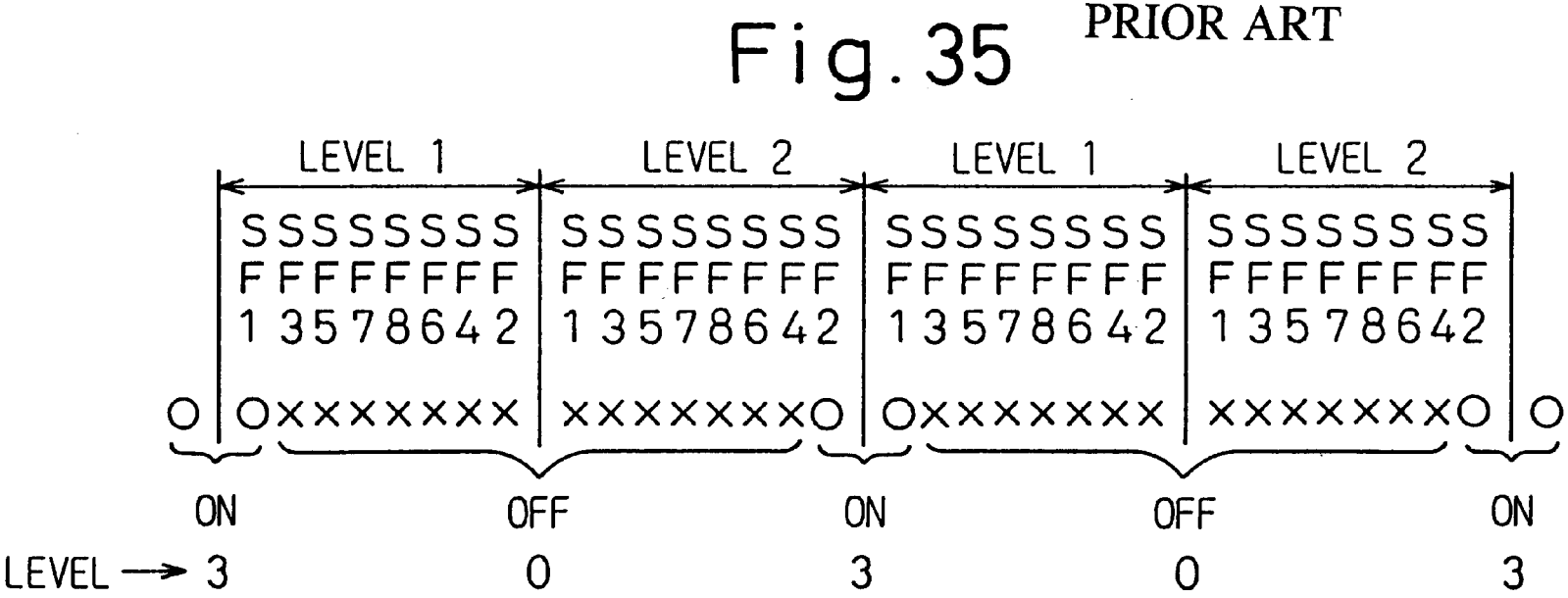
Fig. 35 PRIOR ART
FIG. 35 is a diagram for explaining occurrence of flicker at a low gray-scale level due to the technique of the prior art shown in FIG. 34.

Next, an embodiment attempting to further reduce flicker will be described. As already described, when the sequence of sub-frames can be varied, flicker can be reduced. The embodiment described below uses another method to further reduce flicker. As shown in FIG. 34, if sub-frames associated with larger weights of luminance are arranged in the center of a frame, flicker occurring with a high-order bit of value transition (when a gray-scale level is high) is surely reduced. However, as shown in FIG. 35, flicker occurring with a low-order bit of value transition (when a gray-scale level is low) becomes more conspicuous than it is when no measure is taken. The embodiment described below attempts to minimize flicker occurring with a low-order bit of value transition.

In an image display apparatus of the sixteenth embodiment, for further reducing flicker, according to an image display method of the present invention, one frame during which an image represented by display data is displayed on a display panel is composed of a plurality of sub-frames associated with difference luminance levels. A cell is lit selectively during the plurality of sub-frames, whereby a gray-scale level is rendered. A bit corresponding to a sub-frame within an adjoining frame is used to cover a sub-frame within one frame during which a cell should be lit according to a gray-scale level represented by display data.

Figure 51:
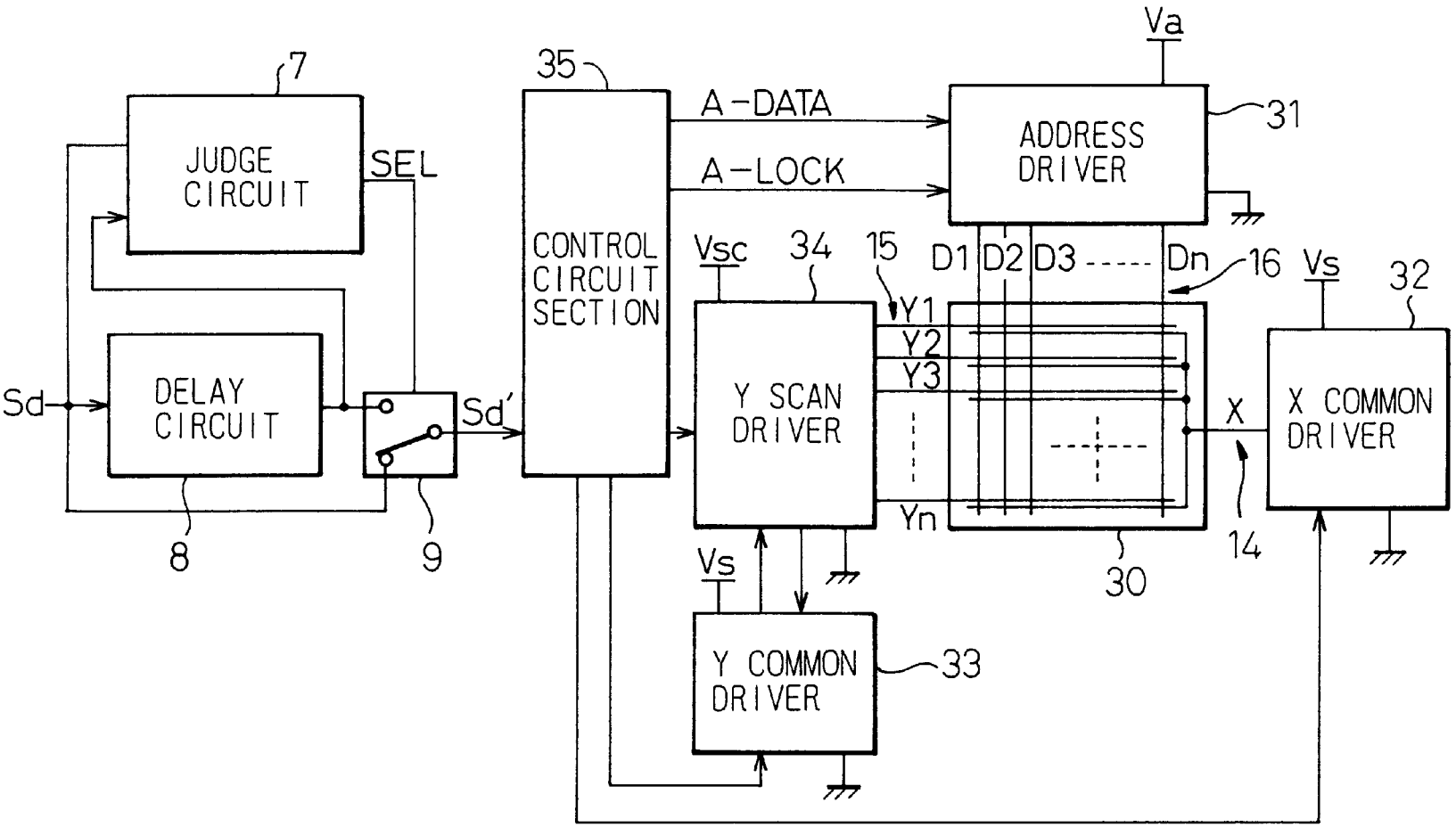
FIG. 51 is a block diagram showing another principles and configuration of the present invention.

FIG. 51 shows the overall configuration of an image display apparatus of the sixteenth embodiment. Components identical to those described previously are assigned the same reference numerals.

As shown in FIG. 51, the image display apparatus of this embodiment is a PDP display device. The address driver 31, X common driver 32, Y common driver 33, Y scan driver 34, and control circuit section 35 which are the same as those shown in FIG. 7 are included. Moreover, an AC type plasma display panel is used as the display panel 30 of the image display apparatus of this embodiment. The display panel 30 is fundamentally adapted for a DC type PDP, liquid-crystal display, or electroluminescent display which utilizes an intraframe time-division multiplexing method.

The description of the configurations of the various drivers, control circuit section, and display panel will be omitted.

In FIG. 51, the image display apparatus of this embodiment is an image display apparatus in which one frame during which an image represented by display data is displayed on the display panel 30 is composed of a plurality of sub-frames associated with different luminance levels, and a cell is lit selectively during the plurality of sub-frames in order to render a gray-scale level. The image display apparatus further comprises a judge circuit 7 for detecting a gray-scale level represented by display data or data to be displayed and determining whether or not a bit corresponding to a sub-frame within an adjoining frame is used, a delay circuit 8 that when it is determined that a bit corresponding to a sub-frame within an adjoining frame is used, delays an image by one frame, covers a sub-frame within the one frame during which a cell should be lit using the bit corresponding to the sub-frame within the adjoining frame, and an output switching means 9 that when a switching signal SEL output from the judge means 7 has a given level, changes a bit corresponding to a sub-frame within one frame during which a cell should be lit to a bit corresponding to a sub-frame which is delayed till an adjoining frame. An output signal Sd' sent from the output switching means 9 is input as display data representing an image to the control circuit section 35.

In the image display apparatus of this embodiment, as shown in FIGS. 34 and 35, a sequence of sub-frames is such that sub-frames associated with smaller weights of luminance are arranged alternately across a sub-frame associated with the largest weight of luminance within a frame. Sub-frames associated with smaller weights of luminance are arranged near the start and end of a frame. It is judged if display data corresponding to one frame should be displayed in combination with that corresponding to an adjoining frame. If it is judged that the display data should be displayed in combination, bits corresponding to sub-frames associated with smaller weights of luminance that are displayed in combination with the display data corresponding to the adjoining frame. A sub-frame associated with the largest weight of luminance of all the sub-frames associated with the smaller weights of luminance is arranged at the start or end of the frame.

The image display apparatus of this embodiment can be adapted for a sequence of sub-frames in which sub-frames associated with larger weights of luminance within one frame are arranged alternately at the start and end of the frame. In this case, it is bits corresponding to sub-frames associated with the larger weights of luminance that are judged to see if the bits should be displayed in combination with display data corresponding to an adjoining frame. Incidentally, sub-frames associated with smaller weights of luminance are arranged in the center of the frame. Preferably, sub-frames associated with smaller weights of luminance are arranged across a sub-frame associated with the largest weight of luminance of all sub-frames associated with the smaller weights of luminance.

More preferably, a means for judging if an image represented by display data is an animated image or still image is included. The judge circuit 7 and delay circuit 8 are operated so that only when an image is judged as a still image or a slow-motion animated image, a bit corresponding to a sub-frame within an adjoining frame is used to cover a sub-frame within one frame during which a cell should be lit.

Figure 52:
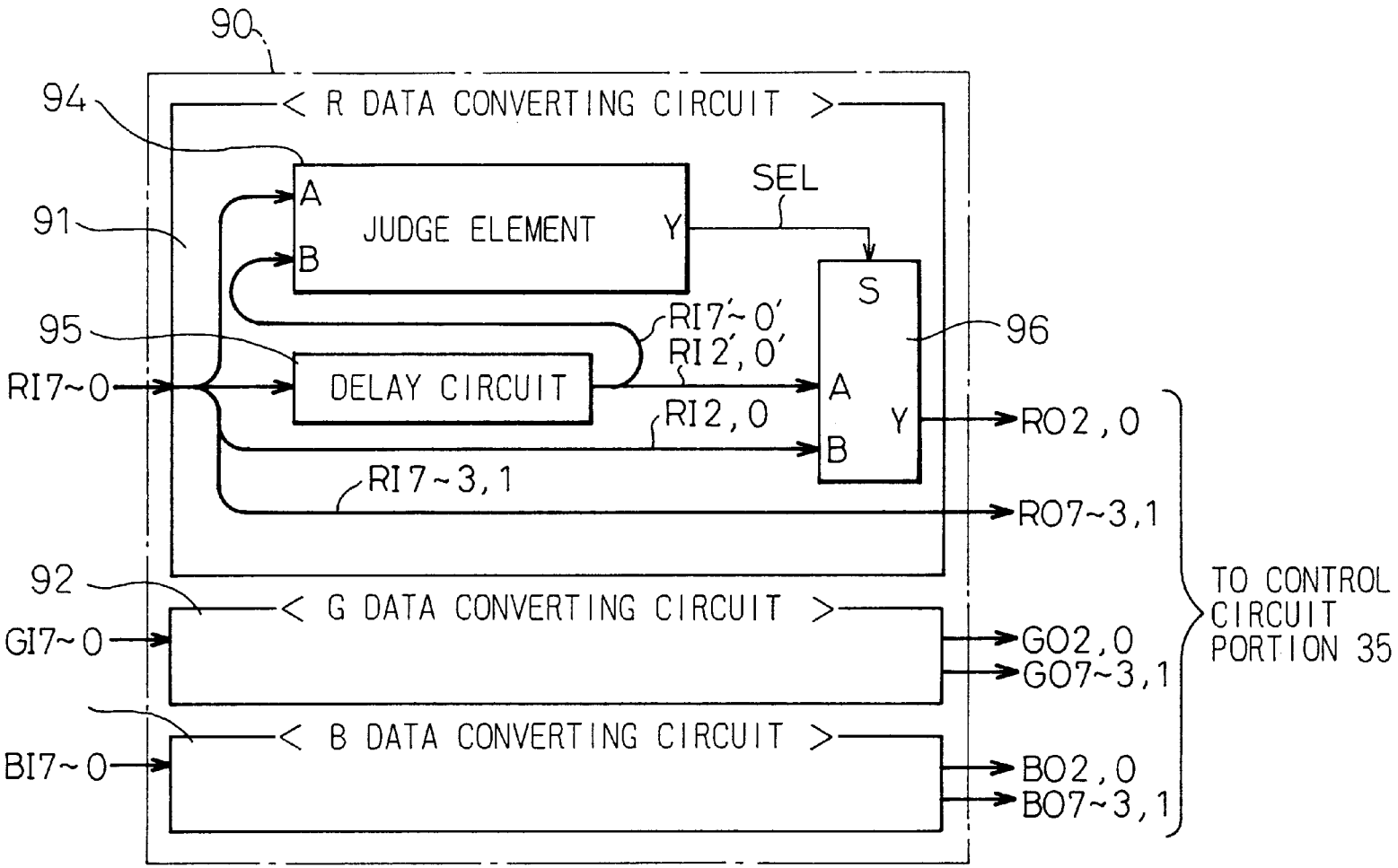
FIG. 52 is a circuit block diagram showing the configuration of the sixteenth embodiment of the present invention.
Figure 53:
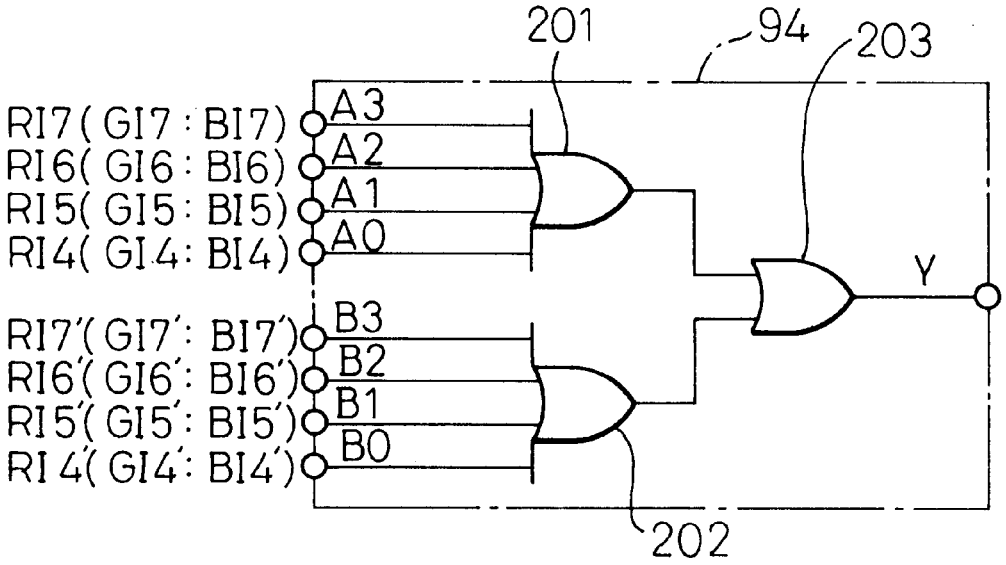
FIG. 53 is a circuit diagram showing a first example of a judge element of the embodiment.
Figure 54:
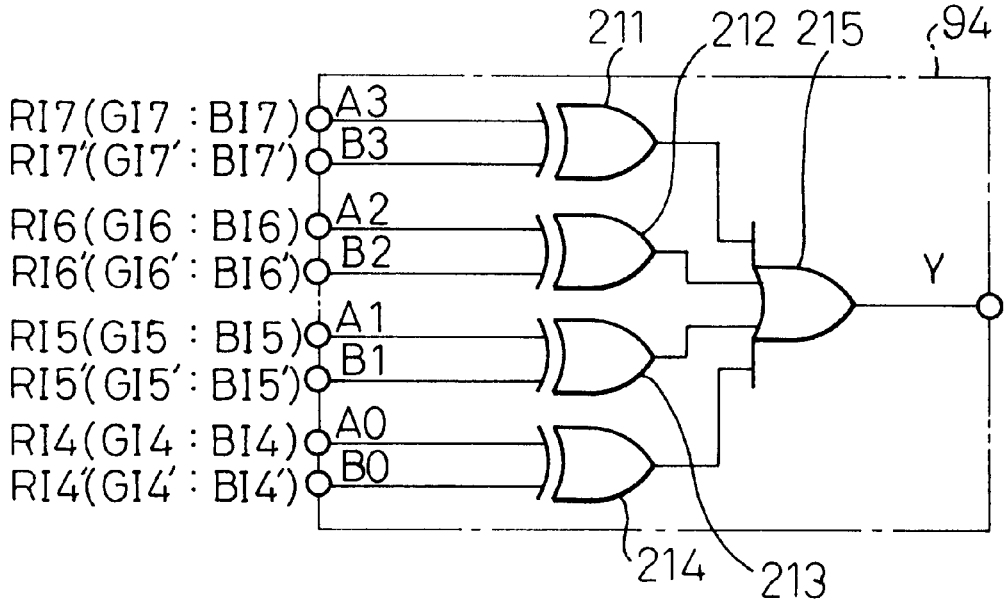
FIG. 54 is a circuit diagram showing a second example of a judge element of the embodiment.

Referring to FIGS. 52 to 54, the constituent features of this embodiments will be described in more detail.

FIG. 52 is a circuit block diagram showing the configuration of this embodiment. In FIG. 52, a sequence of sub-frames within one frame is such that sub-frames associated with smaller weights of luminance are arranged across a sub-frame associated with a large weight of luminance. For example, a plurality of sub-frames are arranged in the sequence of sub-frames SF0, SF2, SF4, SF6, SF7, SF5, SF3, and SF1. A data stream conversion unit 90 is connected on the preceding state of a display data input port of the control circuit section 35 for controlling rendering of a gray-scale level.

The data stream conversion unit 90 for color display comprises a red (R) data converting circuit 91, green (G) data converting circuit 92, and blue (B) data converting circuit 93. The R data converting circuit 91, G data converting circuit 92, and B data converting circuit 93 have the same circuitry. Each of the three data converting circuits 91 to 93 includes a delay circuit 95 corresponding to the delay circuit 8 shown in FIG. 51, a judge element 94 comparable to the judge circuit 7 shown in FIG. 51, and an output switch 96 comparable to the output switching means 9 shown in FIG. 51. The delay circuit 95 delays an input display data stream for color display (red input display data R17 to 0, green input display data G17 to 0, or blue input display data B17 to 0) by one frame.

An output switch 96 receives input display data, that is, even low-order bits 2 and 0 of display data (red input display data RI2 and RI0, green input display data GI2 and GI0, or blue input display data BI2 and BI0) through an input port B thereof. Besides, delayed input display data, that is, even low-order bits 2 and 0 delayed by one frame by means of the delay circuit 95 is input to an input port A of the output switch 96.

A switching signal SEL input from the output switch 96 is produced by the judge element 94. Input display data that is an input display signal is input without the delay by one frame to an input port A of the judge element 94. Moreover, delayed input display data that is display data delayed by one frame by the delay circuit 95 (red delayed input display data RI7' and RI0', green delayed input data GI7' and GI0', or blue delayed input display data BI7' and BI0') is input to the judge element 94 through an input port B thereof. At an output port Y of the output switch 96, output display data that is even low-order bits selected through either the input port A or input port B of the output switch 96 according to the switching signal SEL sent from the judge element 94 (red output display data RO2 and RO0, green delayed input data GO7 and GO0', or blue delayed input display data B02 and BO0) is produced. Moreover, output display data that are remaining bits (bits 7 to 3 and 1) (red output display data RO7 to RO3 and RO1, green output display data GO7 to G03 and G01, or blue output display data BO7 to BO3 and BO1) do not pass through the delay circuit 15 and output switch 96 but are input to the control circuit section 35 as they are.

FIG. 53 is a circuit diagram showing a first example of the judge element shown in FIG. 52. In FIG. 53, during a period during which any of gray-scale levels 1 to 31 corresponding to a display luminance is rendered, the output of the output port Y of the judge element 94 is low and the input port A of the output switch 96 is therefore selected.

More particularly, the judge element 94 shown in FIG. 53 is composed of three logic circuit elements such as OR gates 201, 202, and 203. When only the input display data of bit 3 or smaller is valid, that is, when only the input display data that is low-order bits indicating any of gray-scale levels 1 to 31 is input to the data converting circuit (for example, R data converting circuit), input display data that is high-order bits not delayed by one frame (representing weights of luminance of 4 or larger), RI7, RI6, RI5, and RI4, is not input to the input terminals A0 to A3 of the OR gate 201. Moreover, delayed input display data that is high-order bits delayed by one frame, RI7', RI6', RI5', and RI4', is not input to the input terminals B0 to B3 of the OR gate 202. Consequently, the output of the output terminal Y of the OR gate 203 goes low. In other words, since the gray-scale levels are low, when gray-scale levels are rendered during two adjoining frames, flicker can be avoided.

During a period during which any of gray-scale levels 32 to 255 corresponding to a display luminance is rendered, when the output of the output port Y of the judge element 94 goes high, the input port B of the output switch 96 is selected.

To be more specific, when input display data of bit 4 or larger is valid, that is, when input display data of high-order bits indicating any of gray-scale levels 32 to 255 is input to the data converting circuit (for example, the R data converting circuit), input display data of high-order bits that is not delayed by one frame, RI7, RI6, RI5, and R14, is input to the input terminals A0 to A3 of the OR gate 201. The output of the output terminal Y of the OR gate 203 therefore goes high. In other words, since the gray-scale levels are high, even when a gray-scale level is rendered during one frame, flicker does not occur.

FIG. 54 is a circuit diagram showing a second example of the judge element shown in FIG. 52. In FIG. 54, a judge element 94 is composed of four exclusive OR gates 211, 212, 213, and 214, and one OR gate 215.

When one high-order bit of input display data must be carried or borrowed, the output of any of the four exclusive OR gates 211, 212, 213, and 214 to which input display data of four high-order bits and delayed input display data are input is driven high. This causes the output of the output terminal Y of the OR gate 215 on the output stage to go high. Consequently, the input port B of the output switch 96 is selected.

When one high-order bit of input display data need not be carried or borrowed, the output of the output port Y of the judge element 94 is driven low. The input port A of the output switch 96 is selected. In other words, when one high-order bit of input display data is not carried, gray-scale levels are rendered during two adjoining frames. When one high-order bit is carried, a gray-scale level is rendered during one frame.

In this embodiment of the present invention, the description has proceeded on the assumption that sub-frames are arranged in the sequence of sub-frames SF0, SF2, SF4, SF6, SF7, SF4, SF3, and SF1 (that is, sub-frames associated with larger weights of luminance are gathered in the center of a frame). In the case of a sequence of sub-frames SF7, SF4, SF3, SF1, SF0, SF2, SF4, and SF6 (that is, sub-frames associated with smaller weights of luminance are gathered in the center of a frame), the technique of the present invention can also apply. In this case, the relationship between high-order bits and low-order bits is reversed. Specifically, in a sequence of sub-frames in which sub-frames associated with smaller weights of luminance are gathered in the center of a frame, a gray-scale level indicated by high-order bits is rendered using bits corresponding to sub-frames within two adjoining frames. This makes it possible to render a gray-scale level without flicker. In the present invention, a sequence of sub-frames below is preferably adopted in an effort to prevent a bit corresponding to a sub-frame within one frame from being combined with a bit of value transition corresponding to a sub-frame within a preceding frame.

SF2, SF0, SF4, SF6, SF7, SF5, SF1, SF3 SF7, SF5, SF1, SF3, SF2, SF0, SF4, SF6

An image display technique of the present invention can be adapted for a whole display screen of a display panel. In practice, the technique is preferably adapted for a still image prone to flicker. For example, a means for judging whether an image represented by display data is a dynamic image, still image, or a slow-motion dynamic image is included in the judge means 94 shown in FIG. 51. Only when judging that an image appearing on a display panel is a still image or slow-motion dynamic image, the still image judgment means covers a sub-frame within one frame during which a cell should be lit using a bit corresponding to a sub-frame within an adjoining frame. Thus, flicker is avoided.

In short, preferably, input display data and delayed input display data made by delaying the input display data by one frame are input to the still image judgment means. A moving area is then distinguished from a motionless area. Based on the result of judgment provided by the still image judgment means, the output switch 96 may switch the output of the judge element 94 and the output of the delay element 95.

Figure 55:
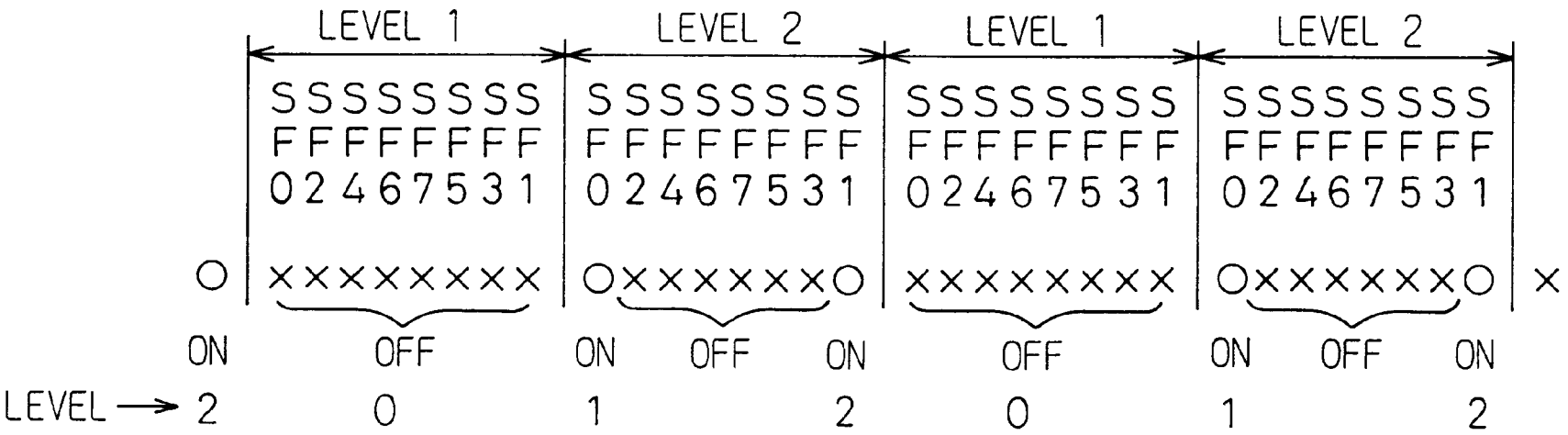
FIG. 55 shows a sequence of sub-frames during which a cell is lit in the sixteenth embodiment of the present invention.

FIG. 55 shows a sequence of sub-frames during which a cell is lit in this embodiment. In FIG. 55, when a sequence of sub-frames is sub-frames SF0, SF2, SF4, SF6, SF7, SF5, SF3, and SF1, when display data causing a cell to glow with a low-order bit of value transition according alternately to low gray-scale levels, for example, gray-scale levels 1 and 2 is input, a bit corresponding to a sub-frame within one frame during which a cell should be lit is delayed till an adjoining frame. Thereby, the display data is modified so that the cell glows according alternately to gray-scale levels 3 and 0 at intervals of a glow cycle that is the same as a frame. Thus, the glow cycle or an interval between sub-frames during which a cell is lit becomes shorter than it conventionally is. Flicker or the like does not therefore occur.

To be more specific, when display data causing a cell to glow with a low-order bit of value transition according alternately to low gray-scale levels, for example, gray-scale levels 1 and 2, a bit corresponding to a sub-frame within one frame during which a cell should be lit is delayed till an adjoining frame. Thus, the display data is modified so that the cell is lit according alternately to gray-scale levels 3 and 0. Consequently, a glow cycle or an interval between sub-frames during which the cell is lit becomes shorter than it conventionally is and no flicker occurs.

According to the present invention, when intraframe time-division multiplexing is used to render gray-scale levels at a plurality of display cells, even if a gray-scale level is relatively low, a glow cycle or an interval between sub-frames during which the cell is lit can be shortened by combining bits corresponding to sub-frames within two adjoining frames. Consequently, it becomes possible to prevent occurrence of a display defect deriving from flicker or the like.

Furthermore, an alternative technique is such that sub-frames associated with larger weights of luminance are arranged alternately across a sub-frame associated with the smallest weight of luminance within one frame, a bit corresponding to a sub-frame associated with a larger weight of luminance during which a cell should be lit is converted to the one corresponding to a sub-frame within an adjoining frame during which a cell should be lit, and thus a gray-scale level is rendered.

Furthermore, according to the present invention, even when a gray-scale level is relatively high, sub-frames associated with smaller weights of luminance are arranged in the center of a frame, and bits corresponding to sub-frames within two adjoining frames during which a cell should be lit are combined. Thus, a glow cycle or an interval between sub-frames during which a cell is lit can be shortened. Consequently, occurrence of a display defect deriving from flicker or the like can be prevented.

Because a plasma display device according to the present invention has the configuration as described above, even in the case in which a specific gray-scale level is displayed repeatedly, because the sub-frame sustained discharge sequence is appropriately changed, the repetition of the sustained discharge sequence in the same pattern is prevented, and because high-intensity sub-frames are largely located in the temporal center of the sustained discharge period of the frame, it is possible to prevent the above-described formation of a low-frequency component, and as a result there is effective avoidance of such image defects as flicker.

Additionally, in the present invention, since there is no periodicity in the turn-on sequence in the sub-frame sustained discharge period, it is possible to prevent the generation of partial flicker such as occurred with the prior art methods.

As described above, in a plasma display method according to the present invention because, in addition to locating a plurality of sub-frames having the same intensity weight within a given frame and setting the specific sequence of turning these on, and by making them overlap the light/dark lines occurring in the past are changed to light/dark dots, so that these appear to cancel out each other, thereby eliminating this light/dark part, and further because the emission of light within a frame is done so as to disperse the intensity, it is possible to bring about the effect of blurring a moving image, thereby enabling suppression of the problem of generation of false color contours.

In addition, because in the present invention, in comparison with the prior art, there are more sub-frames at the beginning and end of a frame that are turned on, it has the effect of shortening the longest blank periods, thereby suppressing the problem of the image flickering.

In addition, in the present invention, by making use of the surface gray-scale method of causing sub-frames to overlap, for a given gray-scale level, there are sub-frames which are turned on and sub-frames which are not turned on, thereby temporally dispersing the load, and if the 1st and 2nd modes are mixed in staggered pattern, as shown in FIG. 21(C) or (D), the resulting effect is that the apparent line-impedance and sustaineder output impedance, are both reduced, thereby reducing the grayscale display level load ratio dependency.

And further, in the present invention, when making use of the surface gray-scale method which mixes sub-frames, frames by shifting the intensity level data for each dot, in addition to intraframe time-division multiplexing, it is possible to achieve gray-scale levels utilizing the surface gray-scale producing method, thereby enabling an increase in the number of gray-scale levels that can be displayed, without sacrificing the above-described effects.

Furthermore, according to the present invention, the number of combinations of sub-frames for realizing gray-scale levels can be increased efficiently. A difference in relative timing of a sub-frame associated with a higher luminance level, during which a cell glows, resulting from a change in gray-scale level can therefore be minimized. Consequently, a false colored contour phenomenon occurring in a motion picture can be suppressed.

Moreover, according to the present invention, since a cell is more likely to glow during sub-frames arranged at the start and end of a frame than it conventionally is, a maximum blank period can be shortened. Flicker that is a problem in a picture can be suppressed.

Furthermore, according to the present invention, a bit corresponding to a sub-frame within one frame during which a cell should be lit is displayed in combination with a bit corresponding to a sub-frame within an adjoining frame. When a gray-scale level is rendered by lighting a cell during sub-frames arranged mutually apart within one frame, occurrence of a display defect deriving from flicker or the like can be prevented and display definition can therefore be improved. In particular, when sub-frames associated with smaller weights of luminance are arranged alternately across a sub-frame associated with the largest weight of luminance in an effort to reduce flicker occurring due to a transition during a sub-frame associated with the largest weight of luminance, even if a gray-scale level is low, flicker will not occur with a low-order bit of value transition corresponding to a sub-frame arranged by the side of the sub-frame associated with the largest weight of luminance. This results in improved display quality.

Furthermore, according to an image display apparatus of the present invention, even when sub-frames associated with larger weights of luminance are arranged at both ends of a frame, since a bit is combined with a bit corresponding to a sub-frame within an adjoining frame in order to render a gray-scale level, flicker or the like will not occur with a high-order bit of value transition corresponding to a sub-frame arranged at either of the both ends of the frame. This results in improved display quality. Furthermore, even when a gray-scale level is relatively low, a glow cycle or an interval between sub-frames during which a cell is lit becomes shorter or becomes equal to about one frame. Consequently, flicker will not occur.

In particular, for a still image in which occurrence of flicker is critical, flicker can be alleviated. The display of a high-definition picture with little flicker can be expected.

What is claimed is:

1. An image intraframe time-division multiplexing type display device in which one frame, during which an image is displayed on a display panel, comprises a plurality of sub-frames, and a cell is lit selectively during said plurality of sub-frames in order to render a gray-scale level, comprising:

an output change judgment circuit judging whether or not bits, corresponding to sub-frames arranged near either of a start or an end of a previous frame, should be displayed in place of those of a present frame; and a control circuit providing control so that the bits of the previous frame, which are judged to be displayed in place of those of the present frame by said output change judgement circuit, are displayed during the present frame.

2. An intraframe time-division multiplexing type display device according to claim 1, comprising:

a frame delay circuit delaying an image by one frame, wherein said output change judgment circuit judges whether or not the bits of the previous frame should be displayed in place of those of the present frame by comparing an image with the image delayed by said frame delay circuit; and said control circuit comprises an output switching circuit selecting either of the bits of the previous frame or those of the present frame according to an output of said output change judgement circuit.

3. An intraframe time-division multiplexing type display device according to claim 1, wherein:

a sequence of sub-frames is such that sub-frames associated with smaller weights of luminance are arranged alternately across a sub-frame associated with a largest weight of luminance within one frame; and said output change judgement circuit judges that the bits of the previous frame should be displayed in place of those of the present frame when more of sub-frames, associated with larger weights of luminance among sub-frames, are lit.

4. An intraframe time-division multiplexing type display device according to claim 1, wherein:

a sequence of sub-frames is defined such that sub-frames, associated with larger weights of luminance within one frame, are arranged alternately at the start and end of the frame;

said output change judgement circuit judges that the bits of the previous frame should be displayed in place of those of the present frame when at least one of sub-frames associated with larger weights of luminance among sub-frames changes.

5. An intraframe time-division multiplexing type display device according to claim 1, further comprising:

a circuit judging whether an image represented by said display data is an animated image or a still image and, only when judging that said image is a still image, producing an output validating the operation of said output change judgment circuit.

* * * * *

UNITED STATES PATENT AND TRADEMARK OFFICE

CERTIFICATE OF CORRECTION

PATENT NO. : 6,222,512 B1
DATED : April 24, 2001
INVENTOR(S) : Masaya Tajima et al.

It is certified that error appears in the above-identified patent and that said Letters Patent is hereby corrected as shown below:

Title page,
Item [75], Inventors, delete "Naoki Matsui" and "Kyoji Kariya".

Item [30], Foreign Application Priority Data, change "6-284244" to -- 6-264244 --.

Signed and Sealed this

Twenty-ninth Day of January, 2002

*Attest:*

*Attesting Officer*

JAMES E. ROGAN
*Director of the United States Patent and Trademark Office*